US005443248A

United States Patent [19]

Hayashi et al.

[11] Patent Number: 5,443,248

[45] Date of Patent: Aug. 22, 1995

[54] SHEET POST-PROCESSING APPARATUS

[75] Inventors: Kenichi Hayashi, Tokyo; Yoshifumi Takehara, Yokohama, both of Japan

[73] Assignee: Canon Kabushiki Kaisha, Tokyo, Japan

[21] Appl. No.: 82,957

[22] Filed: Jun. 29, 1993

[30] Foreign Application Priority Data

Jun. 29, 1992 [JP] Japan ..... 4-171082
Jun. 30, 1992 [JP] Japan ..... 4-173240

[51] Int. Cl.[6] ..... B42C 1/12; G03G 21/00

[52] U.S. Cl. ..... 270/53; 270/58; 355/323; 355/324

[58] Field of Search ..... 270/53, 58; 355/323, 355/324

[56] References Cited

U.S. PATENT DOCUMENTS 4,295,733 10/1981 Janssen et al. ..... 355/323
4,361,393 11/1982 Noto ..... 270/58 X
4,552,497 11/1985 Kockler et al. ..... 270/53 X
4,946,152 8/1990 Ishikawa et al. ..... 270/58 X
4,971,302 11/1990 Morii et al. ..... 270/53
5,007,625 4/1991 Kremers et al. ..... 270/53
5,020,784 6/1991 Asami et al. ..... 270/53
5,067,767 10/1991 Emigh et al. ..... 270/58
5,174,556 12/1992 Taylor et al. ..... 270/53 X
5,186,445 2/1993 Nakanishi et al. ..... 270/58 X
5,384,634 1/1995 Takehara et al. ..... 270/53 X

FOREIGN PATENT DOCUMENTS 60-262373 12/1985 Japan .
63-262373 10/1988 Japan .
1-146674 6/1989 Japan .

*Primary Examiner*—John E. Ryznic
*Attorney, Agent, or Firm*—Fitzpatrick, Cella, Harper & Scinto

[57] ABSTRACT

A sheet post-processing apparatus includes at least one sheet discharging tray for receiving and stacking sheets discharged; a first feeder for feeding a set of sheets on the discharging tray; an intermediate tray for stacking the set of sheets fed by the first feeder; a second feeder for feeding the set of sheets on the intermediate tray; a stacking tray for stacking the set of sheets fed by the second feeder.

21 Claims, 49 Drawing Sheets

SHEET POST-PROCESSING APPARATUS

FIELD OF THE INVENTION AND RELATED ART

The present invention relates to a sheet post-processing apparatus provided with a stacker, more particularly to a sheet post-processing apparatus comprising a sorter for sorting and accommodating sheets such as copy sheets discharged from an image forming apparatus such as a copying machine, printer or the like after image formation on one or more bin trays, and a stacker for stacking sets of sheets. Proposal has been made as to a sheet post-processing apparatus capable of sorting and accommodating the number of sets of sheets which is larger than the number of bin trays. The apparatus comprises a sorter for sorting and accommodating the sheets on one or more bin trays, and a stacking tray for stacking sets of sheets discharged from bin trays of the sorter.

Referring first to FIG. 54, there is shown an example of conventional apparatus in a top plan view. A sorter 600 is disposed downstream of a image forming apparatus 500 and having one or more bin trays 601 arranged vertically. A stacker 700 is disposed in front of the sorter 600 so that the sets of sheets received by the bin trays 601 are sequentially accommodated into a stack tray 701 of the stacker 700.

FIG. 54 is a sectional view of the apparatus of FIG. 54. A set of sheets is gripped by rollers 702 and 703 constituting a pair, and rotated in the same direction, by which it is transferred from the bin tray 601 to the stacking tray 701. However, the conventional example involves the following problems.

(1) As shown in FIG. 58, the bin trays of the sorter are usually inclined. If the stack tray is inclined correspondingly, the alignment of the sets of sheets is not satisfactory. If the stack tray is horizontal, the alignment of sheet sets is still non-satisfactory since the sets of sheets are transferred from the inclined bin trays to the horizontal stacking tray.

(2) As shown in FIG. 56, the set $S_A$ of the sheets already staked on the stacking tray 701 and a leading edge of the set $S_B$ of the sheets to be stacked next, are contacted, by which the topmost sheet Pa of the already stacked sheet set $S_A$, is urged in the conveying direction. Therefore, a deviation preventing member or the like is required to confine the already stacked sheet $S_A$, with the possible result of complicated structure.

(3) When a set of sheet to be transferred from the bin tray to the stacking tray 701 has been stapled in the sorter, as shown in FIG. 57, a leading edge of the next set $S_B$ of the sheets contacts a staple $H_R$ of the already stacked set $S_A$ of sheets, with the result that the leading end portion of the set $S_B$ of the sheets is folded, or the already stacked sheet $S_A$ is deviated.

(4) When a set of a small number of sheets (2–5 approx.), is stapled by a stapler $S_T$, and a large number of such sets of sheets are accommodated on the stacking tray 701, as shown in FIG. 58, the stapled end portions become bulky as compared with the leading end portions because of the presence of the staples $T_R$, and therefore, a loop R occurs with the increase of the number of stacked sets. The sets of sheets in the lower portion of the stack have a low degree of loop, and therefore, the alignment can be accomplished by abutting the trailing end portions to a reference wall W. However, the upper sets of sheets have a large degree of loop with the result of improper alignment. In order to maintain horizontal sheet surface on the stack tray at all times, it is required to control the angle of the stack tray with the result of complicated structure.

From the standpoint of low cost, the sheet set conveying means is preferably roller type. However, when the sheet sets are advanced by a pair of rollers, they are deviated for the following reasons.

As shown in FIG. 59, the rollers 702 and 703 nip the set of sheet with sufficient force f to convey the set of sheets S. At this time, since the sheet is an elastic material, a deformation w occurs as shown in the Figure. The radius of curvature r of the deformation w is $r_0$ ($r_0$ is a radius of the roller) in the case of the directory contacted sheet. However, it increases toward the center, and therefore, the moved distance of the sheet by a predetermined rotational angle of the roller, is large for the central sheet. As a result, as shown in FIG. 60, the sets of sheets are stacked on the stacking tray 701 with the central sets A are projected.

SUMMARY OF THE INVENTION

Accordingly, it is a principal object of the present invention to provide a sheet post-processing apparatus capable of conveying and stacking a larger number of sheet sets than the number of bin trays to a stacking tray with proper alignment, irrespective of whether the set of sheets is stapled or not.

According to an aspect of the present invention there is provided a sheet post-processing apparatus comprising at least one bin tray for sortedly receiving sheets, sheet discharging means for discharging the sheet onto the bin tray, a stacking means for taking the sheets out of the bin tray and for stacking them, first sheet conveying means in said stacking means for conveying the sheets on the bin tray, an intermediate tray in said stacking means for accommodating the conveyed sheets, a second sheet conveying means for conveying the sheets on the intermediate tray, and a stacking tray for receiving and stacking the conveyed sheets.

Because of the provision of the intermediate tray, the stapling operation can be carried out on the intermediate tray. As is contrasted to a stapler between bin trays, the intermediate tray stapler is free from a limitation of intervals between bin trays, and therefore, a large capacity stapler is usable. For example, such a thick set of sheets as are stacked on two bin trays can be stapled.

If the intermediate tray is inclined correspondingly to the inclination of the bin tray, and the stacking tray is made horizontal, the alignment of the sheet sets on the stacking tray is improved.

A vertical reference plate may be provided on the stack tray at a position downstream of the stacking tray, and if this is done, the leading edges of the sheet sets conveyed by the second sheet conveying means can be abutted and aligned relative to the reference plate, and are stacked on the stacking tray. The leading ends of the sheet already stacked on the stacking tray may be continuously urged to the reference plate. By doing so, the aligned state can be maintained when the stacked sheet sets are contacted by a sheet set conveyed to the stacking tray.

The sheet set which has been stapled at its trailing edge by stapling means or the like on the bin tray, is conveyed by the second sheet conveying means with the non-stapled leading end portions (opposite from the stapled end of the preceding sheet set), and is abutted to the reference plate, so that the stacking performance of the stacking tray is improved.

The conveying means may convey a plurality of sheet sets with the lower side of the set being leading. By doing so, the lower part is first abutted to the reference plate, and then, the upper sheet moves to the reference plate by the inertia force, sequentially. Therefore, all of the sheets are positioned by the reference plate, and aligned thereby.

The conveying portion moves to the stacking tray the sheet sets from bottom one of the sheet stacking bins. By doing so, all of the sheets can be moved to the stacking tray even if the sheet accommodating amount of the stacking tray increases.

There may be provided means for detecting sheet surface position at the lower limit position of the stacking tray and means for detecting the number of bin trays existing above the detected sheet surface. By this, even when the sheet surface position on the stacking tray increases with sheet accommodating operation, the sheet can be accommodated continuously by the upper bin tray.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
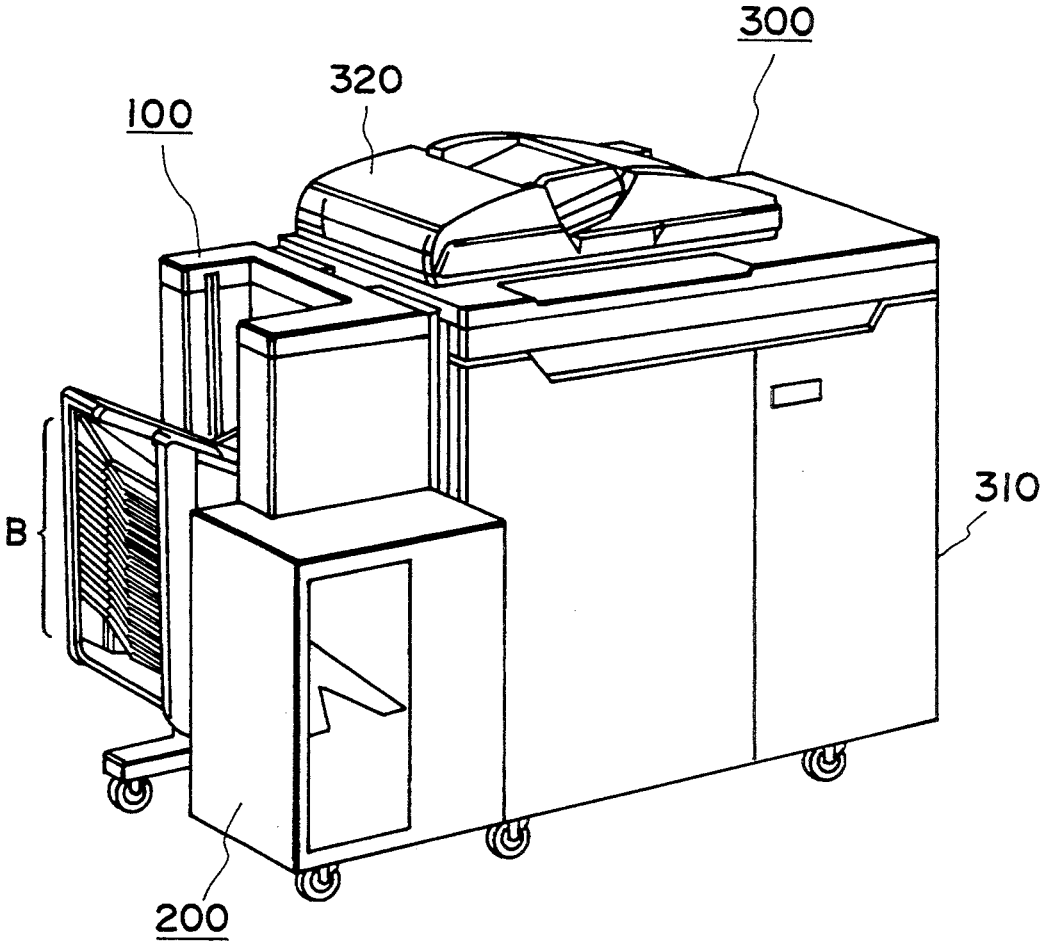
FIG. 1 is a perspective view of an image forming apparatus provided with a sheet post-processing apparatus according to an embodiment of the present invention.

Referring to FIG. 1, there is shown a general arrangement of a sheet post-processing apparatus according to an embodiment of the present invention. A sorter 100 having at least one bin tray B is disposed at a downstream side of an image forming apparatus 300, and a stacker 200 for stacking the sheet sets is disposed at the front side of the sorter 100.

Figure 2:
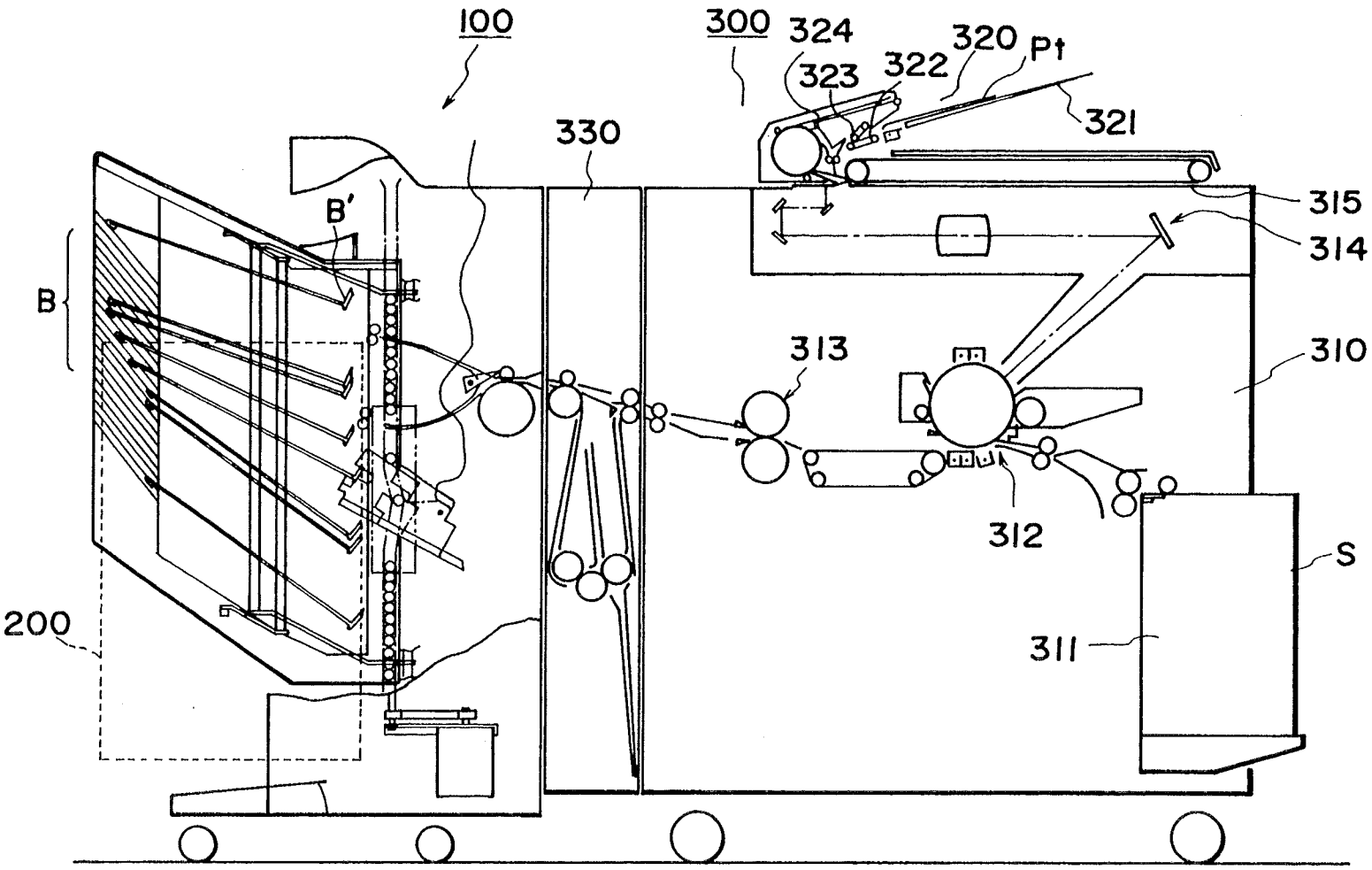
FIG. 2 is a front sectional view of the same.

FIG. 2 is a sectional view of an image forming apparatus 300. As shown in this Figure, the image forming apparatus 300 comprises a copying machine 310 (sheet supply deck 311, a photosensitive member 312, an image fixing device 313, an image reader 314, a platen glass 315 and the like), an automatic document feeder 320 on the top of the copying machine 310, and a sheet folding device 330 disposed downstream of the copying machine 310.

Originals P1 stacked on an original stack 321 of the automatic document feeder 320, are separated one-by-one from the bottom by a separating means 322, and the original is supplied onto the platen glass 315 of the copying machine 310 through a path 323, and is read a preset number of times by an optical system of the copying machine 310. Thereafter, it is discharged to the top surface of the original stack 321 through a path 324. Between the copied originals and uncopied originals, there is a partition lever for the discrimination therebetween.

Figure 3:
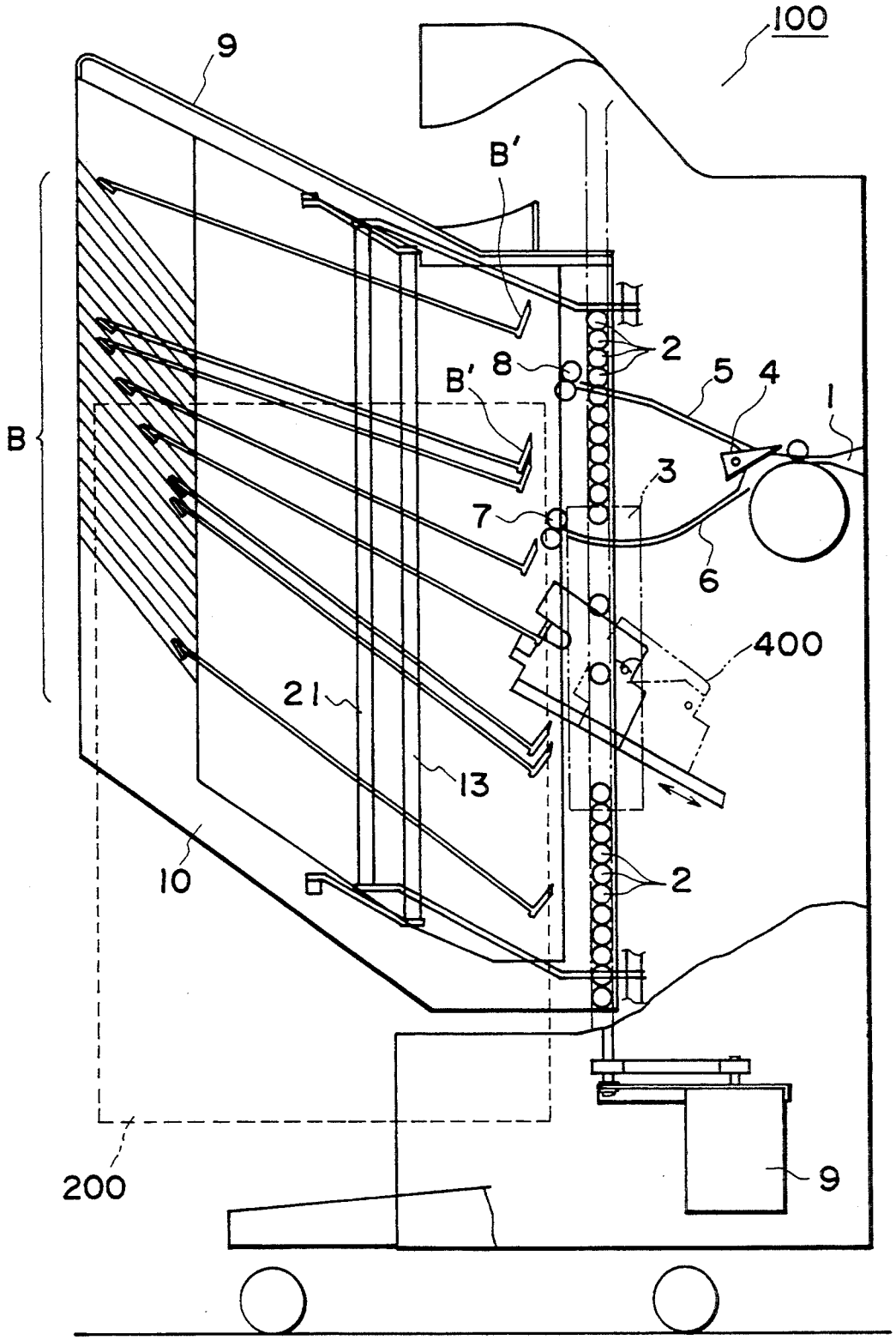
FIG. 3 is an enlarged front sectional view of a sorter of the same.

FIG. 3 is a sectional view of a sorter 100 having one or more bin tray B arranged vertically. Pins 2 and 2 provided at both end portions of the bin tray B are engaged with respective grooves formed on a lifting rotatable member 3 and 3. By one rotation (by motor 9) of the rotatable members 3 and 3, it is lifted or lowered one-by-one bin. The copy sheet from the image forming apparatus 300 is received by a guide inlet 1 of the sorter 100, and is deflected by a flapper 4 to a path which is different depending on whether the sorter 100 is to be operated in a non-sorting mode and a sorting mode. In the non-sorting mode, the flapper 4 is at a broken line position, so that the sheet is accommodated into a non-sorting tray 9 by discharging rollers 8 through a non-sorting path 5. On the other hand, in the sorting mode, the flapper 4 takes the solid line position, so that the sheet is accommodated by the bin trays B, respectively, by the discharging roller 7 through a sorting path 6.

Designated by a reference numeral 400 is a stapling unit 5 stapling a set of sheets accommodated on the bin tray B. At the front side of the sorter 100, there is a stacker 200 which will be described in detail thereinafter to receive all the sets of sheets, as indicated by broken lines.

The description will be made as to a bin unit having the bin trays B and aligning means which will be described in detail hereinafter, for aligning the sheet accommodated in the bin tray.

Figure 4:
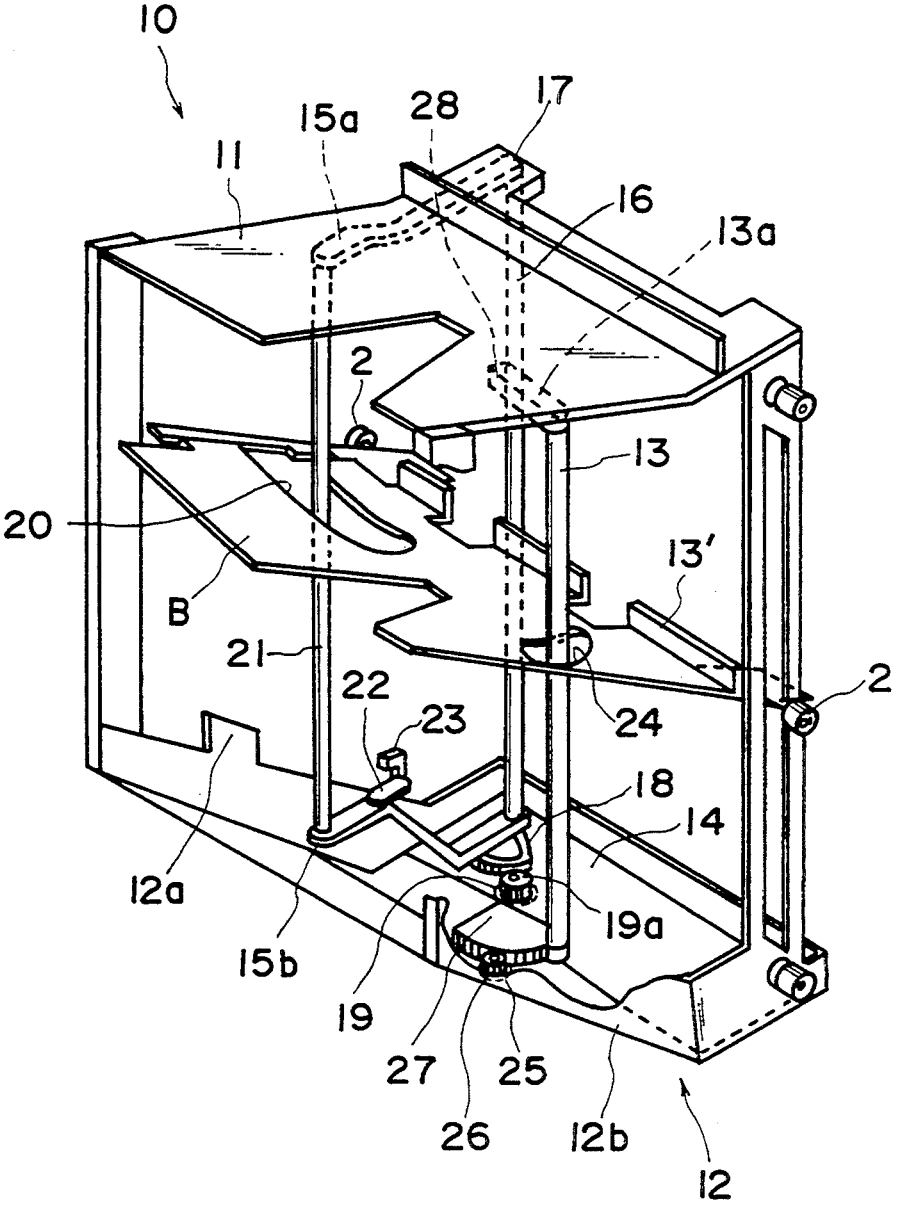
FIG. 4 is a perspective view of a major part of the sorter.

As shown in FIG. 4, the bin unit 10 is provided with an alignment reference member 13 to which the sheets S are abutted, the reference member 13 extending from a bin cover 11 to a bottom portion of a bin frame 12.

A supporting plate 14 is fixed to a base portion of the bin frame 12. A central rotational shaft 14 is fixed to a top arm 15*a* at its top end and also fixed to a bottom arm 15*b* at its bottom end. On the supporting plate 14, the shaft 16 is rotatably supported relative to a shaft (not shown) of the supporting plate 14 and a shaft 17 on a pin cover 11.

On the supporting plate 14, a sector gear 14 is rotatably mounted about a rotational shaft on the supporting plate 14. The bottom arm 15*b* is fixed to the sector gear 18. Below the supporting plate 14, there is a pulse motor 19, and a gear 19*a* fixed to an output shaft of the pulse motor 19 is in meshing engagement with the sector gear 18.

Between an end of the bottom arm 15*b* and an end of the top arm 15*a*, an aligning rod 21 is extended through recesses 20 of all of the bins B, and the aligning rod 21 is swingable by rotation of the sector gear 18. The bottom arm 15*b* is provided with a light blocking plate 22, so that the light blocking plate 22 moves together with the bottom arm 15*b*, by which, a home position sensor 23 disposed at a rear side of the bin frame 12 is actuated or deactuated.

At the front side of the aligning rod 21, a reference rod 13 is disposed through cut-away portions 24 of all of the bins, similarly to the aligning rod 21. It is mounted to the supporting plate 14 fixed to the base end portions of the bin frame 12.

A pulse motor 25 is mounted on the supporting plate 14, and a gear 26 fixed to the output shaft of the pulse motor 25 is in meshing engagement with a sector gear 27. To the sector gear 27, a reference rod 13 is mounted. By the rotation of the pulse motor 25, the reference rod 13 swings about a pivot 28. The pivot 28 is provided by engagement between a projection at one end of the top arm 13*a* and a recess provided at a predetermined position of the bin cover 11.

Figure 5:
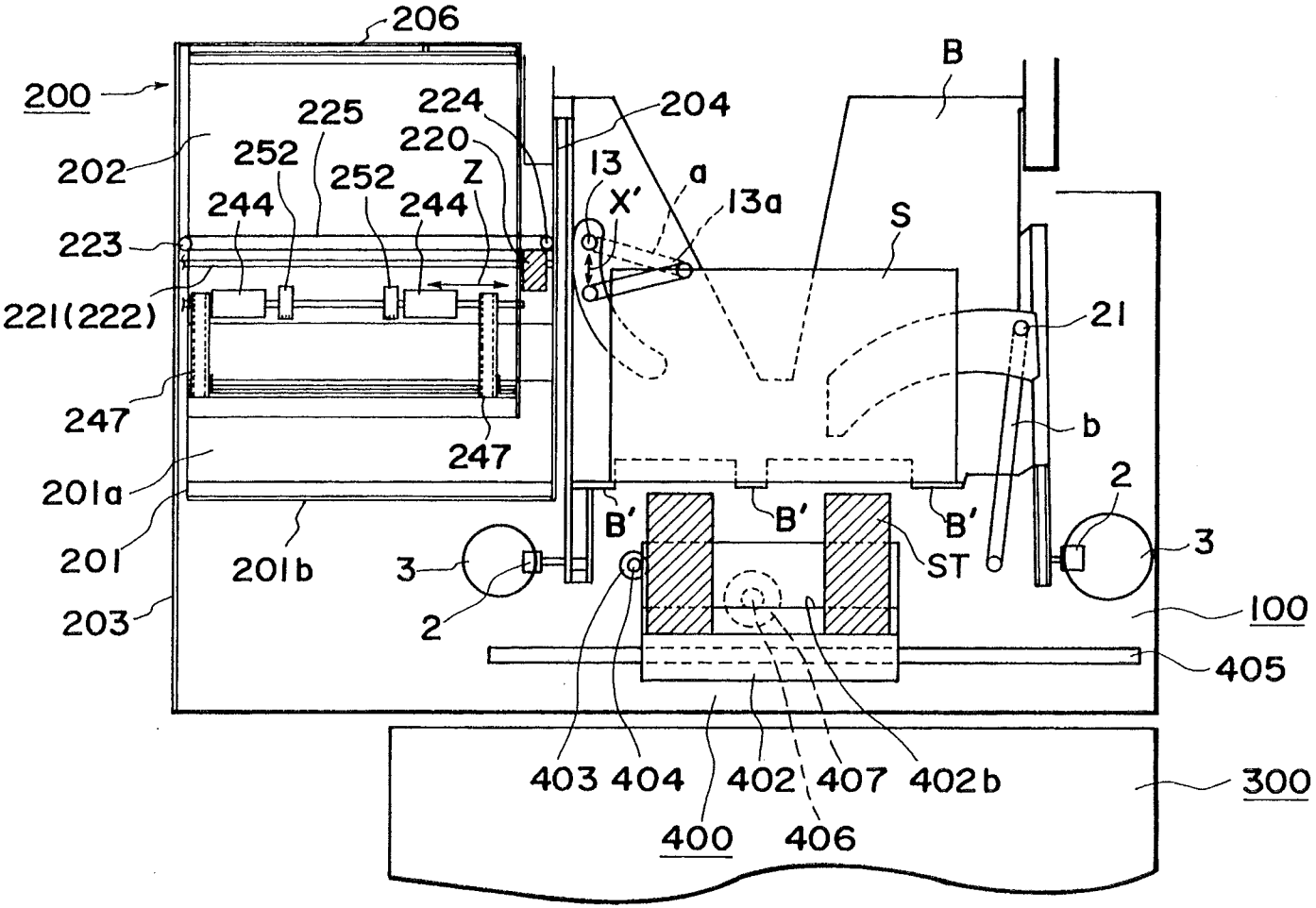
FIG. 5 is a top plan view of the sheet post-processing apparatus.

As shown in FIG. 5 which is a top plan view of the apparatus shown in FIG. 3, when the copying operation of the image forming apparatus 300 starts, the reference rod 13 having been placed at a stand-by position a (broken lines) moves by rotation of the pulse motor 25 in a direction X1, and stops at an alignment reference position (solid line).

A sheet S having an image formed thereon by the image forming apparatus 300 is discharged to the bin tray B by the discharging rollers 7 and 7, and then it moves toward a rear stopper B′ by the weight thereof on the bin tray B which is inclined downwardly toward the rear end stopper B′.

Figure 6:
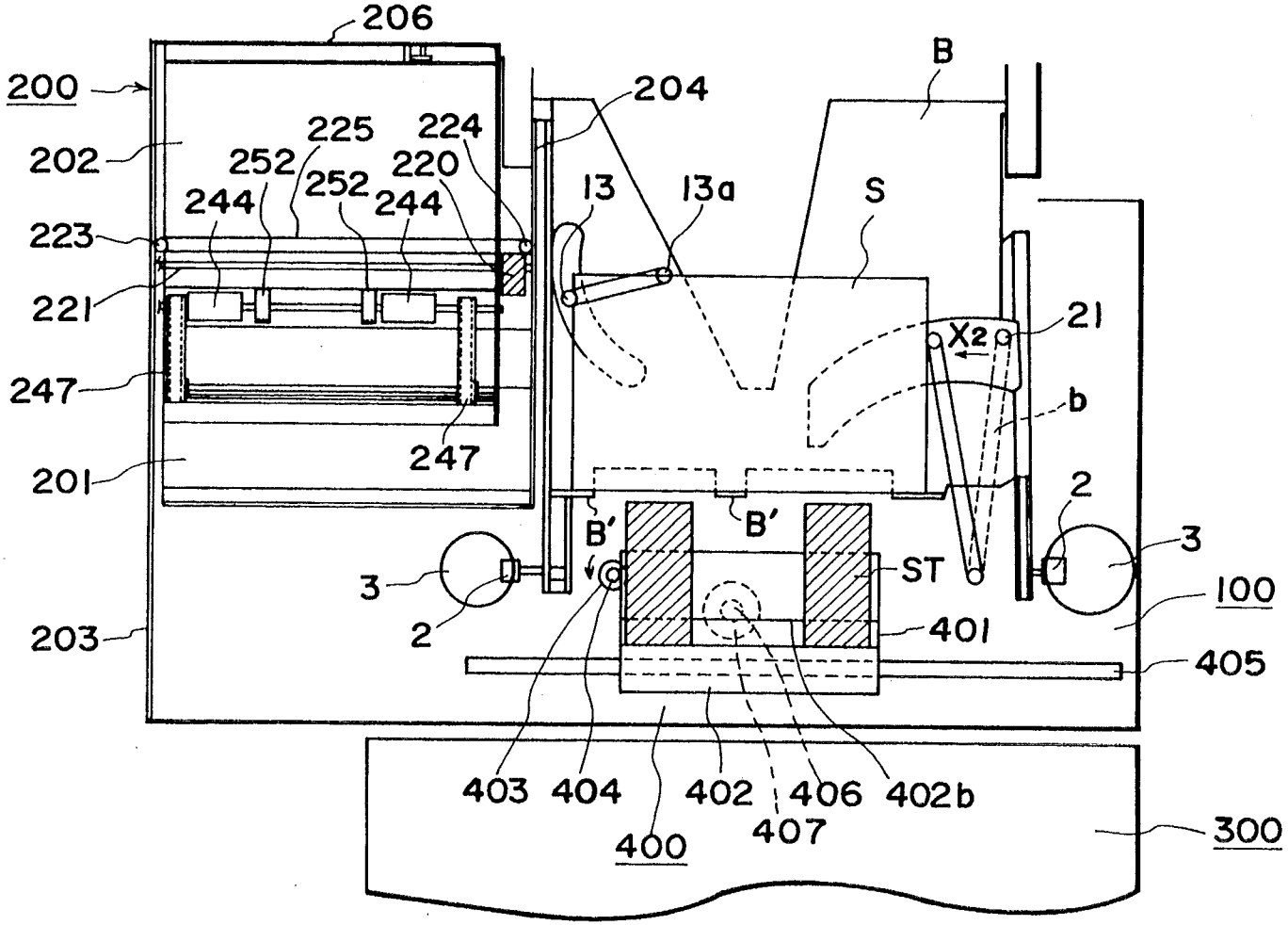
FIG. 6 illustrates operation of the sheet post-processing apparatus.

As shown in FIG. 6, the aligning rod 21 moves through a predetermined distance from a stand-by position b (broken line position) in the direction X2 by the pulse motor 19 rotating in accordance with the pulse signal corresponding to the size of the sheet, by which the sheet is urged to the reference rod 13 fixed at the alignment reference position.

The reference rod 13 is maintained at the reference position until all of the sheets from the image forming apparatus 300 are received by the bin trays B. However, the aligning rod 21 moves through a predetermined distance, and returns to its stand-by position b to prepare for the next sheet discharging. By repetitions of the above-described operation, a set of sheets S is received by a bin tray B with a lateral end abutted to the reference rod 13 and the trailing end abutted to the rear end stopper B′. Since the aligning rod 21 penetrate through all the bin trays, the sheets S accommodated in the other bin trays B are also aligned.

A stapling unit 400 provided in the sorter 100 staples the sheets stacked on the bin tray B supported by the lifting rotatable member 3.

Figure 7:
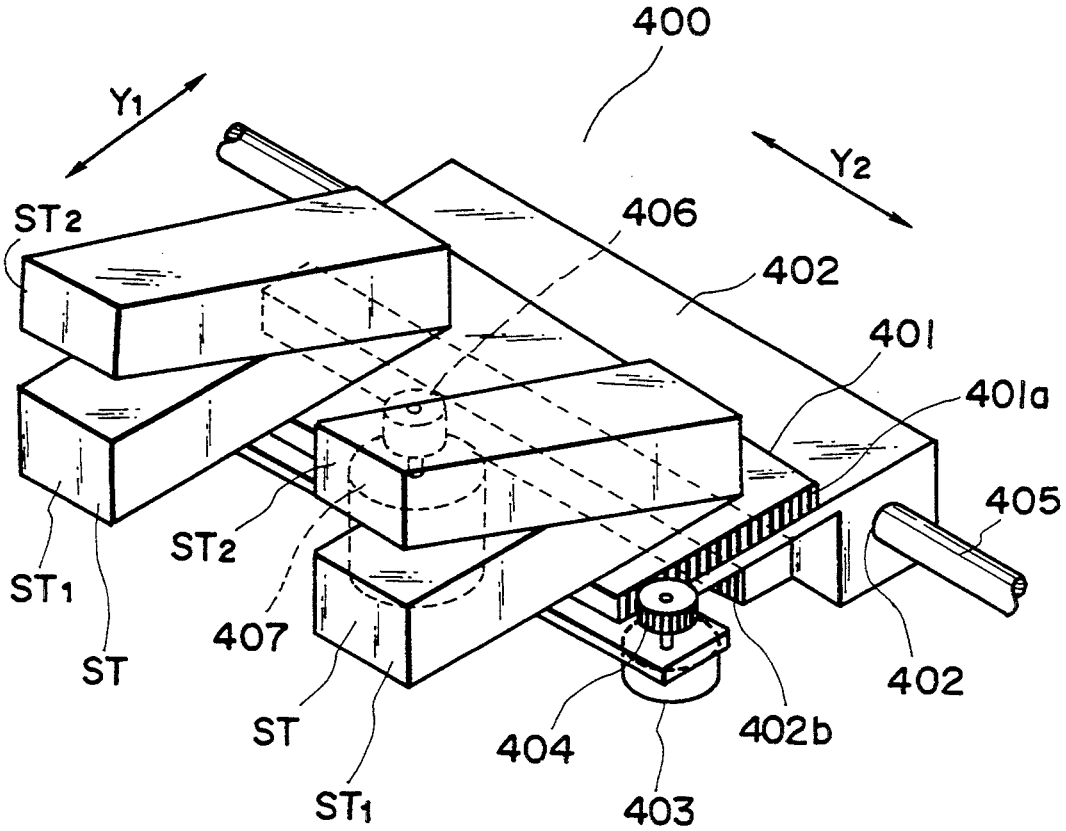
FIG. 7 is an enlarged perspective view of a stapler of the sheet post-processing apparatus.

As shown in FIG. 7, the stapling unit 400 comprises the same two electric stapler ST, and the electric stapler ST is fixed to the first tray 401. The first tray 401 is engaged with a second tray 402 disposed below it by an unshown guiding member. It is reciprocable in directions Y1 by meshing engagement between a rack gear 401*a* formed at a side of the first tray 401 and a pinion gear 404 of a motor 403 fixed on the second tray. A slit 402*a* of the second tray 402 is engaged with a guide rail 405 mounted on a sorter main frame (not shown). By the engagement between a rack gear 402*b* of the second tray 402 and a pinion gear 406 fixed to the motor 407 in meshing engagement with the rack gear 402*b*, it is smoothly reciprocable in directions Y2. An electric stapler ST is, for example, as disclosed in Japanese Laid-Open Patent Application No. 146674/1989, and therefore, the detailed description thereof is omitted. Briefly, the set of sheets is inserted between a bottom jaw ST1 and a top jaw ST2, and it is clinched by staple between them.

The description will be made as to the structure of the stacker 200. As shown in FIG. 5 (top plan view) and a front view (FIG. 8), the stacker 200 is provided with an intermediate tray 201 and a stacking tray 202. An end portion of the intermediate tray 201 has an inclined surface 201*a* parallel with the bin tray B of the sorter 100 and a rear end stopper 201*b*. Front end portion is in the form of a horizontal surface 201*c*, and is fixed to the side plates 203 and 204 at the front and rear of the stacker 200.

Figure 8:
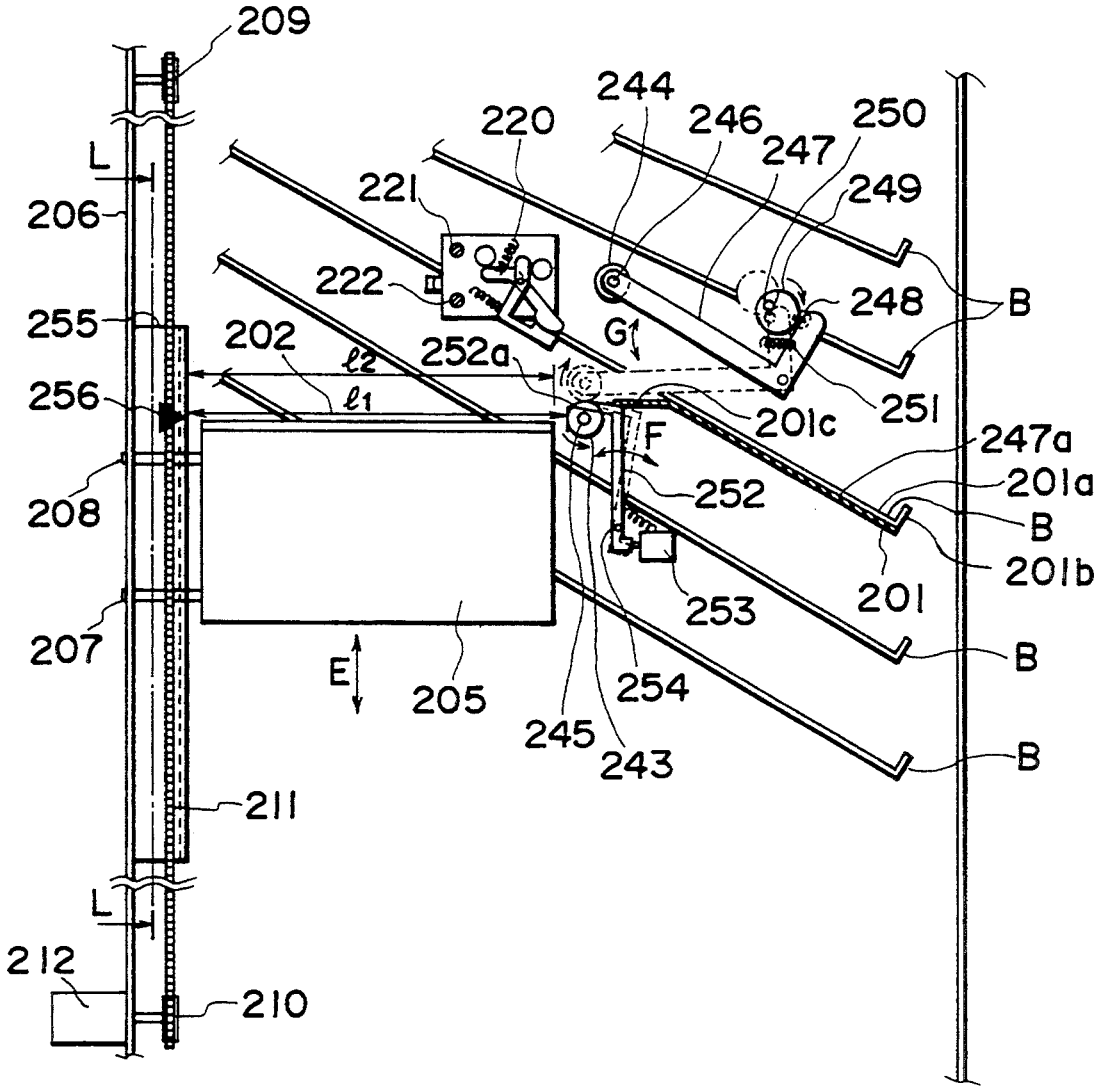
FIG. 8 is a front sectional view of the sheet post-processing apparatus.
Figure 9:
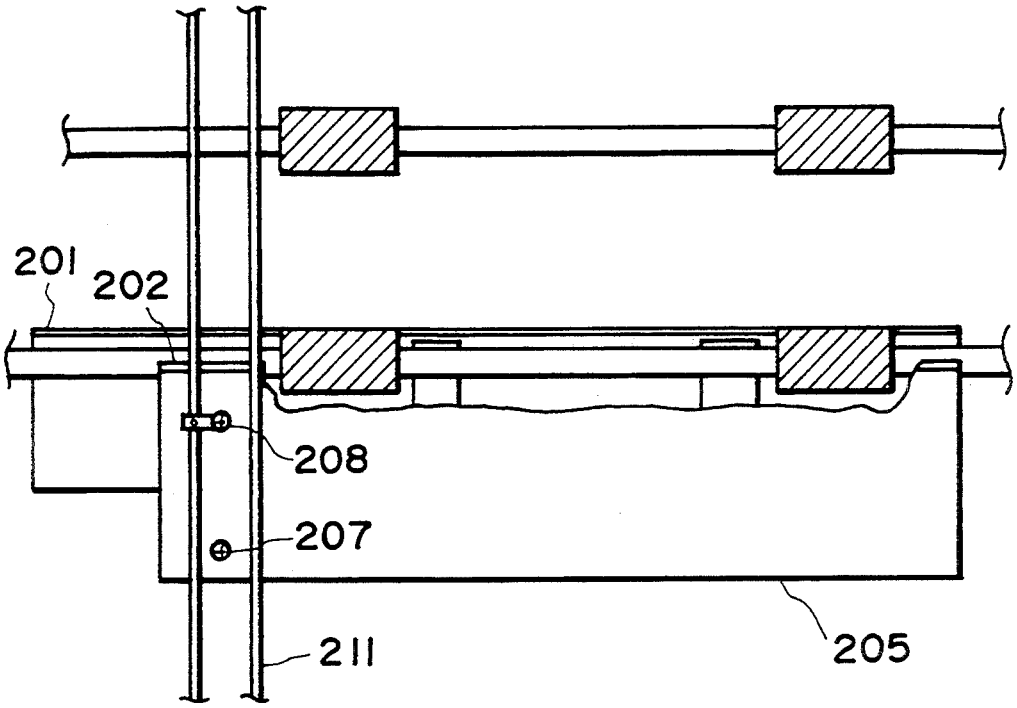
FIG. 9 is a sectional view taken along a line L—L in FIG. 8.

The stacking tray 202 is disposed upstream part of the intermediate tray 201, and is mounted horizontally on a base 205. At left end of the base 205, two pins 207 and 208 are projected, and are engaged with hole (not shown) extending vertically in a left side plate 206. As shown in FIG. 8 and FIG. 9 which is L—L section, pulleys 209 and 210 are vertically arranged on the left plate 206. Between the pulleys, a belt 211 is trained. A part of the belt 211 is fixed to the pin 208, and the base 205 and the stacking tray 202 is vertically movable by driving a motor 212 directly connected with the lower pulley 210.

Adjacent an end 201*c* of the intermediate tray 201, a gripper 220 for moving the sheet set from the bin tray B to the intermediate tray 201, is supported on rails 221 and 222 mounted between the front and rear plate 203 and 204. The front and rear plates 203 and 204 have pulleys 223 and 224 mounted thereon. A belt 225 is trained around the pulleys. A part of the belt 225 is fixed to the gripper 220. When the pulley 223 is rotated by an unshown motor, the gripper 220 reciprocates in a direction Z on rails 221 and 222 (FIG. 5).

Figure 10:
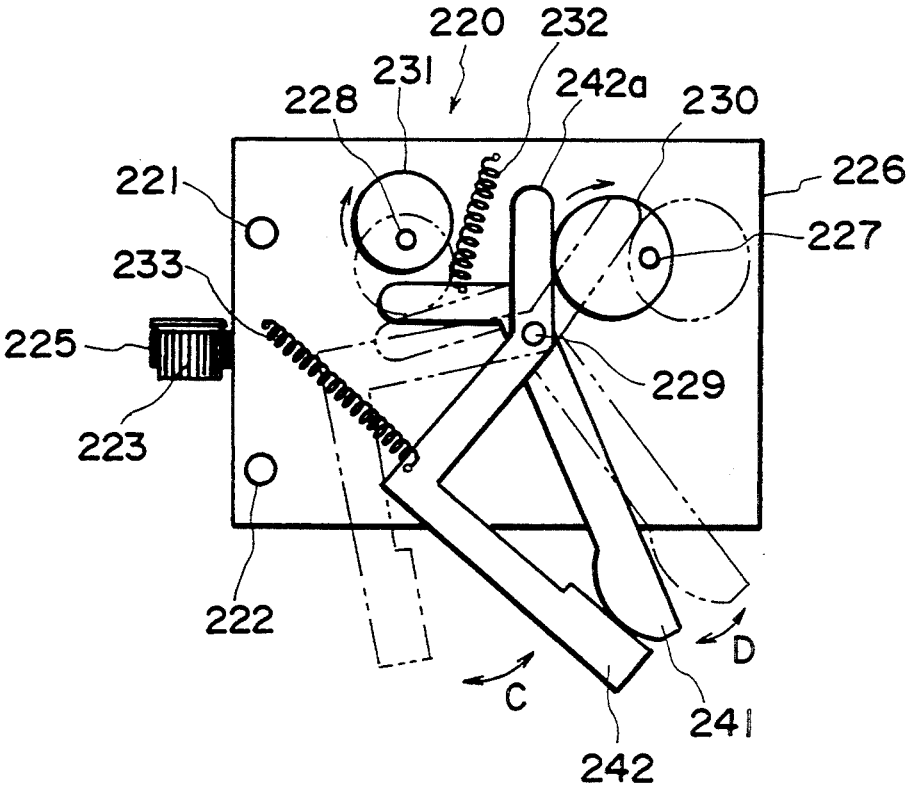
FIG. 10 is a front view of a sheet set gripping apparatus.

FIG. 10 shows in detail the gripper 220. Three shafts 227, 228 and 229 are supported on the side plates 226 and 226. The shaft 229 supports a top gripper 241 and a bottom gripper 242. By rotations of a bottom gripper cam 230 fixed on the shaft 227 and a top gripper cam 231 fixed to the shaft 228, the swinging motion in the directions in D and C, are repeated (solid lines and broken lines).

A spring 233 is provided to urge the cam portion 242*a* of the bottom gripper 242 to the bottom gripper cam 230. The spring 232 urges a cam portion 241*a* of a top gripper 241 to the top gripper cam 231 to provide substantially constant press-contact pressure between the top gripper and the bottom gripper.

The description will be made as to a pair of rollers for conveying the set of sheets accommodated temporarily on the intermediate tray 201 to the stacking tray 202.

As shown in FIG. 8, between the intermediate tray 201 and the stacking tray 202, there are top and bottom conveying rollers 244 and 243 constituting a pair. Two bottom conveying rollers 243 are mounted on the bottom conveying roller shaft 245 supported between the front and rear side plate 203 and 204. On the other hand, two top conveying rollers 244 is mounted on a top conveying roller shaft 246 supported between swingable arms 247 and 247, at a position faced to the bottom conveying roller 243. A roller 248 is mounted to an end of the swingable arm 247, and a swingable cam 249 contacted to the roller 248 is fixed to a swingable cam shaft 250 supported on the front and rear plate 203 and 204. The swingable cam shaft 250 is rotated in a direction indicated by an arrow by an unshown motor to swing the top swingable arm 247 about the shaft 247 in a direction G (solid lines and broken lines). The spring 251 always urges the roller 248 to the swingable cam 249 to provide a substantially constant press-contact pressure between the top conveying roller 244 and the bottom conveying roller 243.

The material of the top conveying roller 244 is rubber having a hardness of 40–60 degrees, and that of the bottom conveying roller 243 is foamed urethane material having a hardness of 10–20 degrees. The top conveying roller 244 has a friction coefficient to assuredly convey the sheet without slippage therebetween. The bottom conveying roller 243 is such that the friction coefficiency between the sheet and the bottom conveying roller is lower than that between the sheets. An outer dimension of the bottom and top conveying rollers 243 and 244 are the same. They are rotated at the same speed in the direction of the arrow by a motor and through transmitting means.

When the set of sheets is conveyed from the intermediate tray 201 to the stacking tray 202, a supporting arm temporarily supports the trailing end portion (leading end portion during conveyance) of the sheet set. The description will be made as to the supporting or holding arm.

As shown in FIG. 8, the holding arm 252 is disposed below the end portion 201*c* of the intermediate tray, and the holding portion 252*a* is disposed between the bottom conveying roller shaft 245 and the nip formed between the top and bottom conveying rollers. Two holding arms 252 are mounted on a shaft 254 (FIG. 5), and it swings about a shaft 254 in a direction F (solid line and broken lines) by actuation and deactuation of solenoid 253 connected to the bottom end of the holding arm 252 (FIG. 8).

To the left side plate 206 of the stacker 200, a reference plate 255 for alignment of the leading edges of the sheet set coming to the stacking tray 202, is mounted. At a predetermined position of the reference plate 255, a sensor 256 for detecting a surface of the stacking tray is disposed. The reference plate 255 is disposed so as to satisfy $l_1 > l > l_2$ when the solenoid 253 is energized, where $l_2$ is a distance between an end of the holding arm 252 and the reference plate 255, $l_1$ is a distance between a surface of a bottom conveying roller 243 and a reference plate 255, and $l$ is a length of the sheet set measured in the direction of the conveyance.

Operation of the apparatus will be described.

First, the description will be made as to the case in which the set of sheets is not stapled by the stapling unit 400 of the sorter 100.

Figure 11:
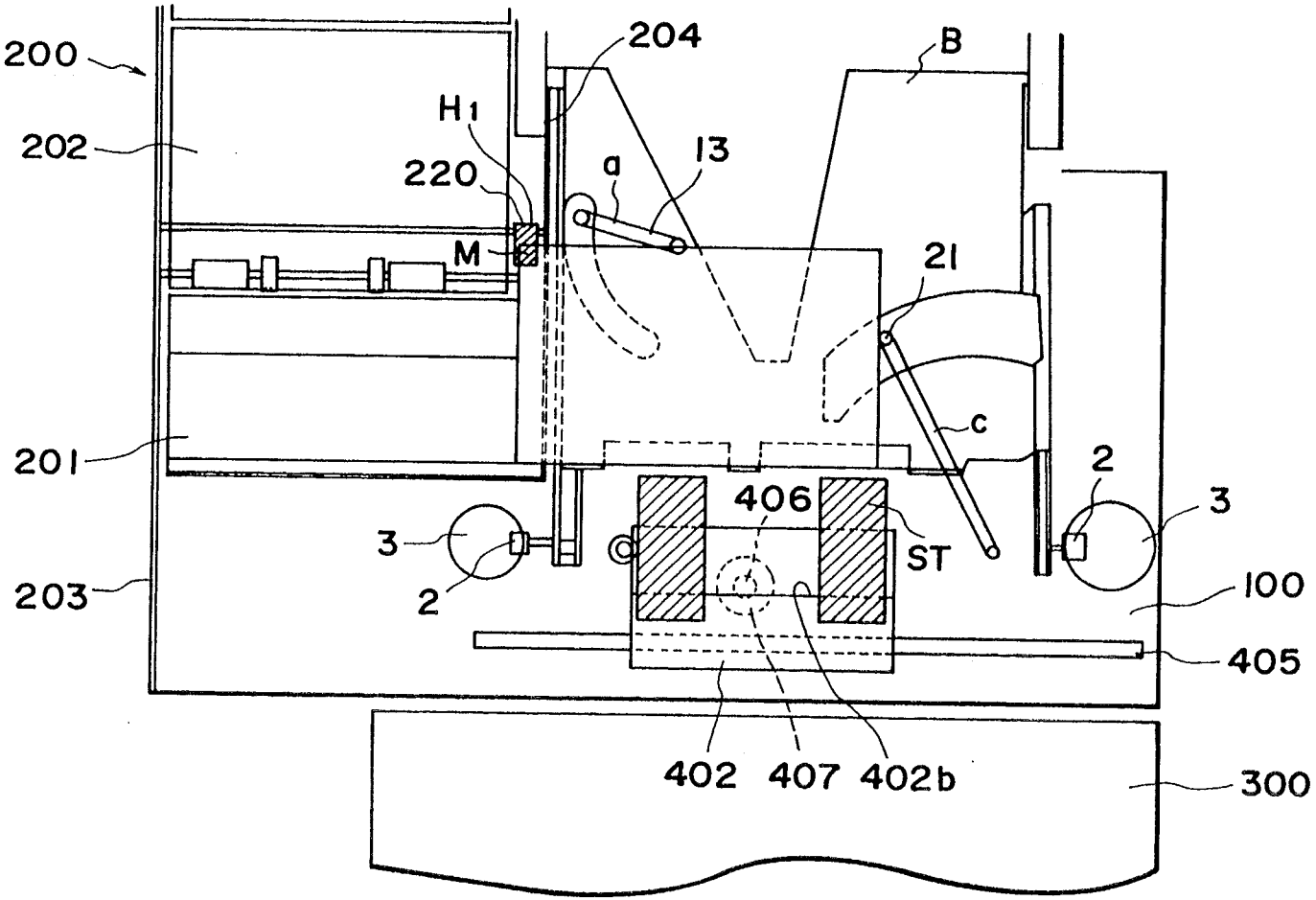
FIG. 11 illustrates operation of the apparatus shown in FIG. 5.
Figure 12:
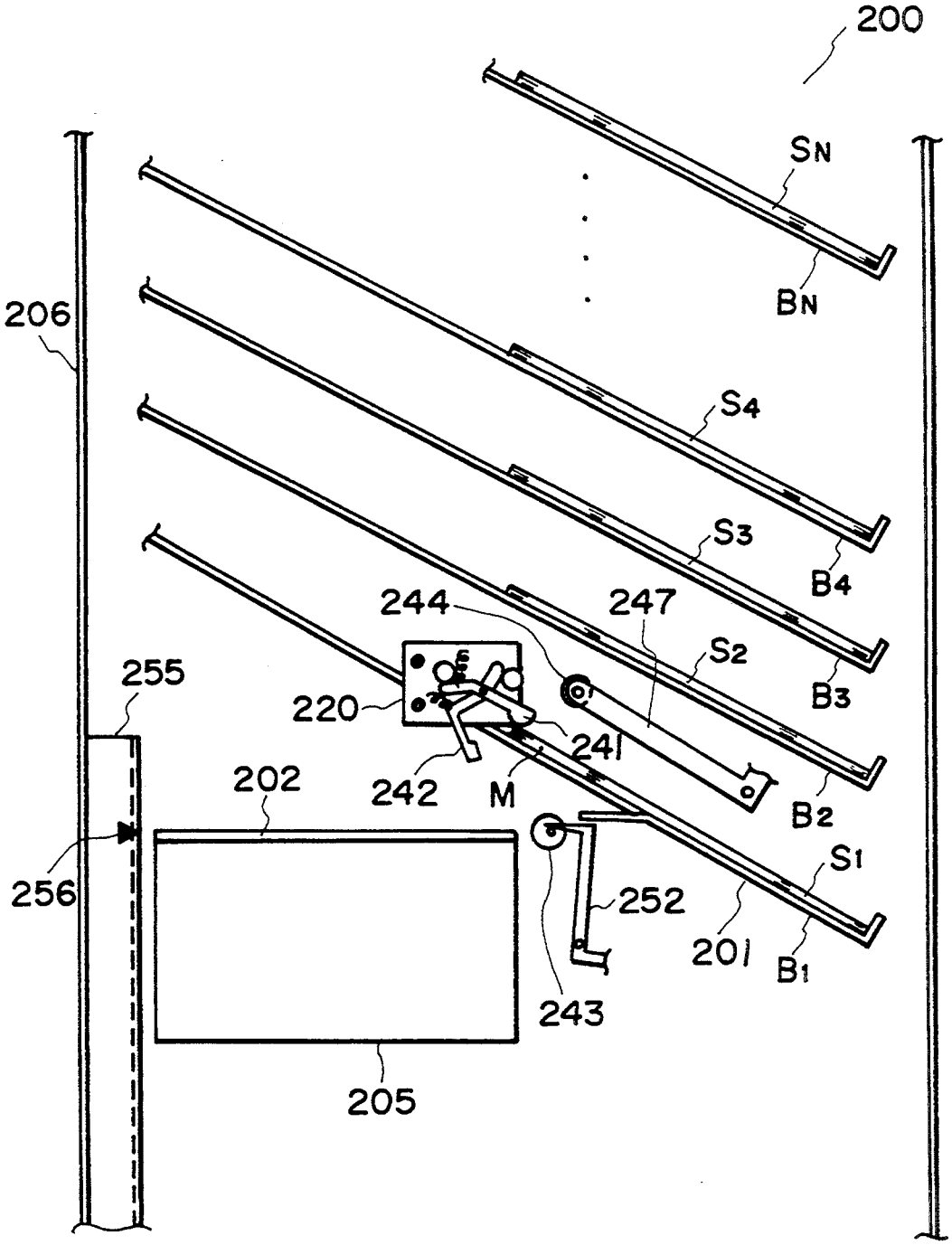
FIG. 12 illustrates operation of the apparatus of FIG. 8.
Figure 13:
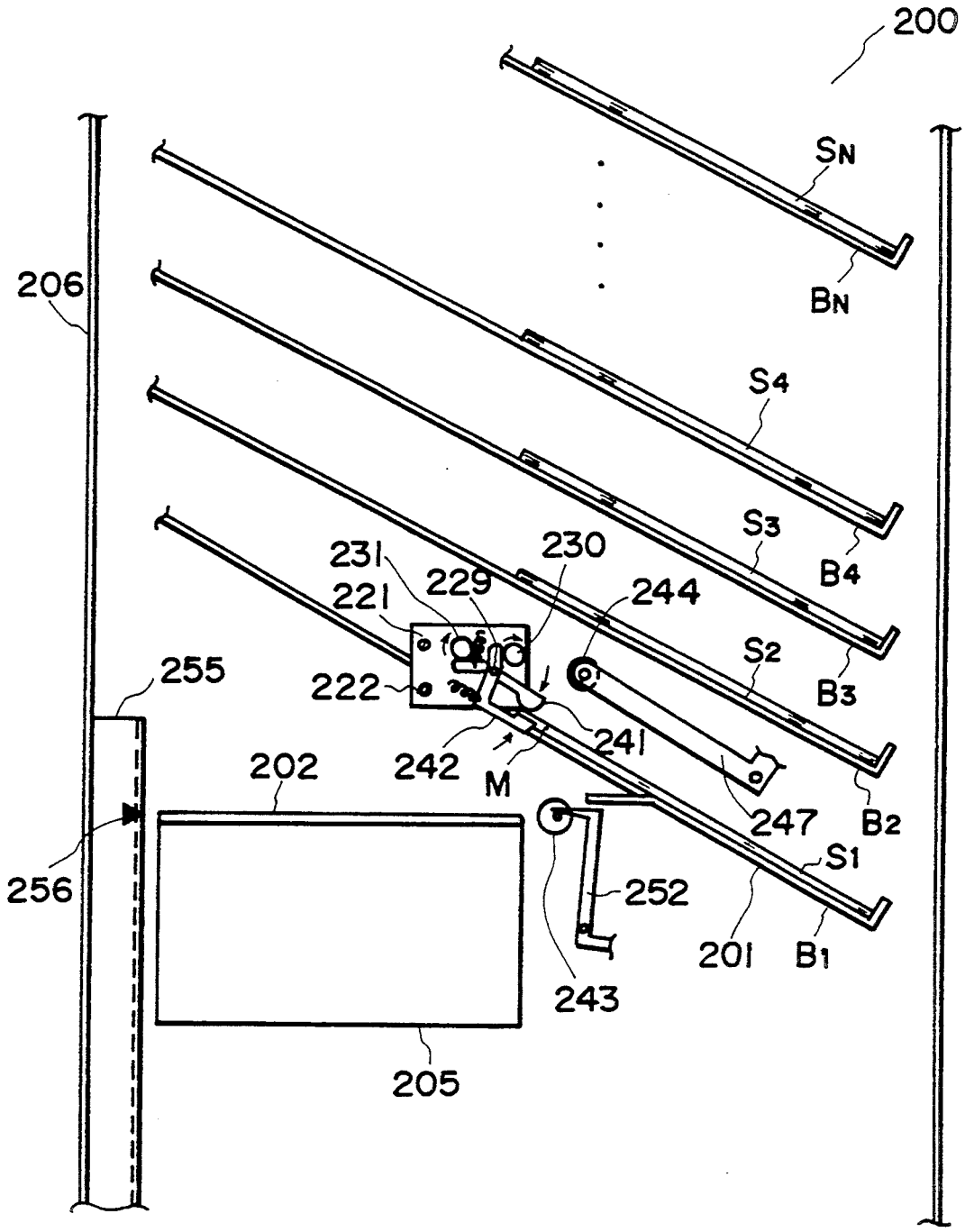
FIG. 13 illustrates operation of the apparatus.

The preset (in the image forming apparatus 300) number of sheets having the formed images, are sequentially discharged to and accommodated by the bin trays B, and they are aligned by the above-described alignment means (FIG. 6). After the completion of the aligning operation, the lifting rotatable member 3 is operated so that the bottommost one of the bin trays that accommodates the sheet set is faced to the intermediate tray 201 of the stacker. Subsequently, as shown in FIG. 11, the alignment reference member 13 fixed at the aligning reference position is returned to the stand-by position a. Then, by operation of the pulse motor 19, the aligning rod 21 moves to a pushing position c while being in contact with lateral ends of all of the sets of sheets. By this motion of the aligning rod 21, the other lateral ends of the sheet sets moves to the front side of the sorter 100 to such an extent as to enter an inside of rear plate 204 of the stacker 200. At this time, as shown in FIGS. 11 and 12, the gripper 220 is waiting at a rear home position H1 of the stacker 200 with the bottom gripper 242 and the top gripper 241 opened. By the pushing action described above, a corner M of the first sheet set S1 is interposed between the bottom gripper 242 and the top gripper 241. Thereafter, by the rotation through 180 degrees of the top gripper cam 231 and the bottom gripper cam 230, the top gripper 241 and the bottom gripper 242 start to rotate about a shaft 229, and the corner M of the set of sheet S1 is assuredly gripped (FIG. 13).

Figure 14:
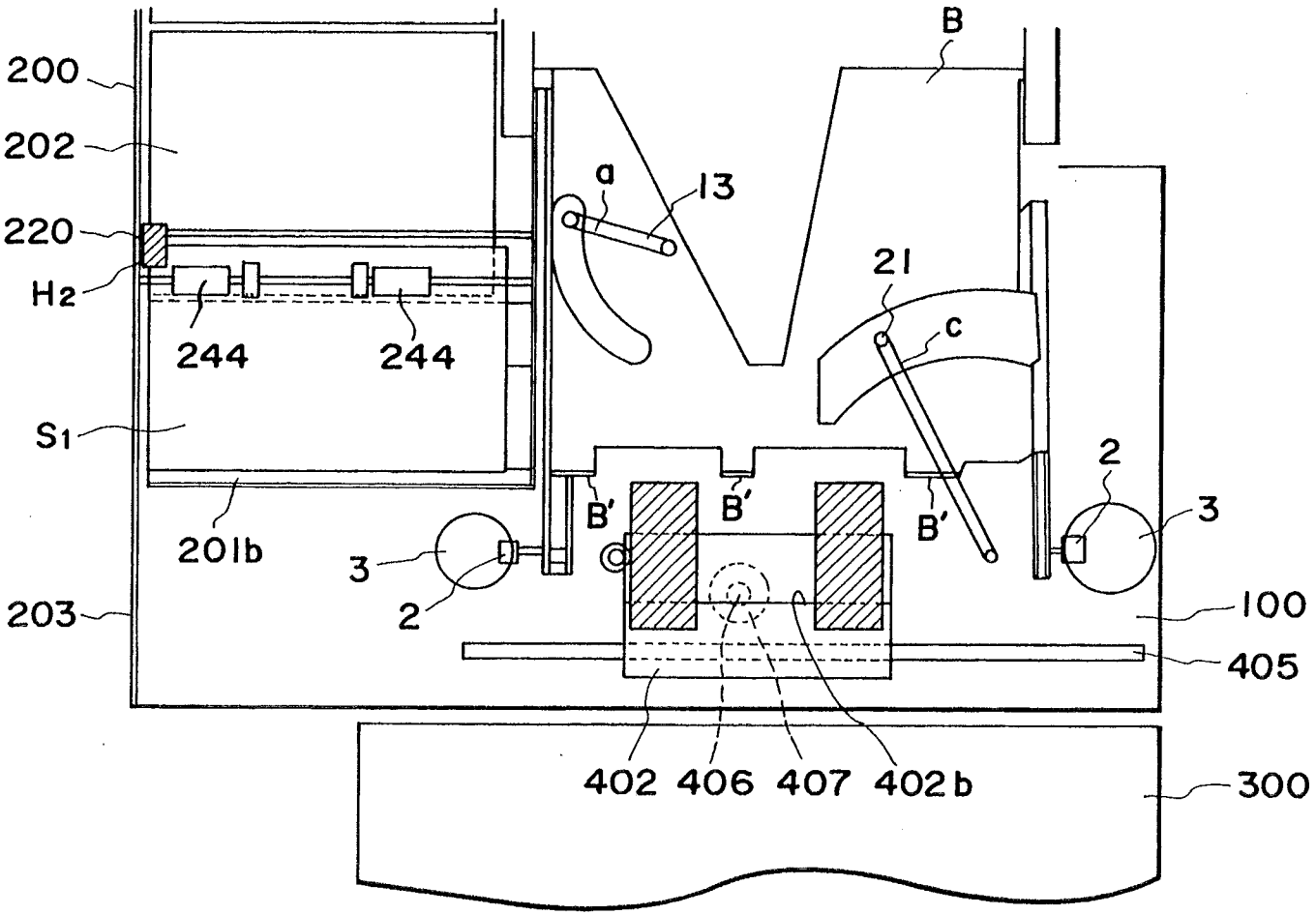
FIG. 14 illustrates operation of the apparatus of FIG. 5.

As shown in FIG. 14, the gripper 220 then moves toward the intermediate tray 201 along the rails 221 and 222 while gripping the sheet sets S1, thus transferring it to the intermediate tray. At this time, the top conveying roller 244 is supported by the swingable arm 247, and is at a position away from the bottom roller 243, and therefore, the sheet set S1 is inserted in the space.

In the transfer action, the corner M of the sheet set S1 is assuredly gripped by the top and bottom grippers, and the trailing end is guided by the rear end stopper B′ of the bin tray B substantially at the same surface and the rear end stopper 201*b* of the intermediate tray 201, and therefore, there is hardly any deviation of the sheets in the sheet set S1. When the sheet set S1 is completely placed in the intermediate tray 201, the movement of the gripper 220 stops (position H2).

Figure 15:
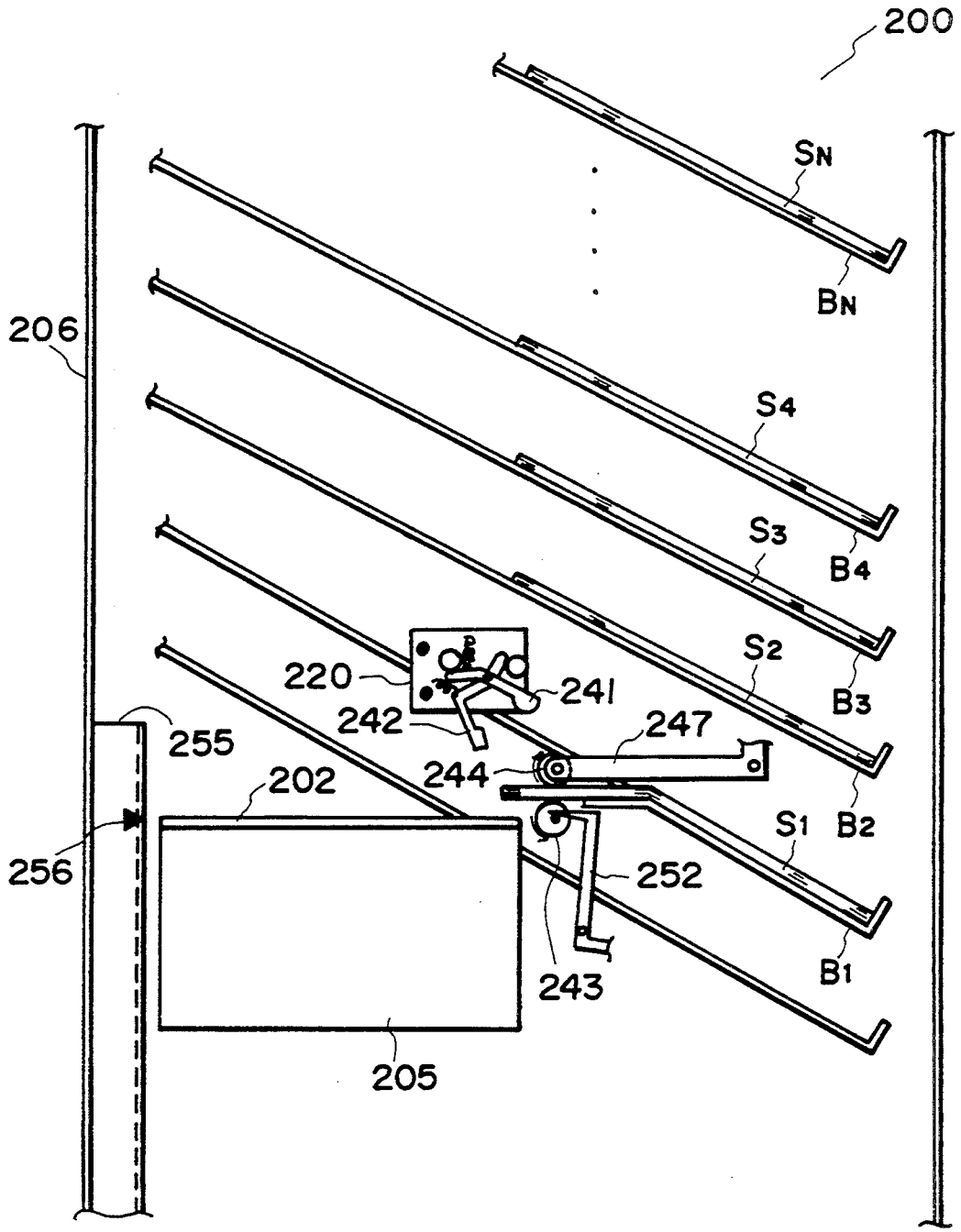
FIG. 15 illustrates operation of the apparatus of FIG. 8.

As shown in FIG. 15, the top gripper cam 231 and the bottom gripper cam 230 rotate again through 180 degrees, so that the top gripper 241 and the bottom gripper 242 are released. With this operation, the bottom surface of the sheet set S1 is contacted to the bottom conveying roller 243. The holding arm 252 described hereinbefore continues to be placed at the retracted position indicated by broken lines in FIG. 8.

If there is a plurality of sheet sets to be transferred, the bin trays B are lowered by one step by rotation of the lifting rotatable member 3, so that the sheet set S2 is aligned with the level of the gripper 220.

Figure 16:
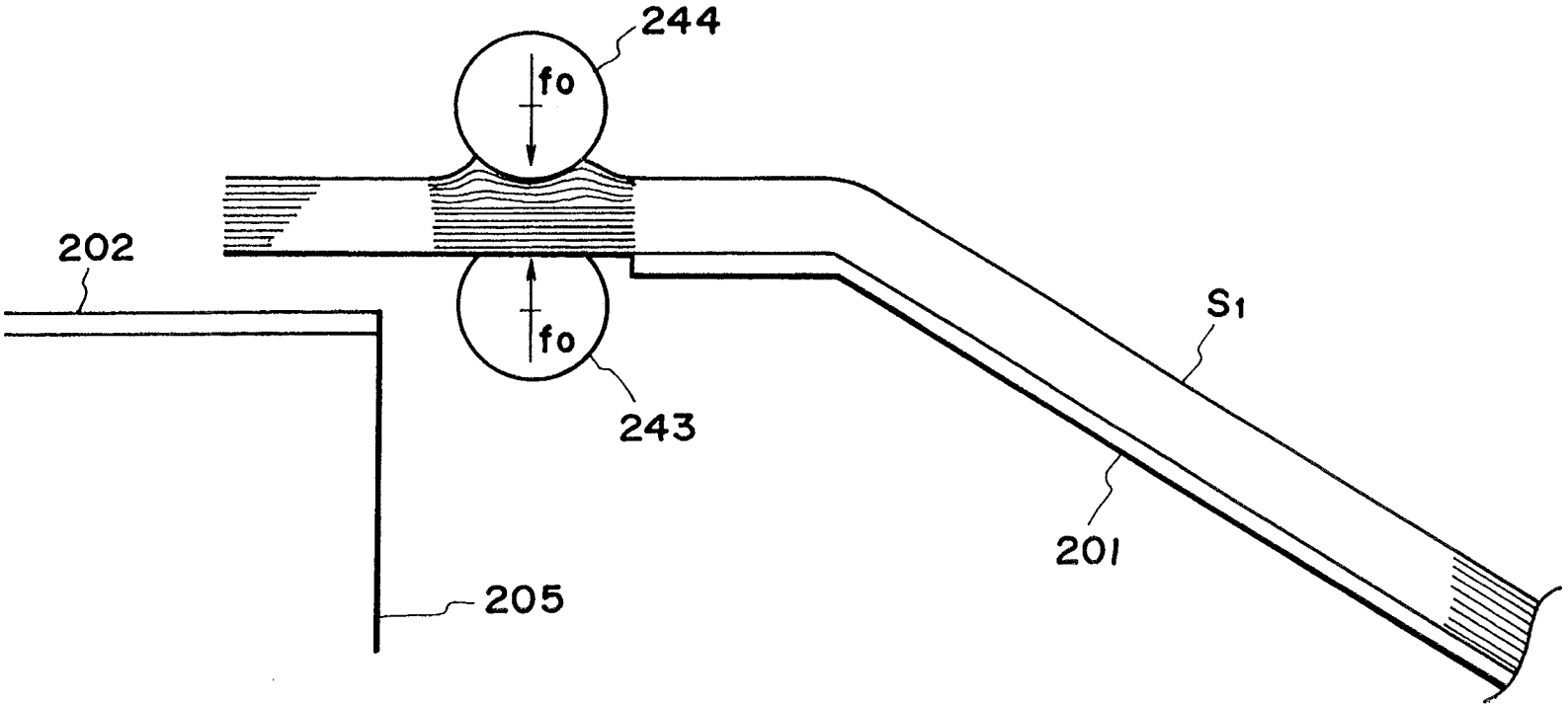
FIG. 16 illustrates motion of a set of sheets.

Subsequently, the swingable arm 247 starts its swinging operation through the above-described means, and the top conveying roller 244 applies a predetermined pressure $f_0$ to the sheet S1. At this time, as described hereinbefore, the hardness of the bottom conveying roller 243 is extremely low as compared with the top conveying roller 244, and therefore, as shown in FIG. 16, the sheet adjacent to the top conveying roller 244 deforms by w. However, for the sheet adjacent to the bottom conveying roller 243, the bottom conveying roller 243 itself deforms to absorb the pressure $f_0$, and therefore, there is no deformation occurred. The radius of curvature of the deformation w increases from the top sheet to the bottom sheet. In other words, the distance of movement by a predetermined angle rotation of the conveying roller increases from the top sheet to the bottom sheet. Here, the distance of movement of the bottom sheet of the sheet set S1 is larger as compared with that by the bottom conveying roller 243, but as described hereinbefore, the friction coefficient of the surface of the bottom conveying roller 243 is lower than the friction coefficient of the sheet, and therefore, the bottommost sheet slips relative to the bottom conveying roller 243. In addition, the bottom driving roller 243 also receives the driving force, and therefore, both of the conveying rollers are provided with sufficient conveying forces to convey a large number of sheets (50–100 sheets).

Figure 17:
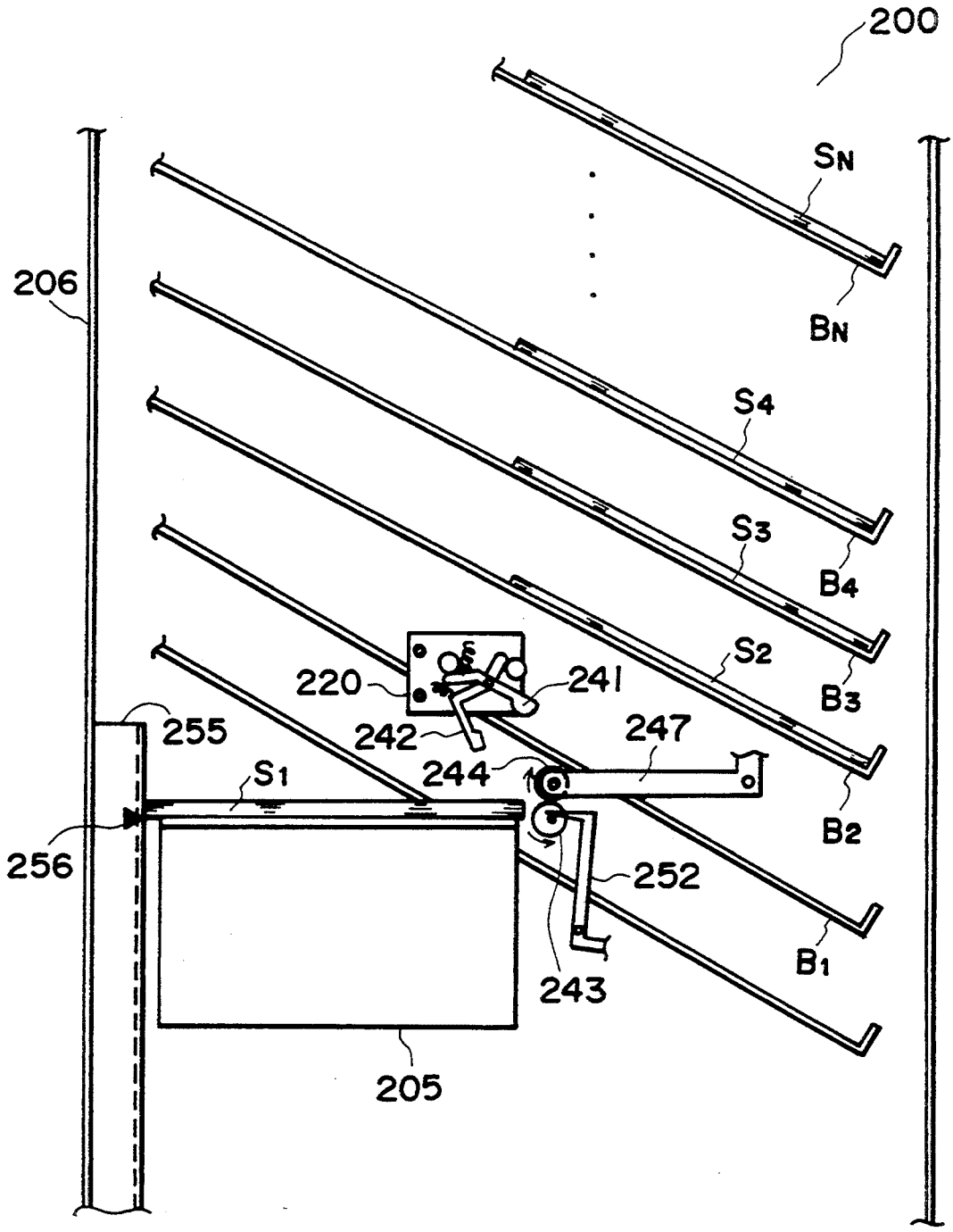
FIG. 17 illustrates operation of the apparatus of FIG. 8.
Figure 18A:
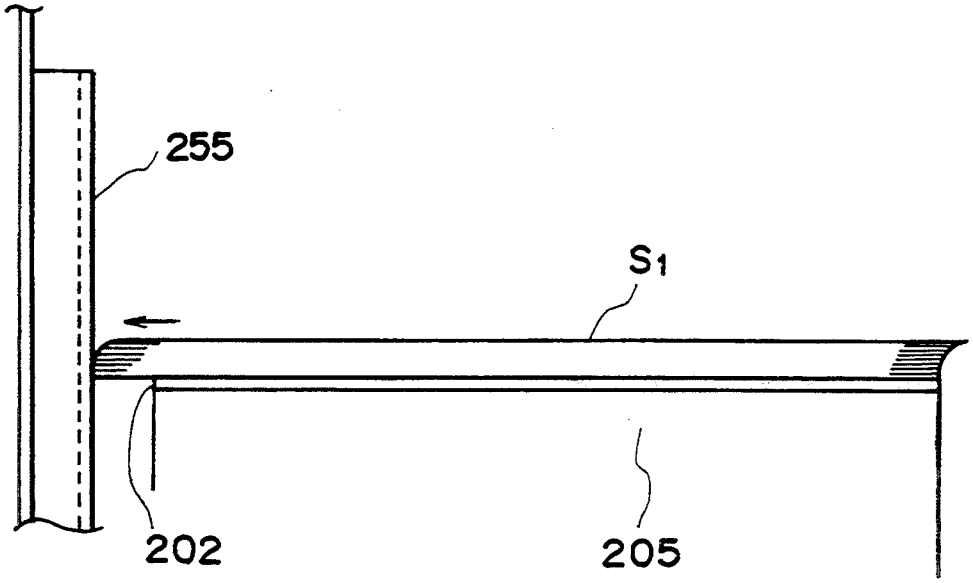
FIG. 18 illustrates an aligning operation for the sets of sheets.
Figure 18B:
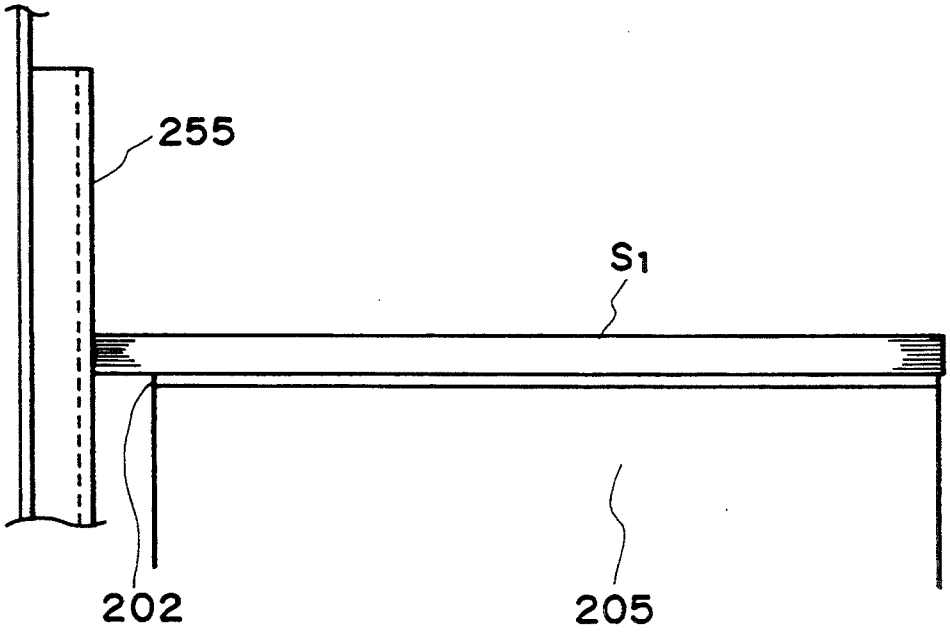

The bottom projected end of the sheet set S1 moved by the conveying rollers is first abutted to the reference plate 253, thus suddenly stop it (FIG. 18A). Then, the upper sheet then moves by the conveying force in the same direction until it stops by abutment to the reference plate 255 (FIG. 18B). In this manner, all of the sheets of the sheet set S1 are abutted and aligned relative to the reference plate 255. Thus they are stacked on the stack tray 202 with proper alignment (FIG. 17). In this manner, after the sheet set S1 is accommodated on the stack tray 202, the base 205 supporting the stack tray 202 lowers by the lifting means until the sensor 256 detects the sheet surface of the set of sheets S1.

The description will be made (second and subsequent) with respect to the case in which a plurality of sheet sets are to be transferred.

Figure 19:
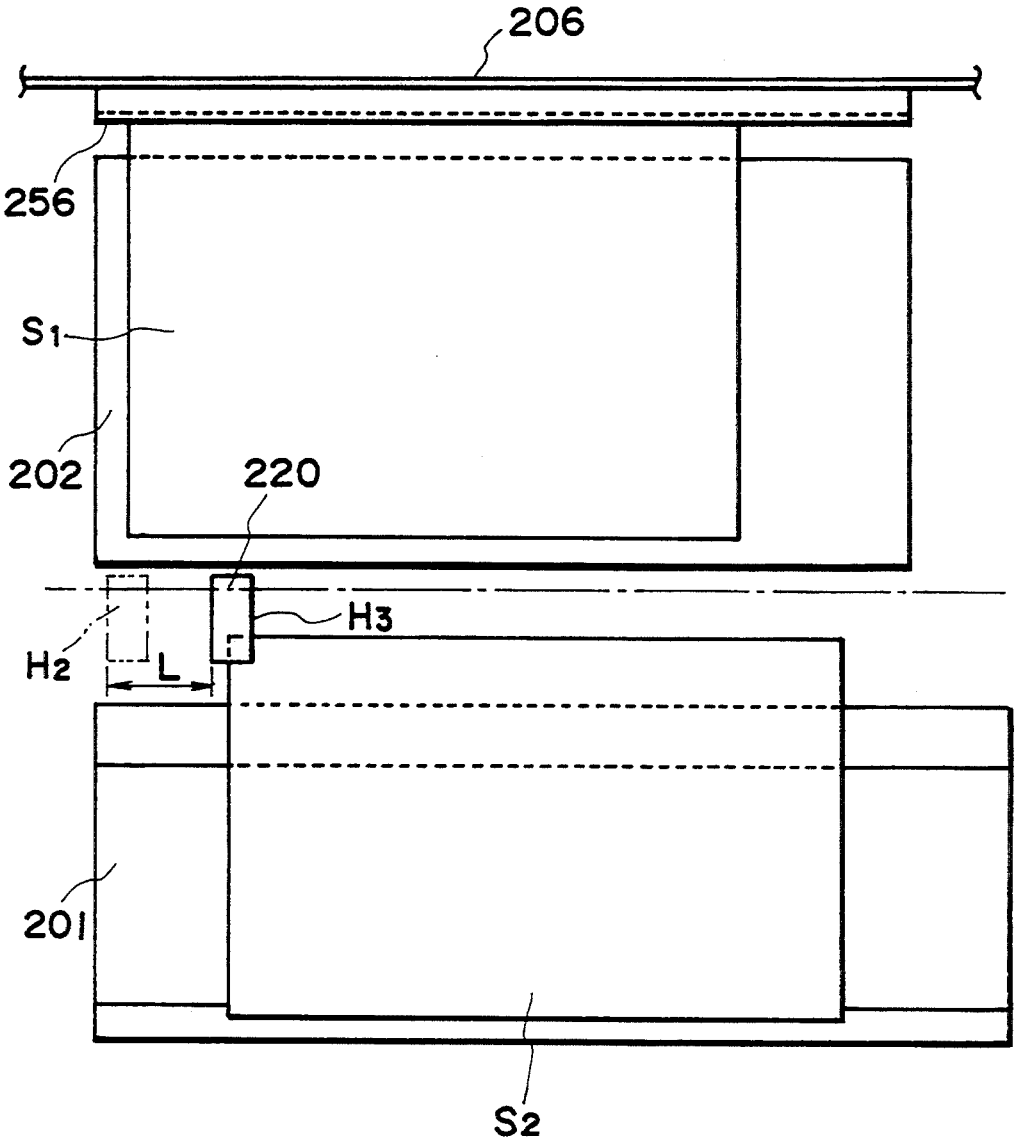
FIG. 19 is an enlarged top plan view of a major part illustrating operation of the apparatus of FIG. 5.
Figure 20:
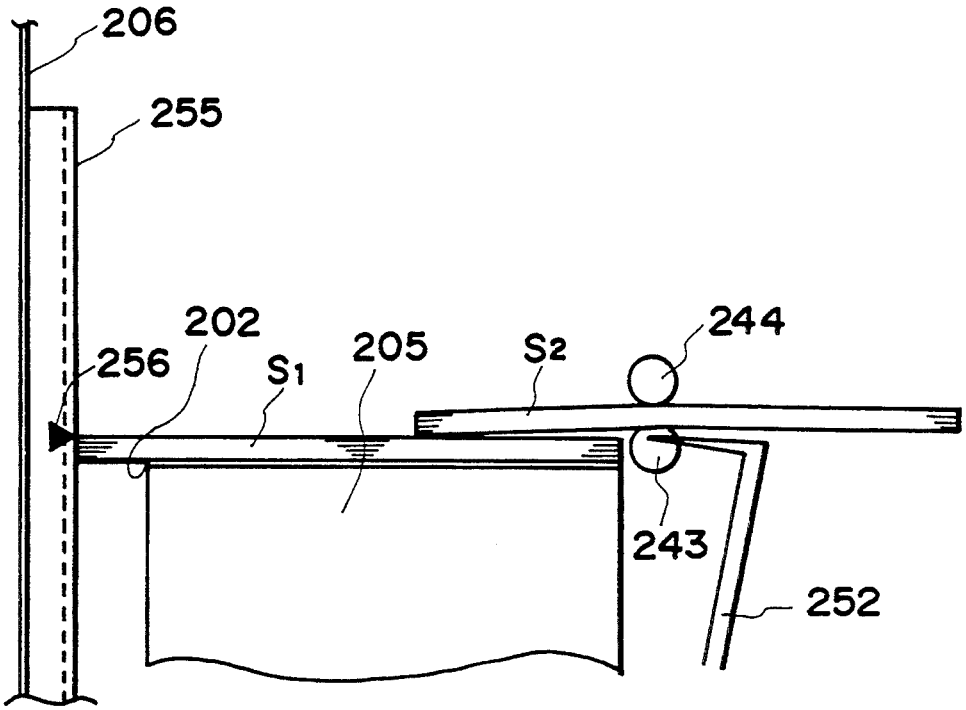
FIG. 20 illustrates operation of a major part of the apparatus of FIG. 8.
Figure 21:
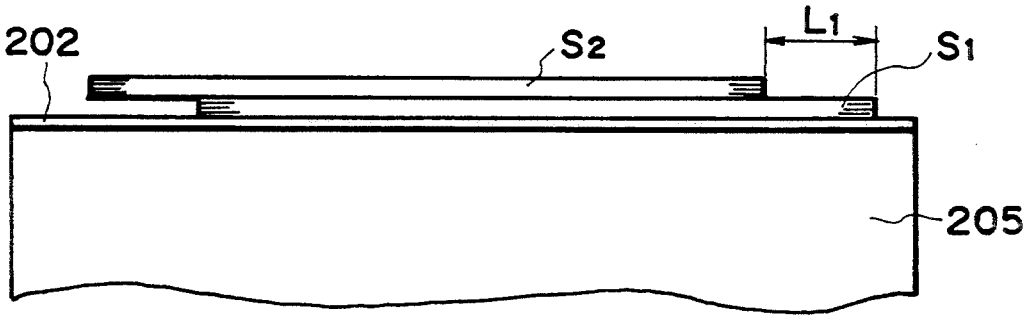
FIG. 21 is a left side view illustrating stacked state.
Figure 22:
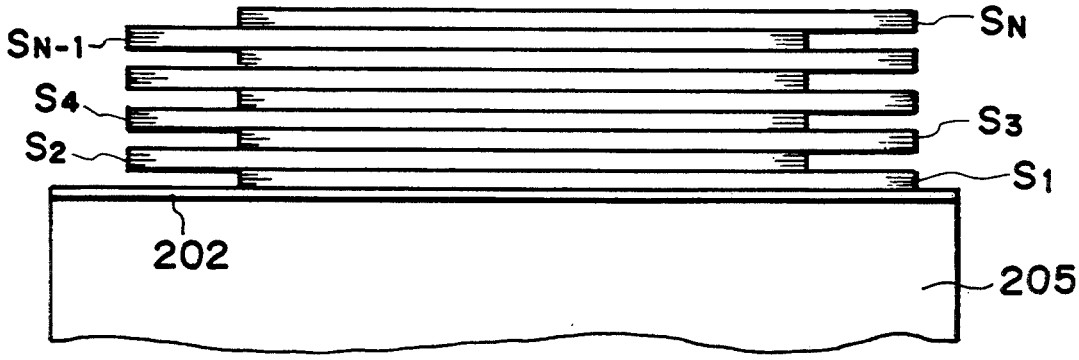
FIG. 22 is a left side view illustrating the stacked state.

As described hereinbefore, the second set S2 of sheets is aligned beforehand at the level of the gripper 220. Similarly to the case of sheet set S1, it is assuredly gripped by the top and bottom grippers 141 and 242, and is conveyed to the intermediate tray 201. As shown in FIG. 19 which is a schematic top plan view of the stacker 200, when the gripper 220 transfers the sheet set S1, it has been moved to the position H2 (chain line). Upon the transfer of the second sheet sets S2, the movement is stopped at a different position (position H3) which is away from the position H2 by a distance L2. The subsequent operations are common. As shown in FIG. 20 which is a front view of FIG. 19, a leading edge of the set S2 of the sheets is advanced while sliding on the sheet set S1, and therefore, the topmost sheet of the set S1 receives the force in the conveying direction. However, since the end is abutted to the reference plate 255, it is not deviated. As shown in FIG. 21 which is a schematic side view of the stacker 200, sheet set S2 is placed on the sheet S1 with a certain offset L1. Similarly, in the subsequent operations, the stop position of the gripper 220 is changed for every other sets of sheets on the bin trays of the sorter 100, by which as shown in FIG. 22, all the sheet sets are spatially divided on the stack tray horizontally.

The description will be made in the case where a small number of sheets (2–5 sheets) are stapled into a set of sheets by a stapling unit, after the sheets are subjected to the image forming operation in the image forming apparatus 300, and sorted on the bin tray.

The preset (key) number of the sheets from the image forming apparatus 300, are sequentially discharged and accommodated into the bin trays B, and are aligned by the aligning means (FIG. 6). At this time, the first tray 401 (FIG. 7) to which the stapler ST is fixed is at the stand-by position with which the stapler ST does not influence the sorting operation (FIG. 6). After the completion of the alignment of all of the sheets, the lifting rotatable member 3 operates so that the bin tray having the sheet set is faced to the stapler ST, and a stapling signal is supplied to the stapling unit.

Figure 23:
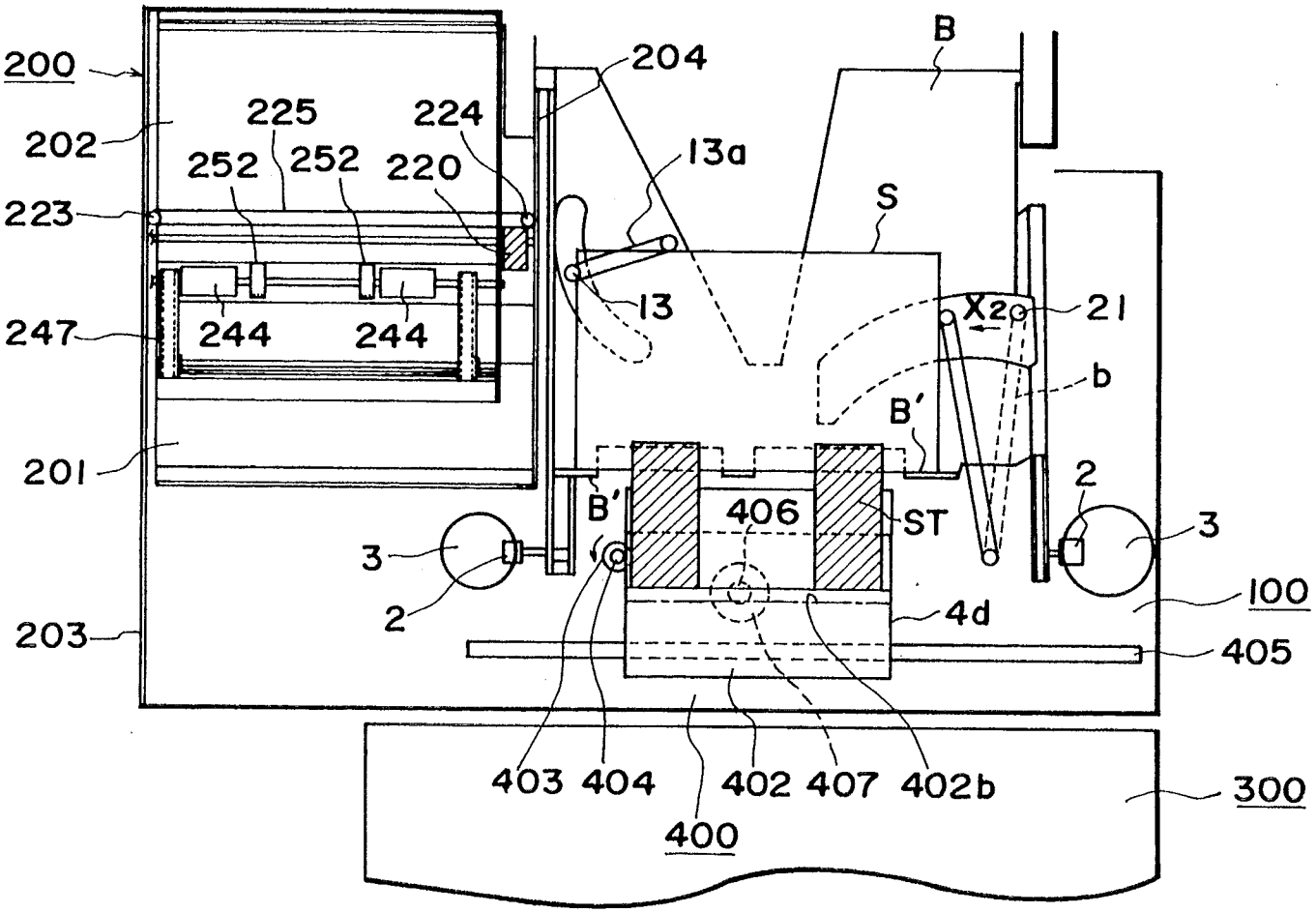
FIG. 23 illustrates operation of the apparatus of FIG. 5.

Receiving the signal, the first tray 401 moves in the direction Y3 by rotation in the direction of an arrow of the pinion gear 401 as a result of motor 403 drive (FIG. 23). The first tray 401 moves through a predetermined amount, and when the sheet set on the bin tray is inserted between the top and bottom jaws of the stapler ST. Then, the sheet is clinched, and the first tray 401 returns to the above-described waiting position.

Figure 24:
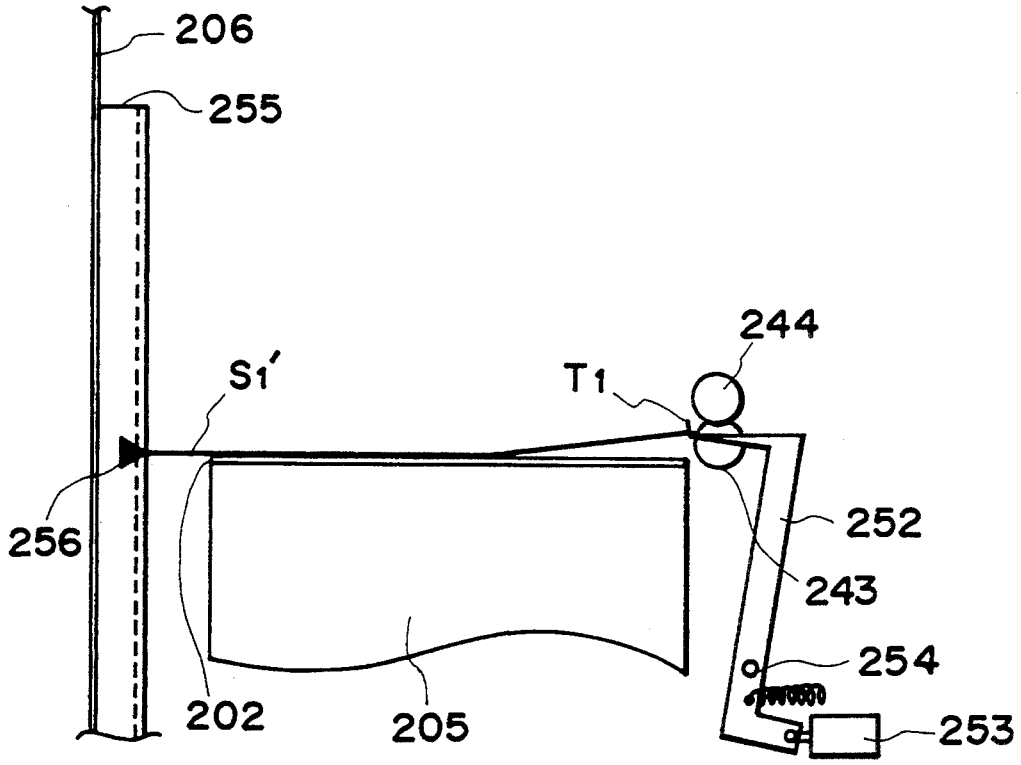
FIG. 24 illustrates operation of a major part of the apparatus of FIG. 8.
Figure 25:
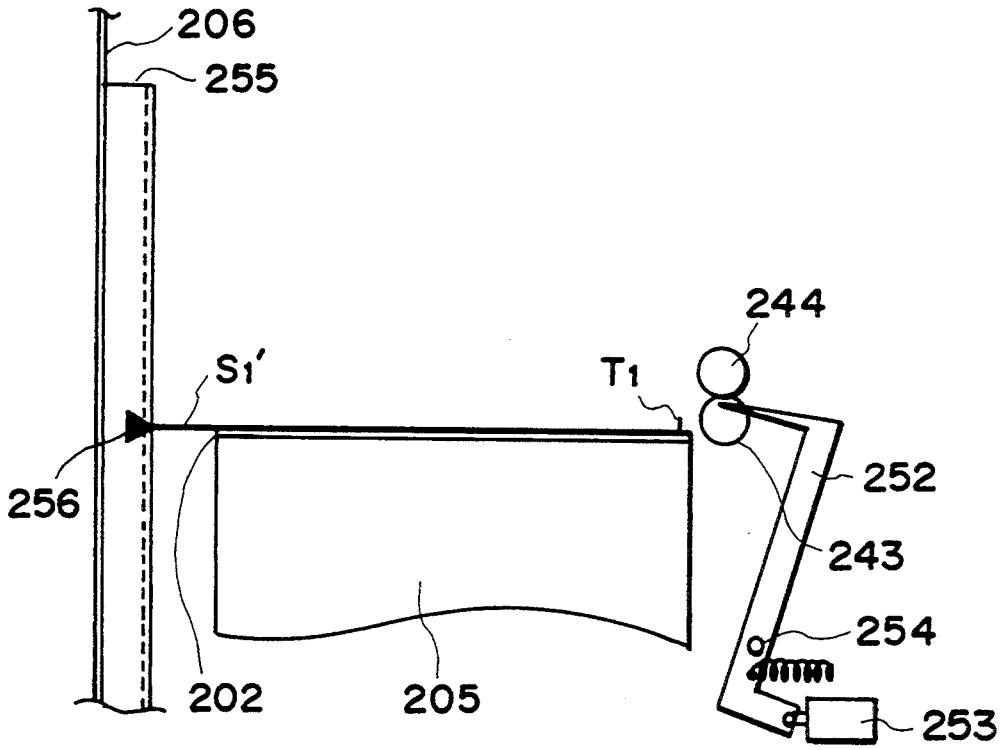
FIG. 25 illustrates operation of the apparatus.

Subsequently, the bin tray is lifted or lowered step-by-step by rotation of the lifting rotatable member 3, so that all of the sheet sets are stapled. Subsequently, the gripper device 220 moves while gripping the stapled sheet set, and the operations until it is placed on the intermediate tray 201 are the same as in the case of the above-described unstapled set of sheets. The stapled sheet set S1′ on the intermediate tray 201 is conveyed onto the stacker tray 202 by rotation of the top and bottom rollers 243 and 244. However, the trailing end of the sheet set is assuredly stapled, and therefore, the deviation in the conveying direction does not occur. At this time, the solenoid 253 is actuated, and the end portion of the holding arm 252 moves to a position projected from the conveying roller surface. Thus, the stapled sheet set S1′ conveyed onto the stack tray 201, as shown in FIG. 24, is aligned by abutment of the non-stapled end to the reference plate 255, and with the stapled end held by the holding arm 252 (T1 designates the staple). As shown in FIG. 25, the solenoid 253 is deenergized, so that the holding arm 252 moves back to the retracted position about a shaft 254. By this operation, the trailing end of the stapled sheet S1′ falls on the stack tray 202. The stack tray 202 lowers until the sensor 255 detects the surface of the stapled sheet set S1′.

Figure 26:
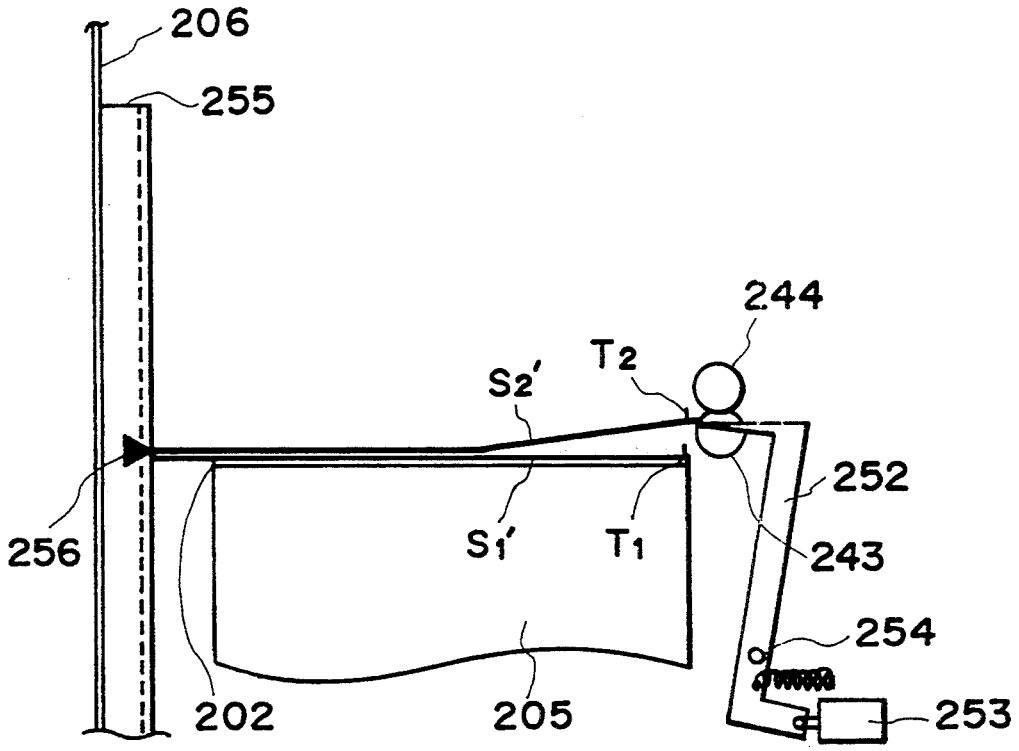
FIG. 26 illustrates operation.

The description will be made as to the second and subsequent transfer actions. Similarly to the first stapled sheet set S1′, the second stapled sheet set S2′ is transferred onto the stack tray 202 (FIG. 26). At this time, the leading end of the sheet set S2′ contacts at a position beyond the staple T1 of the sheet set S1′, and therefore, there is no interference problem between the end of the sheet set S2′ and the sheet set S1′. The leading end of the sheet set S1′ is supported by the reference member 255, and therefore, it is not moved by the transfer of the sheet set S2′. Even when the trailing end of the sheet set S2′ passes through the nip formed between the rollers 243 and 244, the trailing end (staple T2) is temporarily spaced by the holding arm 252 from the sheet set S1′, and therefore, the deviation or trailing end folding or the like problems arising from interference between the staple T2 and the trailing end of the sheet set S1′, can be prevented. Thereafter, the solenoid 253 is deenergized, and the trailing end of the stapled sheet sets S2 held, holds on the sheet set S1′. Subsequently, all of the stapled sheet sets on the bin trays, are transferred onto the stack tray 202 through the above-described operation.

Figure 27:
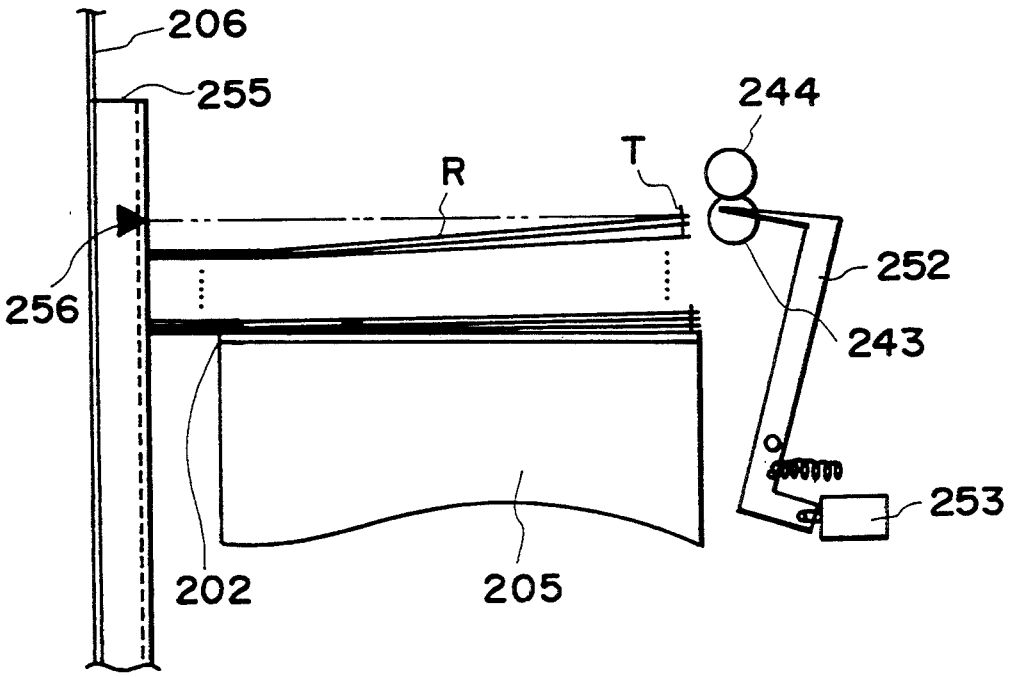
FIG. 27 illustrates the operation of the apparatus.

As shown in FIG. 27, a large number of sheet sets each comprising a small number (2–5) of sheets, the trailing end portions of the sets become bulky to form a loop R. However, since the leading end portions of the sheet sets are supported by the reference member 255, and therefore, the alignment of the sheet sets is maintained on the stack tray 202.

In the foregoing, a sheet set has been stapled at two positions adjacent the trailing end. However, the sheets may be stapled at only one position by operating only one stapler of the two staples. The sheet set transferring operation is the same as described in the foregoing. As shown in FIG. 7, the stapling unit 400 is supported on a rail 405, and is movable in a direction Y2 by a motor 407. It is moved in accordance with various staple positions (one position, two positions) or various sheet sizes.

The sorter used in the foregoing embodiment is a bin-movable type sorter in which the bin trays are moved sequentially to the sheet discharge outlet of the image forming apparatus. However, a bin-fixed type sorter is usable in which the bin trays are fixed, and the sheet discharger of the image forming apparatus dispenses the sheets to the respective bin trays. In this case, the stack tray 202, the gripper 220, the conveying rollers 243 and 244 of the stacker 200 are movable to a position faced to the respective bin trays.

The description will be made as to another embodiment of roller 243.

In the foregoing embodiment, when the unstapled set of sheets is moved by the top and bottom conveying rollers 243 and 244, the amount of movement of the bottommost sheet is larger than the amount of movement of the bottom conveying roller 243, and therefore, slippage occurs between the conveying roller 243 and the sheet. The foregoing apparatus is advantageous in the simple structure and low cost. However, it may involve the problem of quicker wearing of the lower roller and the possible damage to the sheet.

Figure 28:
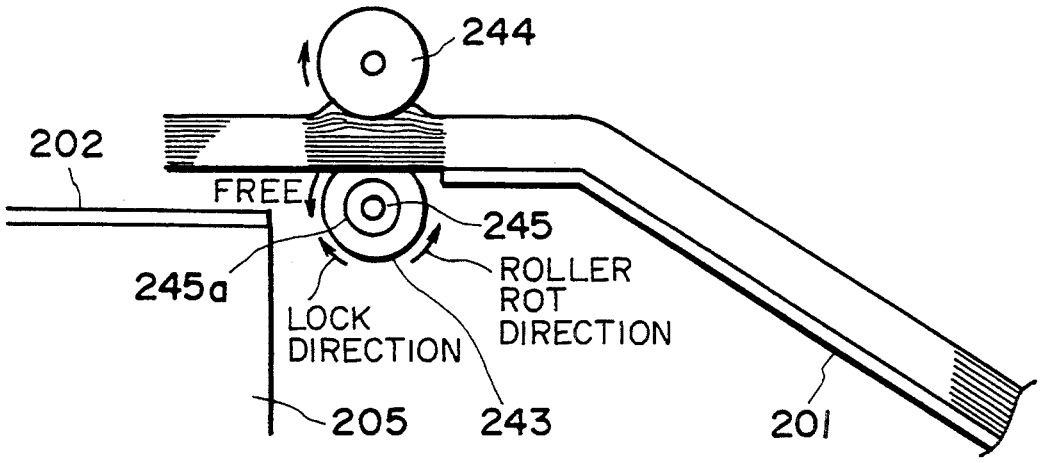
FIG. 28 illustrates conveyance of the sheet set by rollers according to another embodiment of the present invention.

As shown in FIG. 28, it is a possible alternative that the shaft 245 for the bottom roller 243 is provided with a oneway clutch **245*a* permitting free movement in the conveying direction. By the one-way clutch 245*a*, the slippage between the sheet and the bottom conveying roller 243** is accommodated. A further embodiment of moving means for increasing the movement distance of the lower sheet in the sheet set.

Figure 29:
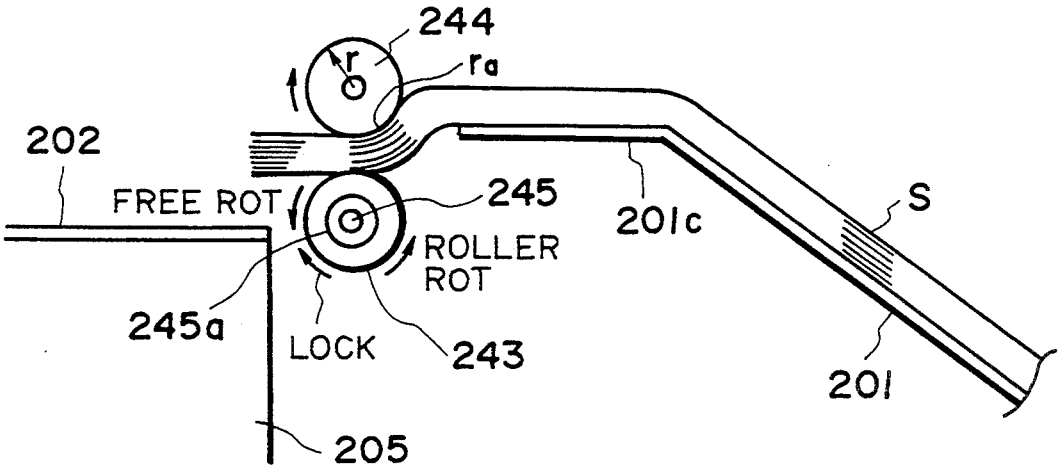
FIG. 29 illustrates conveyance of the sheet sets according to another embodiment.

The structure of the apparatus of this embodiment is similar to the foregoing embodiment. However, as shown in FIG. 29, a position of the nip formed between the top and bottom conveying rollers 243 and 244 is disposed at a level lower than the horizontal level **241*c* of the intermediate tray 201. In this embodiment, the material of the bottom conveying roller 243 is the same rubber material (having the hardness of 40–60 degrees approx.) which is the same of the material of the top conveying roller 244. The one-way clutch 245 is disposed provided on the shaft 245 of the bottom conveying roller 243**.

With this structure, the sheet set gripped by the top and bottom conveying rollers 243 and 244, as shown in FIG. 29 is entirely wrapped on a part of the peripheral surface of the top conveying roller. The wrapped sheet set has a larger radius of curvature at the lower position. When the top and bottom rollers 243 and 244 are rotated in the directions indicated by an arrow, the movement distance of the lower sheet is large to such an extent that it is contacted to the reference plate 255 at the upstream side. The difference between the movement distance between the bottommost sheet of the sheet set and the bottom conveying roller 243, is absorbed by the oneway clutch **245*a*. Thereafter, the upper sheet is contacted to the reference plate 255** by inertia force, and aligned, through the same process as in the foregoing embodiment.

Figure 30:
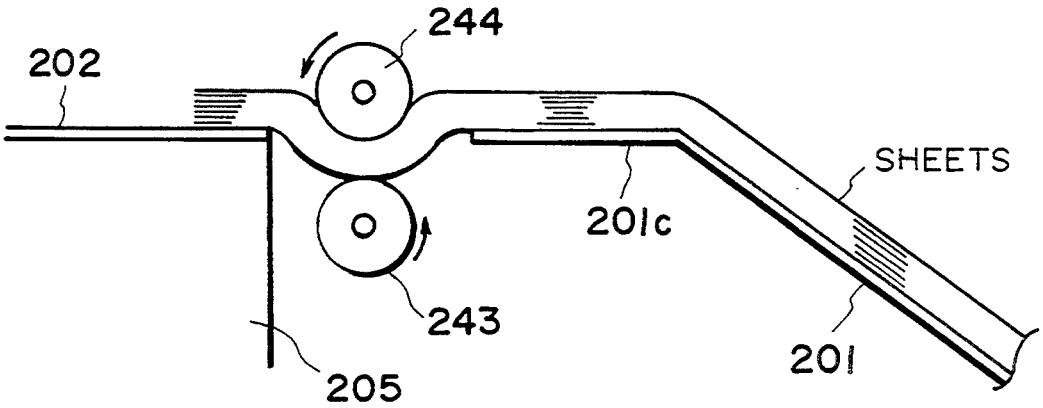
FIG. 30 illustrates conveyance of a sheet set according to a further embodiment of the present invention.

In the above structure, if the sheet surface on the stack tray 202 is raised beyond the nip between the conveying rollers 243 and 244 after the sheet set is gripped by the conveying rollers 243 and 244, and it is conveyed (FIG. 30), the sheet set is more wrapped on the top conveying roller 244, and therefore, the lower sheet is advanced more.

As for the means for increasing the advancement of the lower sheet, the peripheral speed of the bottom conveying roller 243 during the conveying operation can be selected to be hither than the peripheral speed of the top conveying roller 244. This can be accomplished by using an outer diameter of the bottom conveying roller 243 larger than that of the top conveying roller 244, with the driving means therefor being rotated at the same rotational speed. Alternatively, the same diameters may be used for these conveying rollers 243 and 244, and the rotational speed of the bottom conveying roller 243 may be made larger than that of the upper one.

The description will be made as to another embodiment of a guide.

Figure 31:
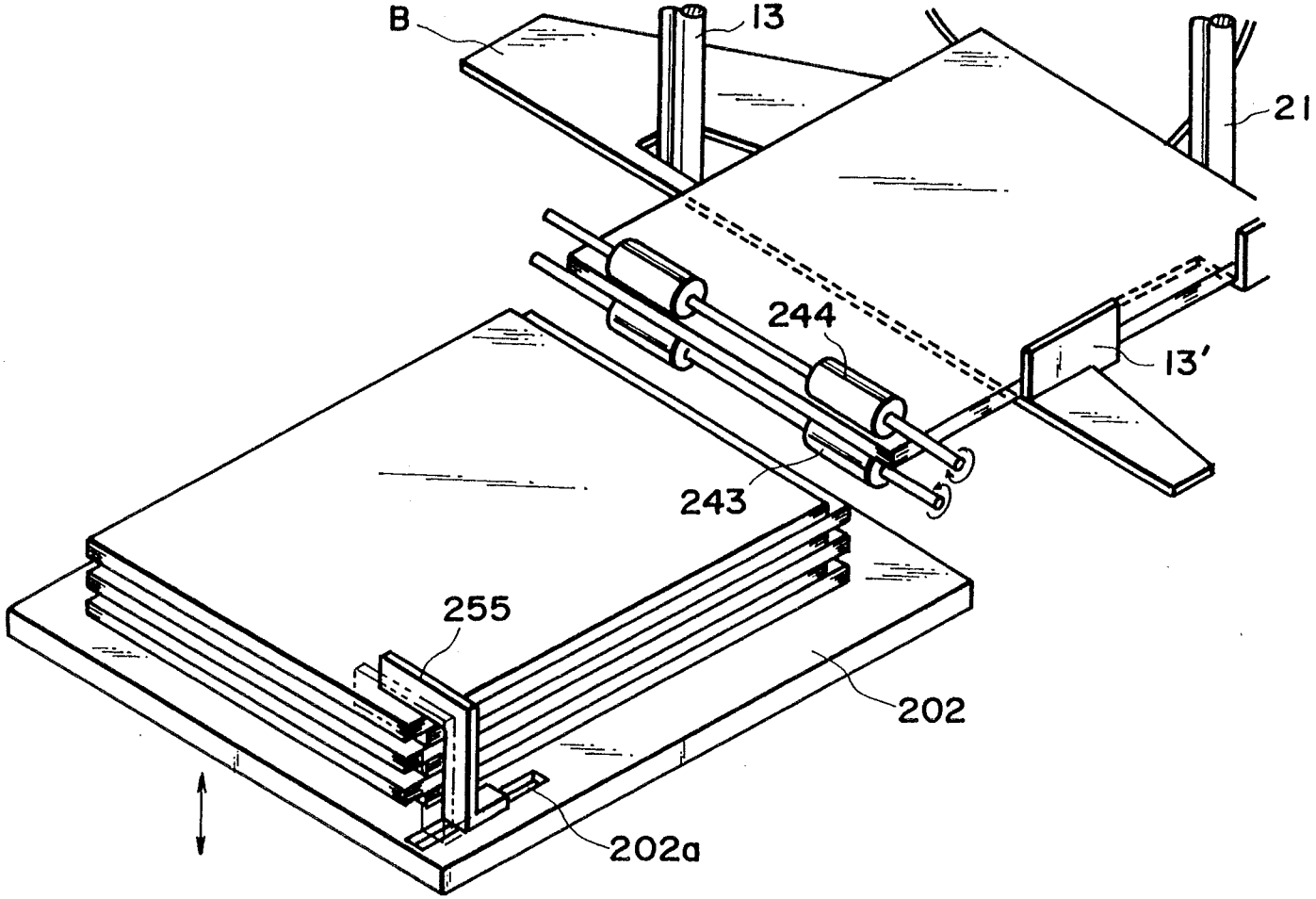
FIG. 31 is a perspective view of a guide of the sheet post-processing apparatus according to another embodiment of the present invention.

As shown in FIG. 31, for example, the use may be made with conveying rollers 243 and 244 arranged parallel with a side end of the bin tray B, and a stack tray 202 directly moves up and down at a location downstream of the conveying rollers 243 and 244. The same reference numerals are in the foregoing embodiments have been assigned to the elements having the corresponding functions, and the detailed description thereof are omitted for simplicity. The discharging speed of the conveying rollers 243 and 244 is changed for each of the sheets discharged from the bin trays. In addition, the reference plate 255 disposed downstream of the rollers 243 and 244 is alternatively changed between the solid line position and the broken line position on the guide 202*a* by an unshown driver in response to the discharged amount, so that the sheet sets aligned by abutment to the reference plate 255, are spatially divided, as shown in the Figure.

Figure 32:
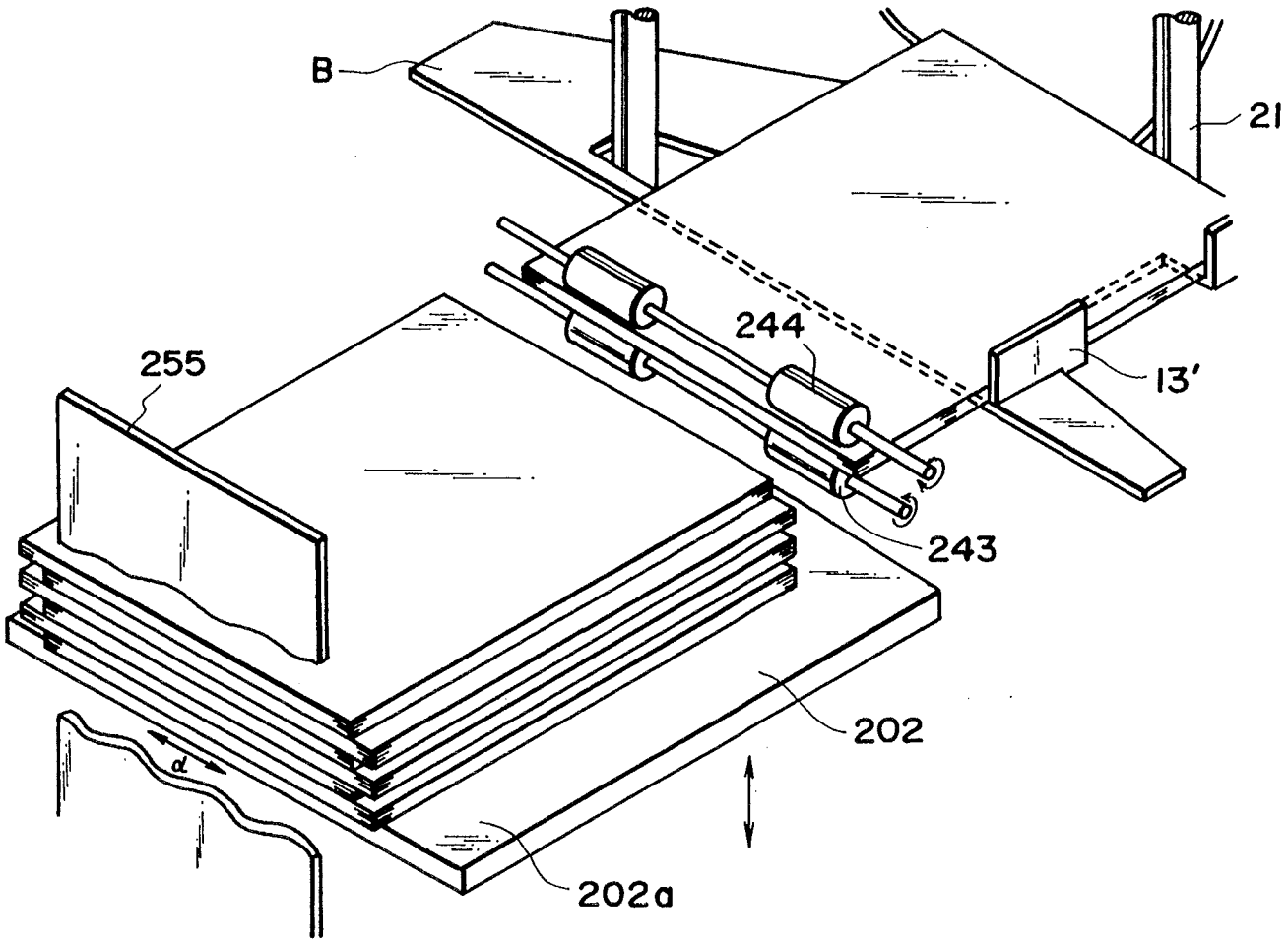
FIG. 32 is a perspective view illustrating shifting action of a stacking tray.

Referring to FIG. 32, a further embodiment of the present invention will be described in which the reference plate 255 is fixed, but still the spatial division of the sets of sheets are possible on the stack tray. The reference plate 255 of this embodiment is fixed at a predetermined position downstream of the stack tray 202. The stack tray 202 is movable up and down and also in a direction $\alpha$ perpendicular to the sheet conveyance direction of the conveying rollers 243 and 244. For each of the sheet sets, the stack tray 202 is moved in the direction of the arrow, by which the sheet sets are spatially divided on the stack tray 202 with the ends abutted to the reference plate 255. In this apparatus, even if the sheet sets on the stack tray 202 are contacted to the sheet being conveyed by the rollers 243 and 244, the ends are always abutted to the reference plate 255 at all times, and therefore, the sets are not deviated.

Figure 33:
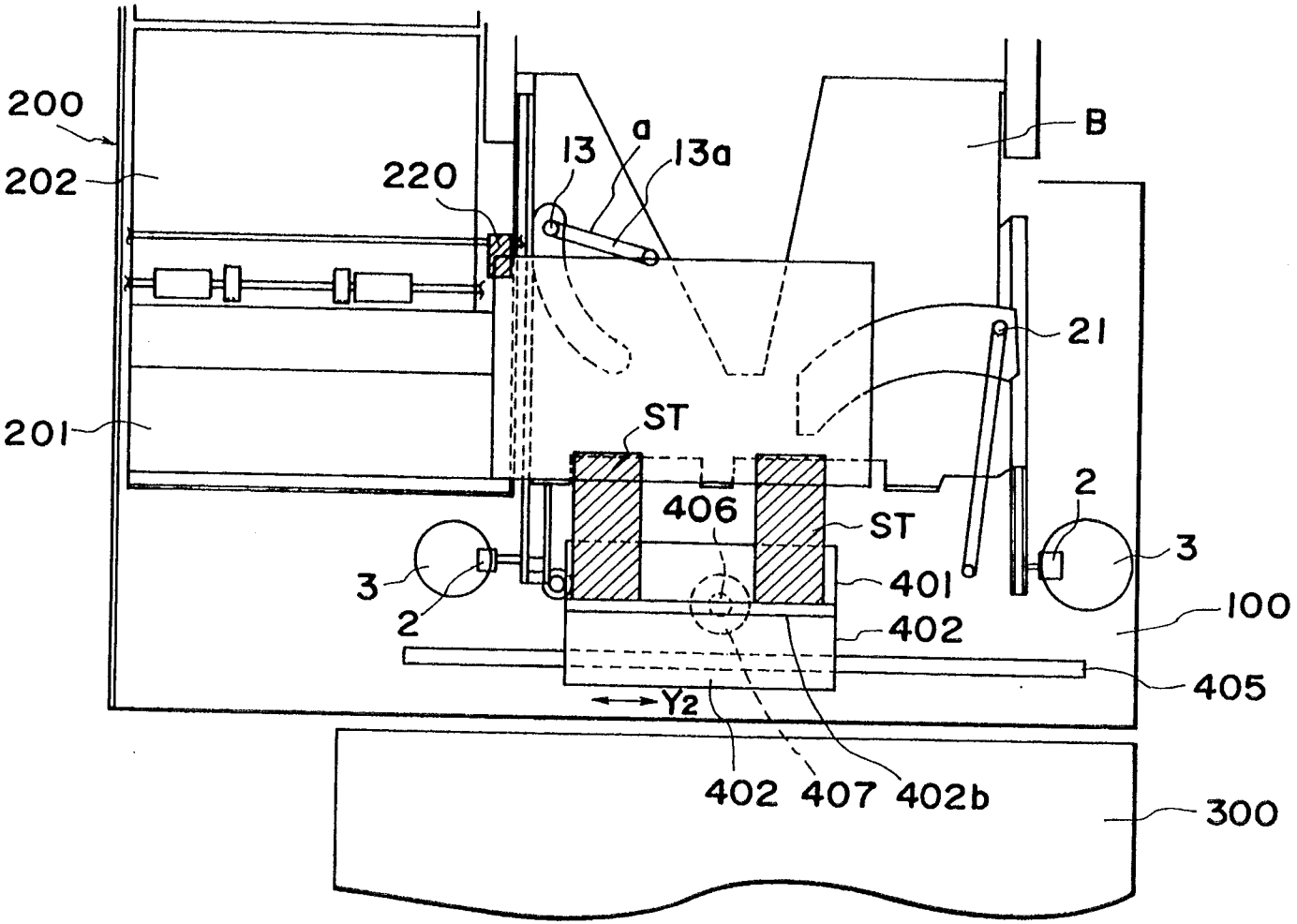
FIG. 33 is a top plan view of an apparatus according to another embodiment of the present invention.

Referring to FIG. 33, a further embodiment of the sheet pushing-out mechanism will be described. In the foregoing embodiments (FIGS. 1–32), the sheet sets are aligned by the swinging movement of the aligning rod 21 on the bin tray of the sorter 100, and thereafter, the aligning rod 21 is further moved, thus pushing the lateral end portions of the sheet sets from all of the bin trays toward the stacker 200 simultaneously. However, the sheet sets may be pushed out for one bin at a time.

As shown in FIG. 33 and FIG. 7, for example, the trailing end of the sheet set accommodated in the bin tray B is clinched between the bottom jaw (anvil) ST1 and the stop jaw (head) ST2 of the stapler ST. With this state maintained, the entirety of the stapler unit 400 is moved in the direction Y2 on a rail 405 by a motor 407, so that the lateral end of the sheet set is moved toward the stacker 200. The operation thereafter is the same as in the foregoing embodiment. Whether the sheet set is to be stapled or not, is controlled by the clinching pressure between the bottom jaw ST1 and the top jaw ST2. More particularly, when the sheet set is simply transferred, the clinching pressure is low so as not to staple it.

Figure 34:
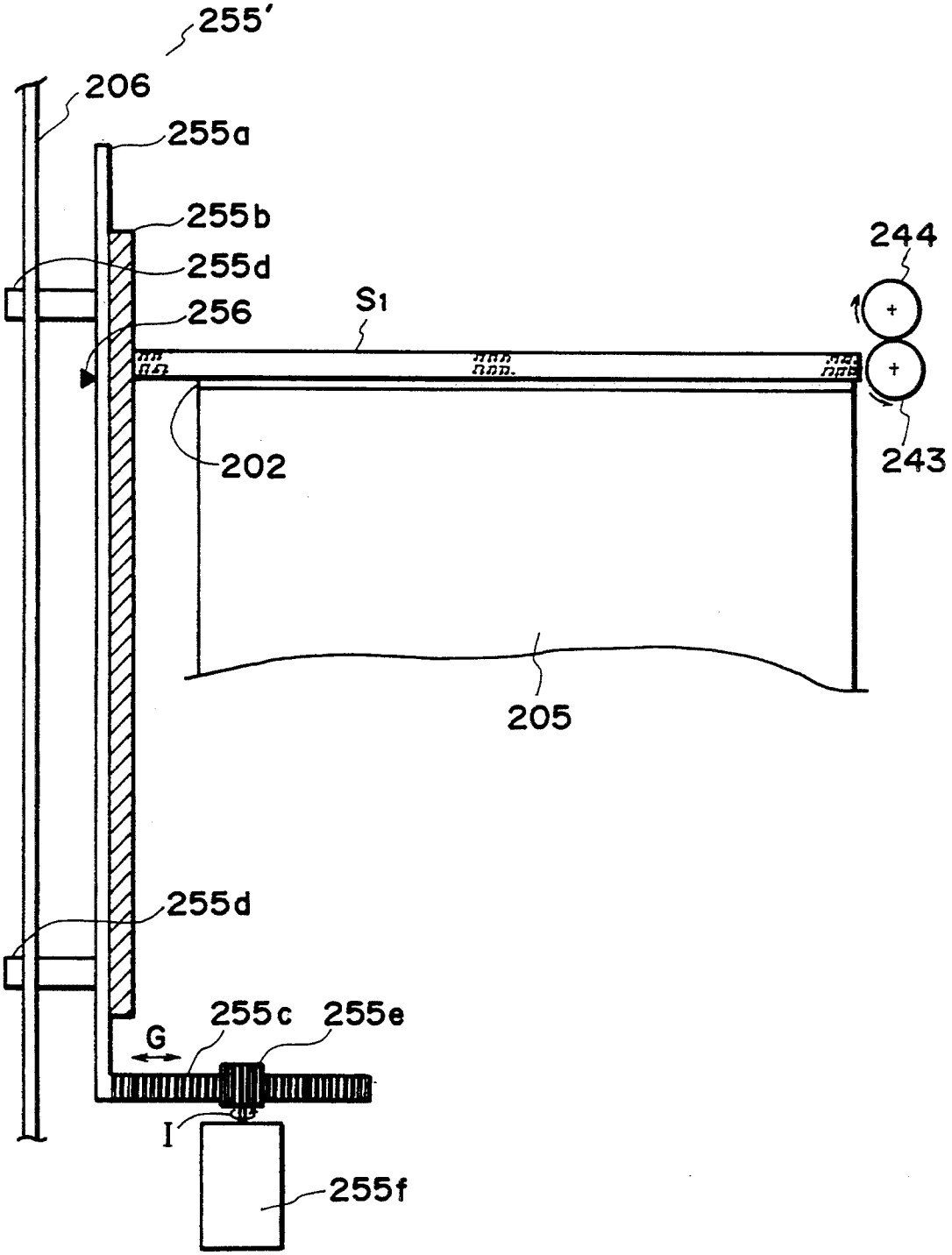
FIG. 34 is a front sectional view of an aligning device according to another embodiment of the present invention.
Figure 35:
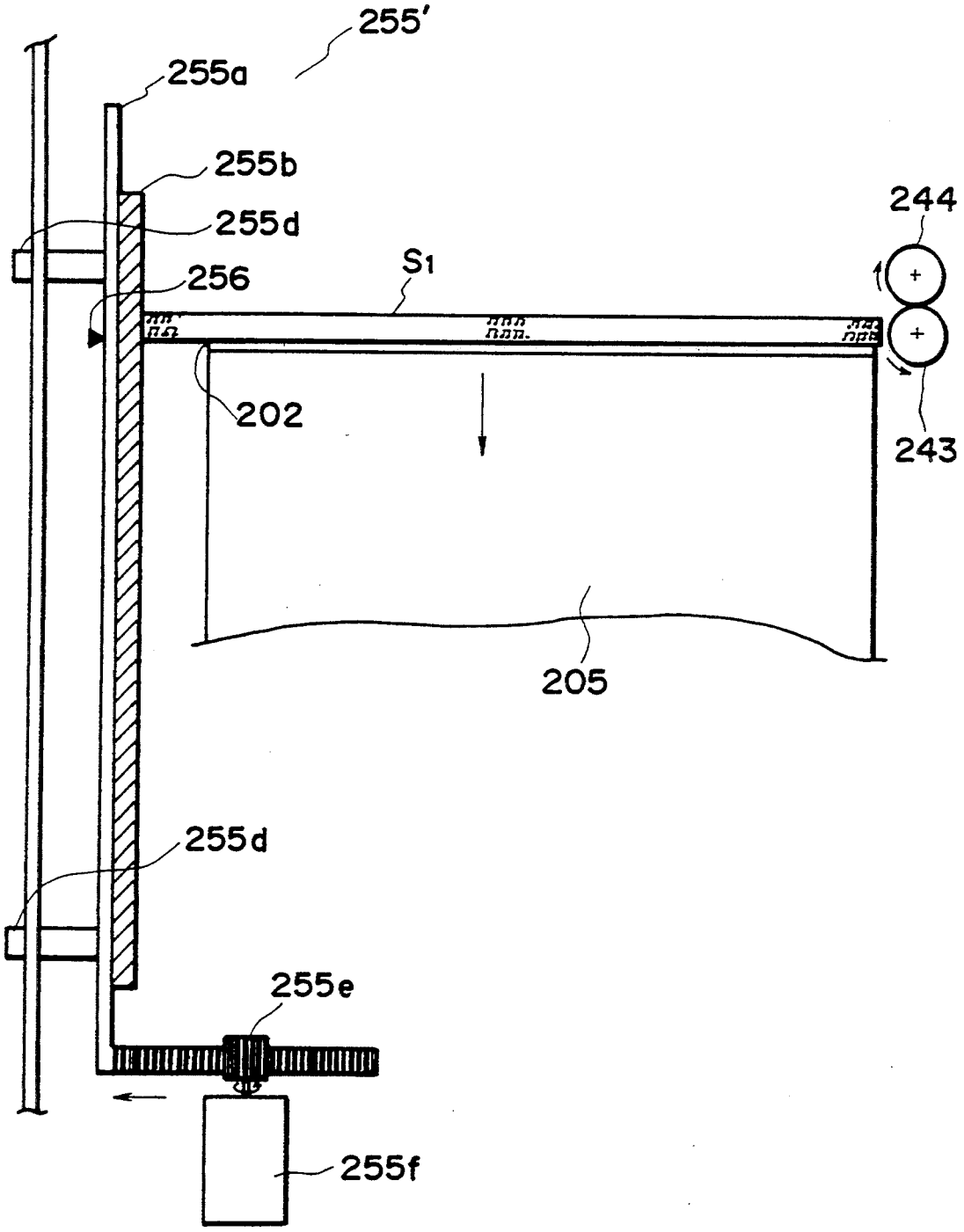
FIG. 35 illustrates operation of the apparatus of FIG. 34.
Figure 36:
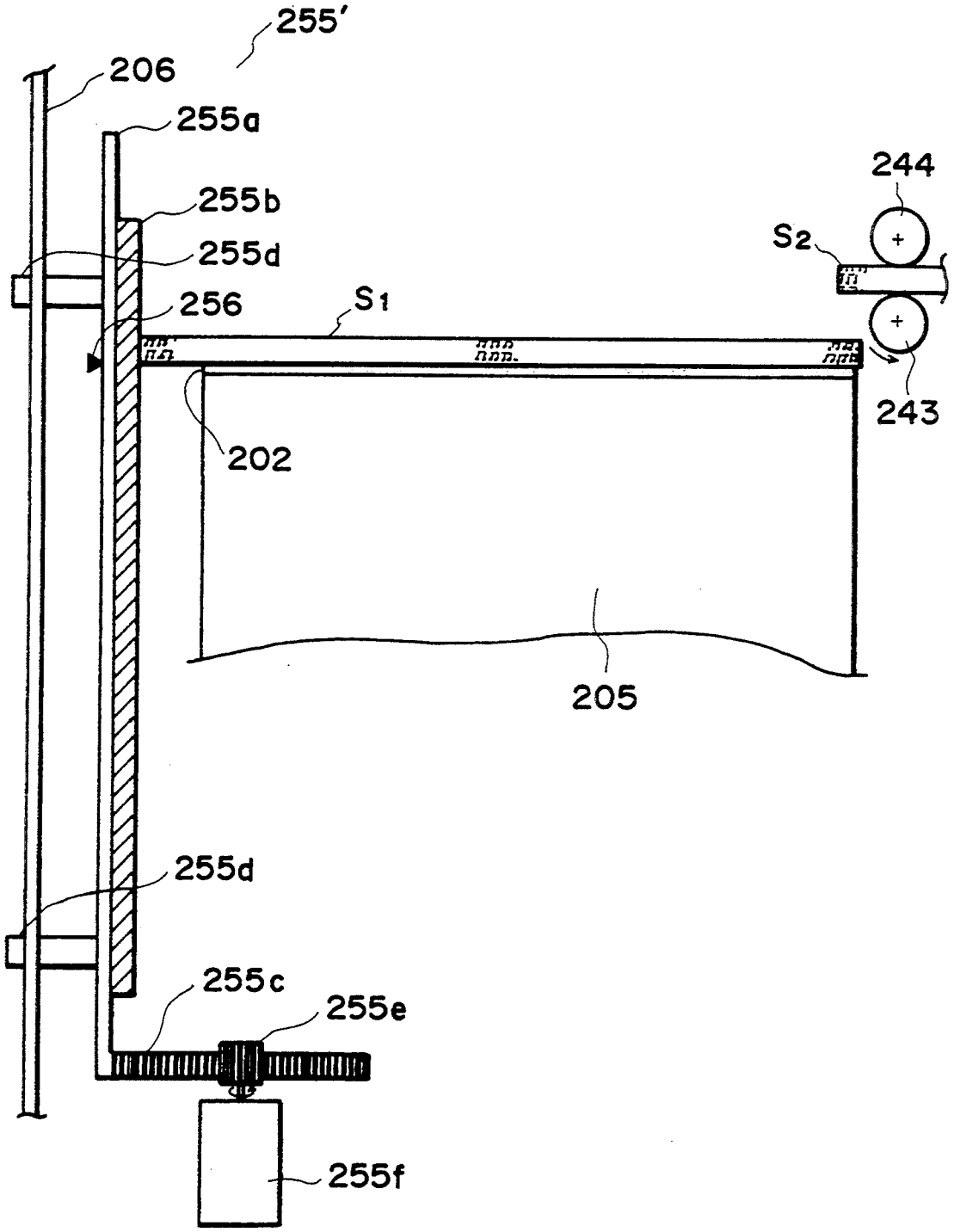
FIG. 36 illustrates operation of the apparatus of FIG. 34.

Referring to FIGS. 34, 35 and 36, a further embodiment will be described which uses an improved reference plate for providing better alignment of the sheet sets on the stack tray 202. The same reference numerals as in the foregoing embodiments are assigned to the elements having the corresponding functions, and the detailed description thereof is omitted.

FIG. 34 is a front view of a stacker 200. The reference plate in this apparatus is supported by engagement between two pins 255*d* of a base plate 255*a* and engaging hole (not shown) of a left side plate 206. The sheet contacting side surface of the base plate 255*a* is coated with an abutment material or member 255*b* on its entire surface. It is of rubber, sponge or another elastic material. The lower portion of the base plate 255*a* is formed into a rack gear 255*c*, and is in meshing engagement with a pinion gear 255*e* mounted to an output shaft of a motor 255*f* fixed on a frame of a stacker 200. A direction I, the reference plate reciprocates in the direction G.

The operation of the apparatus will be described.

Similarly to the foregoing embodiments, the first sheet set S1 (unstapled) is placed on the stack tray 202 by the rotation of the conveying rollers 243 and 244. Here, the leading end of the sheet set S1 is abutted to the abutment member 255*b*. Since the abutment member 255*b* is of elastic material, it is effective to ease the abutment shock, and therefore, there is not rebound of the sheet set by the contact member 255*b*, and therefore, there occurs no space between the sheet and the abutment member 255*b*, by which the alignment is improved.

Next, the base 205 supporting the stack tray lowers as a preparation for the reception of the next sheet set, until the sensor 256 detects the sheet surface of the sheet set S1. However, if it lowers with the state of FIG. 34 maintained, there is a liability that the sheet set is deviated because of the sliding motion between the leading end of the sheet set S1 and the abutment member 255*b*. Therefore, as shown in FIG. 35, the reference plate 255' is moved toward the left in the Figure, so that the sheet set S1 and the abutment member 255*b* is spaced. Thereafter, the base 205 is lowered. When the sensor 256 detects the surface of the sheet set S1, the base 205 stops, and the reference plate 255' is returned to the aligning position to be prepared for the next sheet set S2 (FIG. 36). By the repetition of the foregoing operations, all of the sheet sets are accommodated on the stack tray 202.

When the sizes of the sheet sets to be accommodated on the stack tray 202 are different, the reference plate 255' may be moved to the optimum position for each of the sizes of the sheet sets.

The description will be made as to a further embodiment of the apparatus with which a large number of sheets can be stapled. In the foregoing embodiments, the interval between adjacent bin trays arranged in the vertical direction, has been properly determined on the basis of the dimension of the apparatus. Therefore, there is a limit for the number of sheets which can be accommodated thereby. One bin in the foregoing embodiment can accommodated 50 sheets, for example. Correspondingly, the electric stapler has a capacity of 50 sheets.

Therefore, even if the operator attempts to operate the image forming apparatus in the sorting mode for a set of originals containing more than 51 sheets, the sorting apparatus stops its operation when it sorts 50 sheets, and therefore, the sheets accommodated in the bin trays have to be removed manually.

Even if the interval between the bins is increased in an attempt to increase the capacity per bin tray is increased more than 51 sheets, the electric stapler is not capable of stapling the sheets although the sorting operation is possible. The stapler capable of stapling 100 sheets is quite larger than that of the stapler capable of stapling 50 sheets, and therefore, it is quite difficult to locate such large capacity stapler in the sorter.

In the embodiment described in the following, the stapler having the capacity of 100 sheets is disposed at a position faced to the intermediate tray in a sheet post-processing apparatus.

Figure 37:
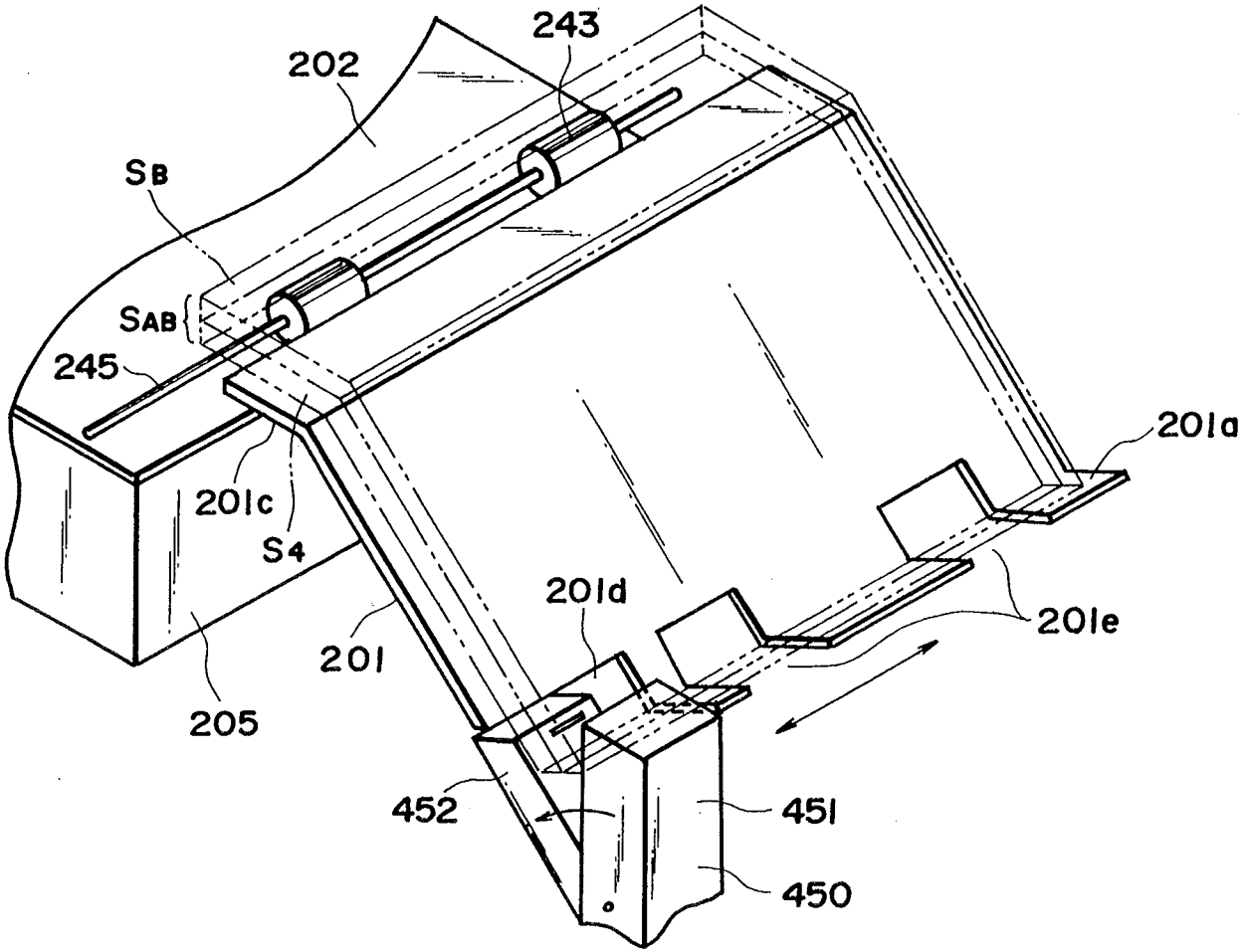
FIG. 37 is a perspective view of an apparatus according to a further embodiment of the present invention in which an intermediate tray is provided with a stapler.

FIG. 37 shows this embodiment, in which the stapler 450 having the capacity of 100 sheets is disposed in a cut-away portion 201*d* provided at the front corner portion of the intermediate tray 201. The bottom jaw 452 of the large capacity stapler 450 is fixed substantially flush with the intermediate tray 201. The top jaw 451 faced to the bottom jaw is swingingly movable in the direction of the arrow to staple the sheets interposed between the bottom jaw 452 and the top jaw 451.

The operation of this apparatus will be made when two sets of 70 sheets are sorted, and are stapled. The operator places the originals on the original stack 321 of the automatic document feeder shown in FIG. 2, and sets the number of originals (70), the sorting number (2 sets) and the stapling or non-stapling mode (stapling mode) and the like. Then, the operator depresses the start key. The originals are sequentially fed to a predetermined position of the platen glass from the bottom of the set. The image thereof is copied. The copy sheets up to 50th sheet from the bottom of the originals, are sorted onto the second bin tray B2 from the top and the fourth bin tray B4 and the copy sheets from the originals from 51th original to 70th original, are sorted to the first bin trays and the third bin trays. After this sorting operation, the stapling unit 400 in the sorter 100 is disabled, and therefore, the sheets are not stapled by the stapling unit 400.

The sheet sets $S_A$ stacked on the fourth bin tray B4 is fed to the predetermined position of the intermediate tray 201 by the same means. At this time, the front and rear corner of the sheet set $S_A$ is inserted into between the bottom jaw 452 and the top jaw 451 of the stapler 450. Subsequently, the sheet set $S_B$ stacked on the third bin tray B3 is fed to the intermediate tray 201 by the same means, and the sheet set $S_B$ is accommodated at the same position as the sheet set $S_A$. In other words, the sheet set $S_A$ and the sheet set $S_B$ are placed between the jaws of the stapler 450 capable of stapling 100 sheets with the four corners aligned. Subsequently, an actuation signal is fed to the stapler 450, in response to which the top jaw 452 swings in the direction indicated by an arrow, so that the set $S_A$ and the set $S_B$ are stapled. The page order of the combined set $S_{AB}$ of the sheets is the same as that of the originals placed on the automatic document feeder.

The sheet sets $S_{AB}$, similarly to the foregoing embodiments, is transferred onto the stack tray 201 by the conveying rollers 243 and 244.

The sheet set $S_C$ received on the second bin tray B2 and the sheet set $S_D$ on the first bin tray B1, are similarly accommodated on the intermediate tray 201 with the sheet set $S_D$ at the top. They are stapled by the stapler 450, and is fed out onto the sheet set $S_{AB}$.

The numbers used in the foregoing description are only for example.

When the non-staple mode is selected by the operator before the start of the operation, the two sets of sheets are overlaid simply on the intermediate tray 2.

In the foregoing embodiment, temporarily divided sheet sets are combined on the intermediate tray into a large set, which in turn is accommodated on the stack tray.

In the foregoing embodiments, stapling means are used to bind the sheets, but it may be replaced with binding means for binding ends of sheets by an adhesive.

The stapler 450 is made reciprocable in a direction indicated by an arrow in FIG. 27, so that any number of sheets can be stapled at any position. For example, as shown in FIG. 27, if the cut-away portion 201*e* is formed at a rear end of the intermediate tray 201, the stapler 450 moves to the cut-away portion 201, so that the sheets can be stapled at the two positions.

Referring to FIGS. 38–53, the bin trays according to further embodiments of the present invention will be described.

Figure 38:
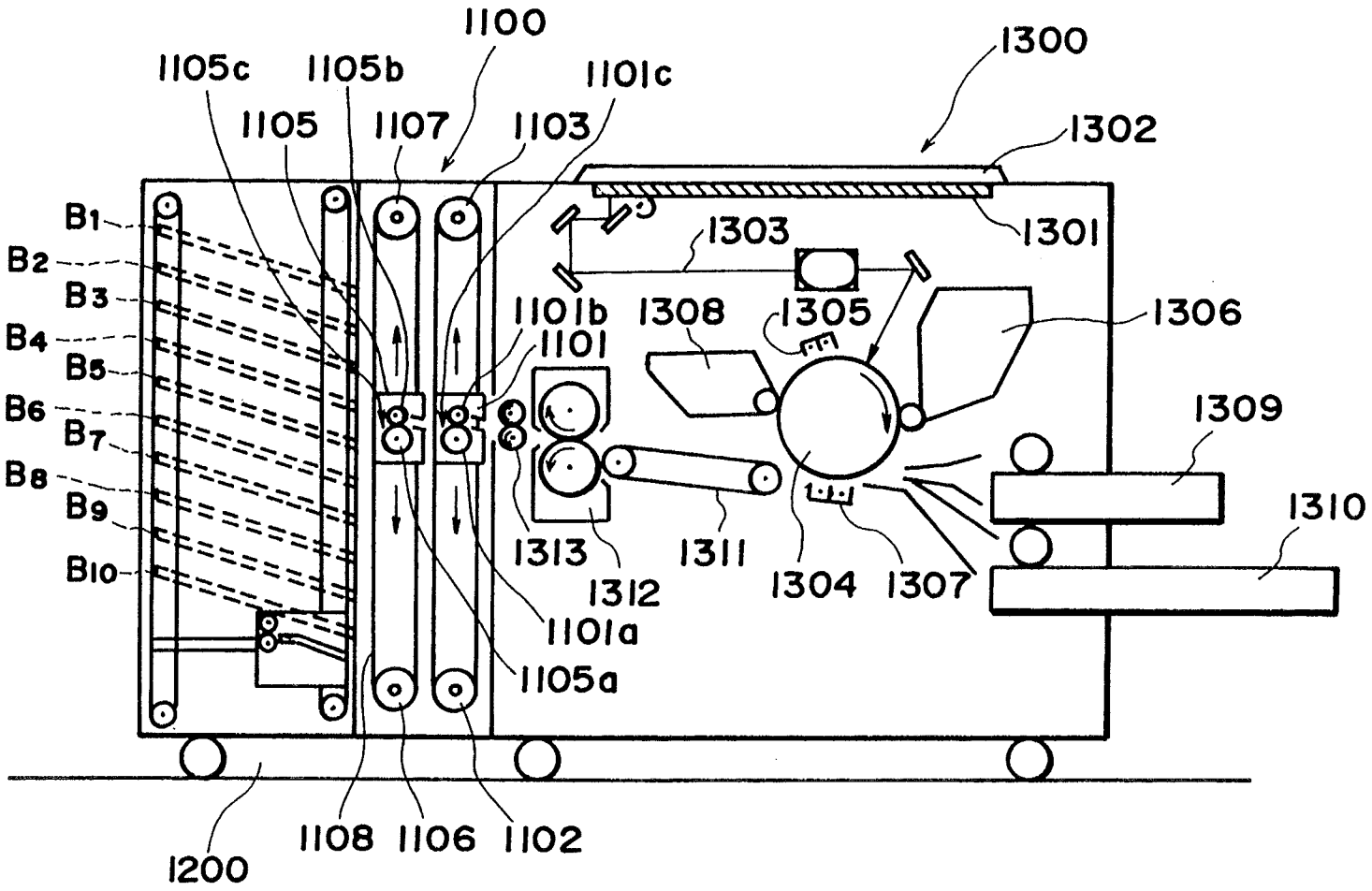
FIG. 38 is a sectional view of an apparatus according to a further embodiment of the present invention in which bin trays are fixed.

FIG. 38 is a sectional view of a sheet post-processing apparatus a sorter 1100 having vertically arranged bin trays B is disposed downstream of an image forming apparatus 1300, and a stacker 1200 is disposed in front of the sorter 1100 to receive sets of sheets.

The structure and the image forming process of the image forming apparatus 1300 is known, and the description is limited to the major part relating to the present invention. The image forming apparatus comprises a platen glass (original supporting glass) 1301, an original covering member 1302, an original illuminating lamp 1303, an original scanning mechanism of a movable optical system type including a movable mirror, an imaging lens, a fixed mirror and the like, a rotatable photosensitive drum 1304, a charger 1305, a developing device 1306, a transfer and separation chargers 1307, a cleaning device 1308, transfer sheet accommodating cassettes 1309 and 1310, a sheet conveying device 1311, an image fixing device 1312, and a pair of sheet discharging rollers 131.

The sorting apparatus 1100 has a similar structure to that shown in Japanese Laid-Open Patent Application No. 63-262373, and therefore, the description thereof will be briefly made. It comprises a plurality of bin trays B1–B10 vertically arranged. A first dispenser 1101 is vertically movable between a pair of sheet discharging rollers 131 of the image forming apparatus 1300 and a sheet inlet side of the bin trays B1–B10. A second is dispenser 1105 is disposed adjacent to the downstream side of the first dispenser 1101, and is also movable up and down. The first dispensing device 1101 comprises a pair of rollers 1101*a*, 1101*b* for gripping and conveying a sheet, a motor (not shown) for driving the rollers, and a sensor 1101*c* for detecting the presence of the $\theta$. It is mounted to a belt 1104 stretched between the lower driving pulley 1102 and an upper follower pulley 1103, so that it is vertically moved by forward or backward rotation of the belt 1104 by the forward or backward rotation of the driving pulley 1102. Similarly, the second dispensing device 1105 comprises a pair of rollers 1105*a*, 1105*b* for gripping and conveying the sheet, a motor (not shown) for driving the rollers, and a sensor 1105*c* for detecting presence of the sheet. It is mounted to a belt 1108 stretched between the lower driving pulley 1106 and an upper follower pulley 1107, and is moved up and down by forward and backward rotation of the belt 1108 by the forward or backward rotation of the driving pulley 1106.

The description will be made as to a bin unit 1105 having the bin trays B1–B10 and aligning means for aligning the sheets accommodated on the bin trays. As shown in FIG. 2, the bin unit 1105 comprises an aligning reference member 1108 extending from the top cover 1106 to the bottom cover 1107, the reference member 1108 being contactable to the sheets. A central shaft 1111 is fixed to the top arm 1109 at the to end and is fixed to the bottom arm 1110 at the bottom end. The central shaft 1111 is rotatably supported on a shaft 1106*a* on the top cover 1106 and to a shaft (not shown) on the bottom cover 1107. A sector gear 1102 is mounted on the bottom cover 1107 for rotation about a shaft thereon. The bottom arm 1110 is fixed to the sector gear 1112. Below the bottom cover 1107, there is a pulse motor 1113, and a pinion 1113*a* fixed to the output shaft of the pulse motor 1113 is in meshing engagement with the sector gear 1112. Between an end portion of the bottom arm 1110 and an end portion of the top arm 1109, an aligning rod 1115 is extended penetrating through the cut-away portions 114 of all of the bin trays B. Thus, the aligning rod 1115 is swingably movable by rotation of the sector gear 1112. A part of the bottom arm 1110 is provided with a light blocking plate 1116. It is integrally rotatable with the bottom arm 1110, by which it actuates or deactuates the home position sensor 1118 fixed on the bottom cover 1107 through an arm 1117.

In front of the aligning rod 1115, there is a reference rod 1118 penetrating through the cut-away portions 1119 of all of the bins, similarly to the aligning rod 1115. The bottom portion of the aligning rod 1118 is provided with a sector gear 1120 fixed thereto. The sector gear 1120 is supported on a shaft 1121 of the bottom cover 1107. The upper arm 1122 fixed to the to end of the reference rod 1108 is supported on a shaft 1123 on the top cover 1106. Below the bottom cover 1107, there is a pulse motor 1124. A pinion gear 1124*a* fixed to the output shaft of the pulse motor 1124 is in meshing engagement with the sector gear 1120 to rotate the sector gear 1120, by which the reference rod 1108 makes swinging movement. To an end of the sector gear 1120, a light blocking plate 1125 is provided. By rotation of the sector gear 1120, a home position sensor 1126 disposed at the rear side of the bottom cover 1107 is actuated or deactuated.

Figure 39:
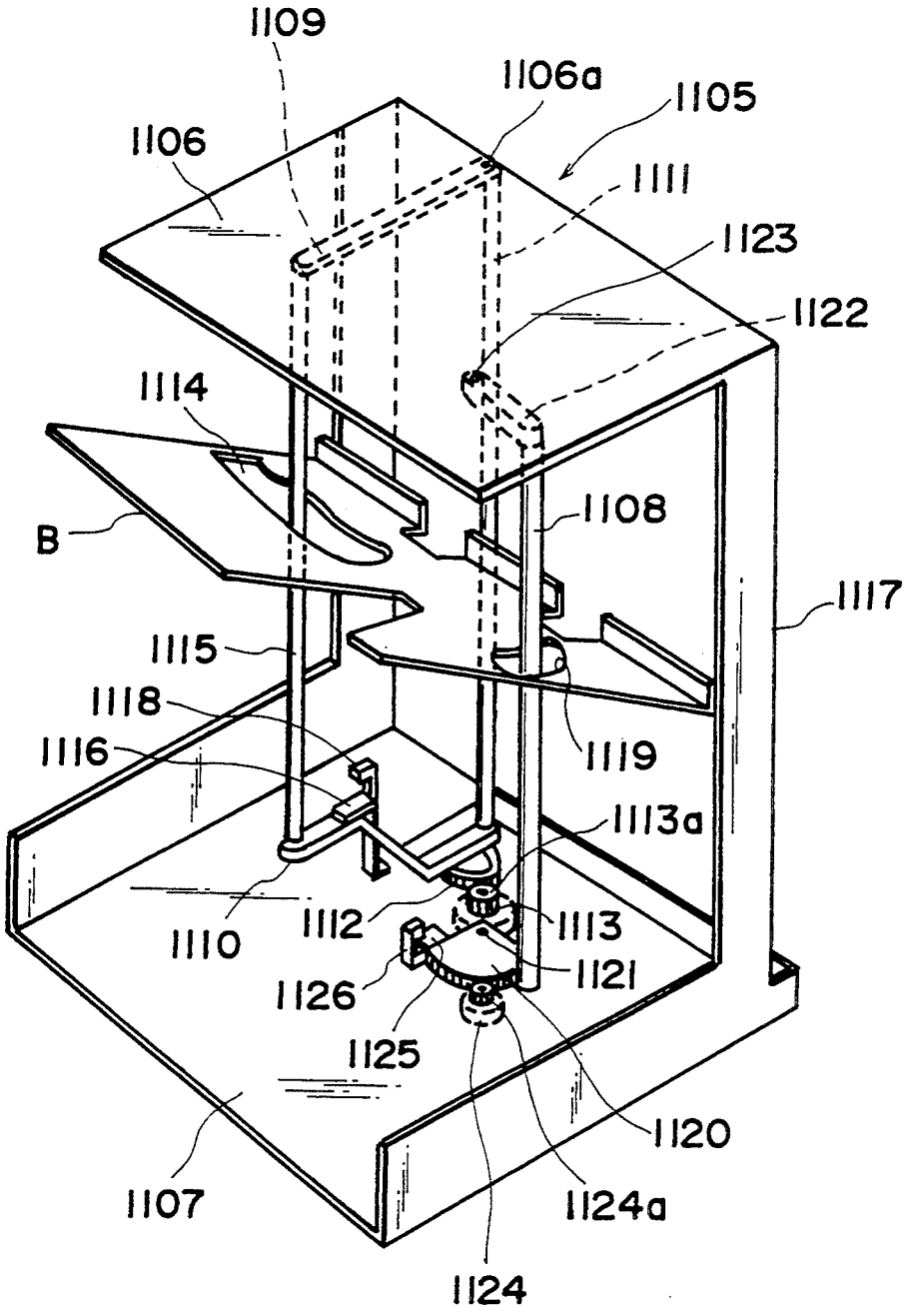
FIG. 39 is a perspective view of a bin unit.
Figure 40:
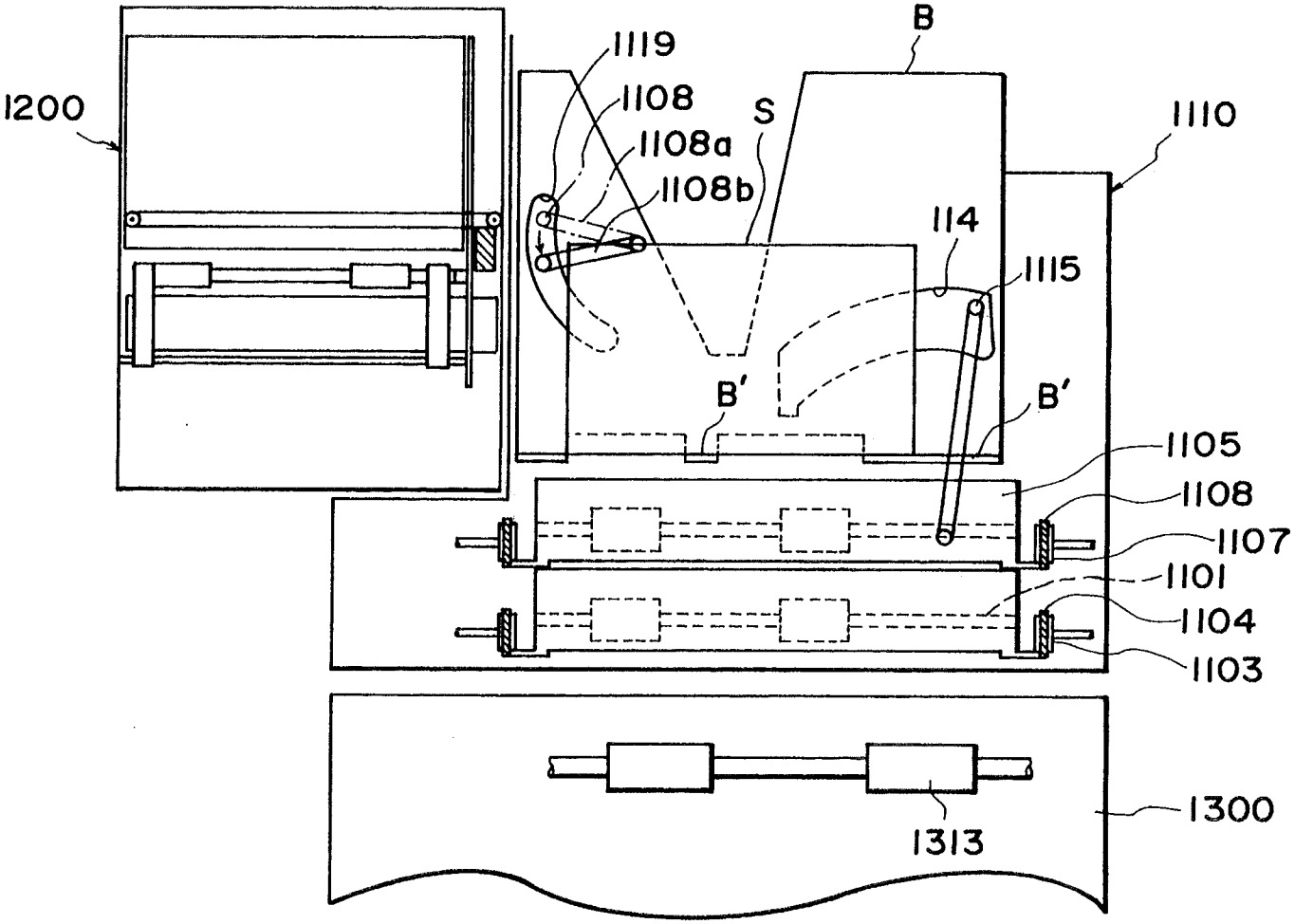
FIG. 40 is a top plan view of the apparatus of FIG. 38.

As shown in FIG. 39 and in FIG. 40 which is a top plan view of the apparatus shown in FIG. 39, when the copying operation of the image forming apparatus 1300 is started, the reference rod 1108 having been placed at a stand-by position 1108*a* (chain line position) is moved in the direction indicated by an arrow by the rotation of the pulse motor 1124, and stops at an alignment reference position 1108*b* (solid line position). Thereafter, the sheet S on which an image has been formed by the image forming apparatus 1300 is discharged to the bin tray by the discharging rollers 1313 through the sheet dispenser 1101 of the sorter apparatus 1100. It moves toward the rear end stopper B′ on the bin tray B inclined toward the end stopper B′, by the weight thereof.

Figure 41:
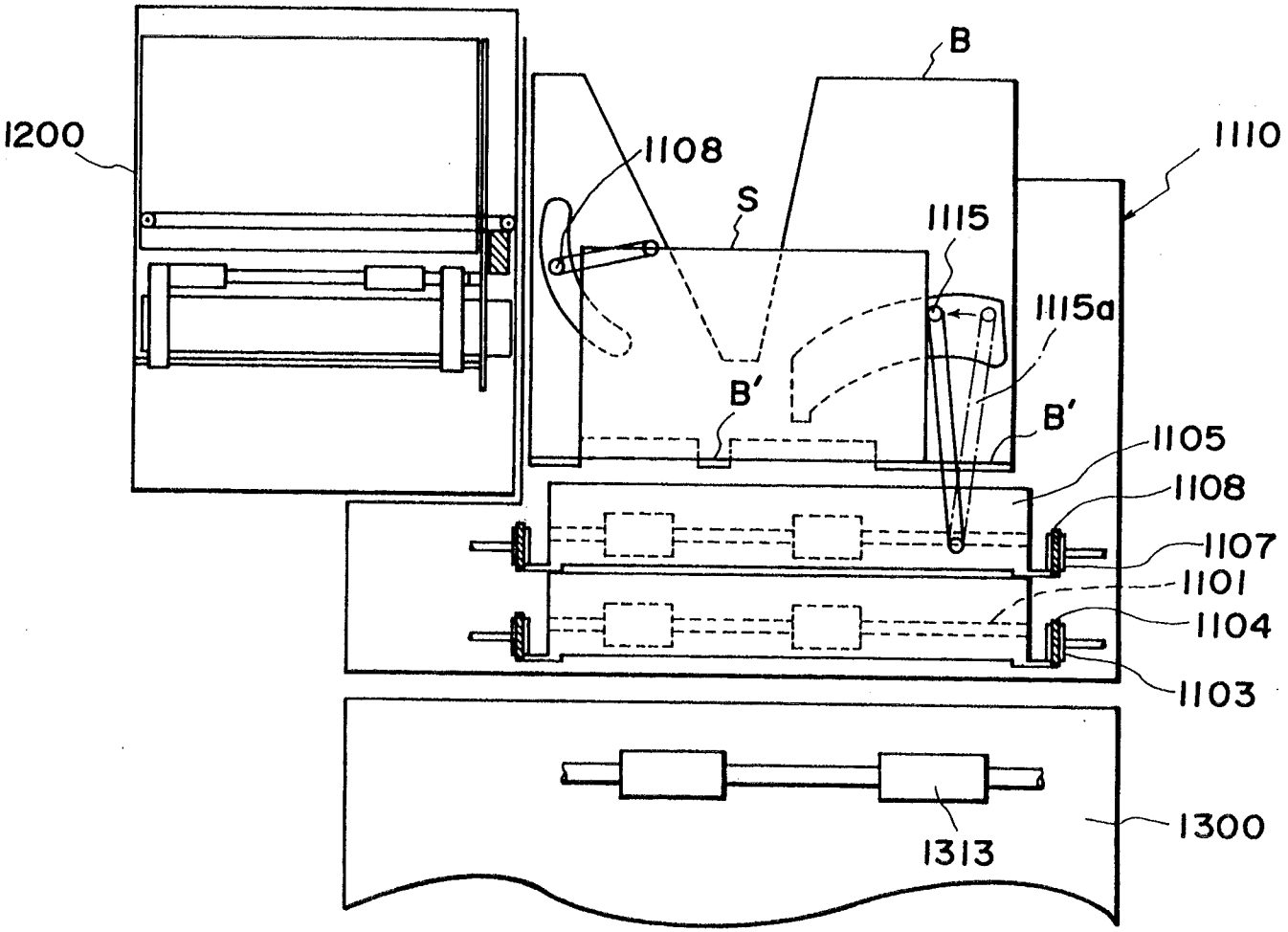
FIG. 41 is a top plan view of the apparatus of FIG. 38.

As shown in FIG. 41, by the rotating pulse motor 1113 responsive to the pulse signal corresponding to the sheet size, the aligning rod 1115 moves through a predetermined distance from the stand-by position 1115*a* (chain line position) to the solid line position, thus urging the sheet to the reference rod 1108 which is fixed at the alignment reference position 1108*b*.

The reference rod 1108 is kept at the alignment reference position until all of the sheets are received by the bin trays B from the image forming apparatus 1300. However, the aligning rod 1115 moves through the predetermined distance, and returns to the stand-by position 1115*a* for the preparation of the discharge of the next sheet. By repetition of the above-described operations, a set of sheets are aligned by the lateral end abutted to the reference rod 1108 and by abutment of the trailing end to the rear end stopper B′. The aligning rod 1115 penetrates through all of the bin trays, and therefore, the sheets S received on the other bin trays are also aligned similarly.

The description will be made as to the structure of the stacker 200.

Figure 42:
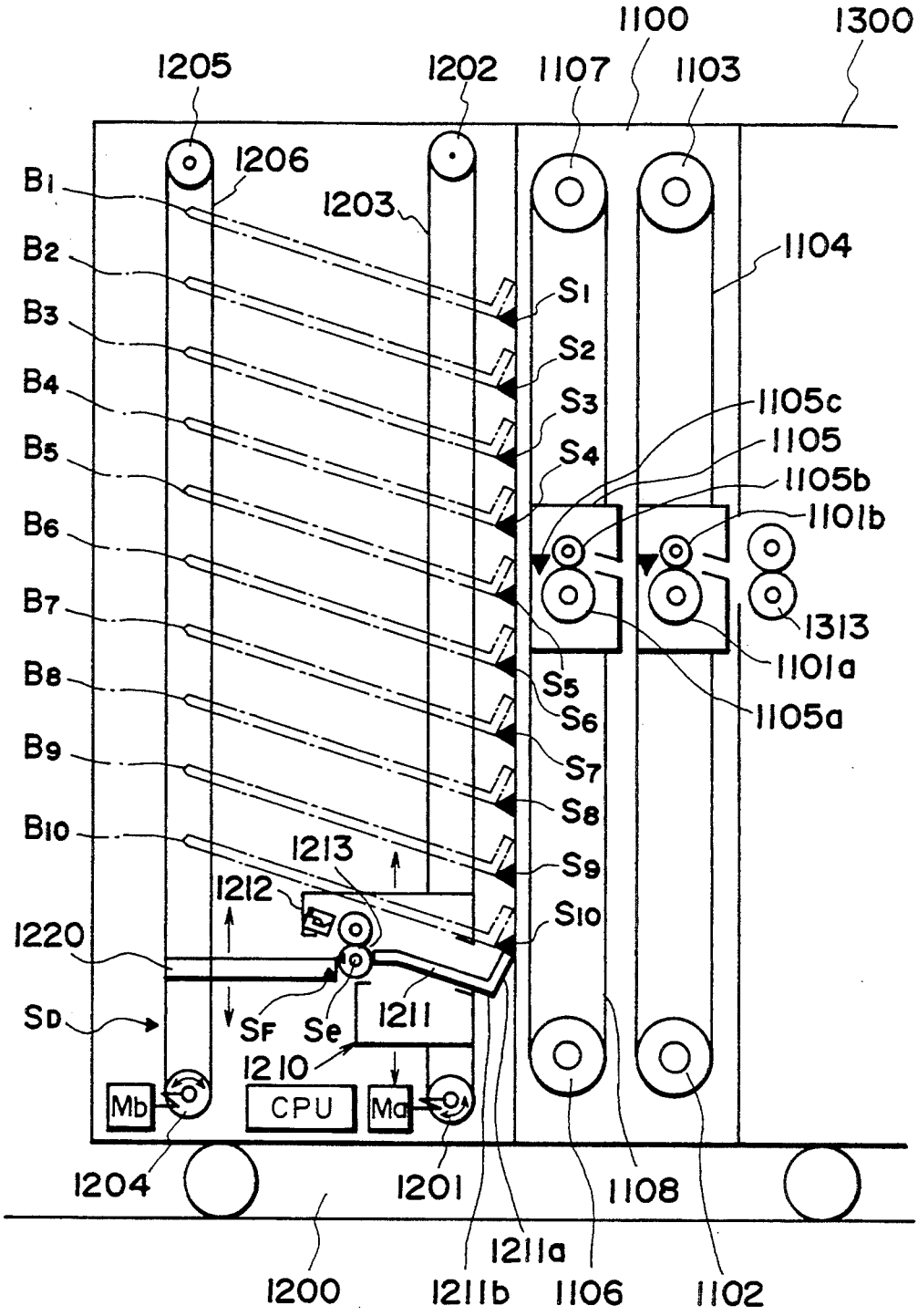
FIG. 42 is a sectional view of a sorter and a stacker.

FIG. 42 is a sectional view of the stacker 200, and FIG. 41 is a top plan view of the same as shown in these Figures, the stacker 1200 comprises an intermediate unit 1210 for feeding sheet set and a stacking tray 1220 for stacking sets of sheets conveyed thereto. The intermediate unit 1210 is fixed to a belt 1203 stretched between a lower driving pulley 1201 mounted on a vertical frame and an upper follower pulley. By the forward or backward rotation of the motor Ma for rotating the bottom pulley 1201, the intermediate unit 1210 moves up and down. On the other hand, in the stack tray 1220 is fixed on a belt 1206 stretched between a lower driving pulley 1204 mounted on the vertical frame and an upper follower pulley 1205, and it is vertically movable by the forward and backward rotation of the motor Mb for rotating the lower pulley 1204.

The intermediate unit 1210 comprises an intermediate tray 1211 for temporarily accommodating a set of sheets, a gripper unit 1212 for transferring the sheet set on the bin tray B to the intermediate tray 1211, and a conveying unit 1213 for conveying the sheets on the intermediate tray 1211 to the stack tray 1220.

Figure 44:
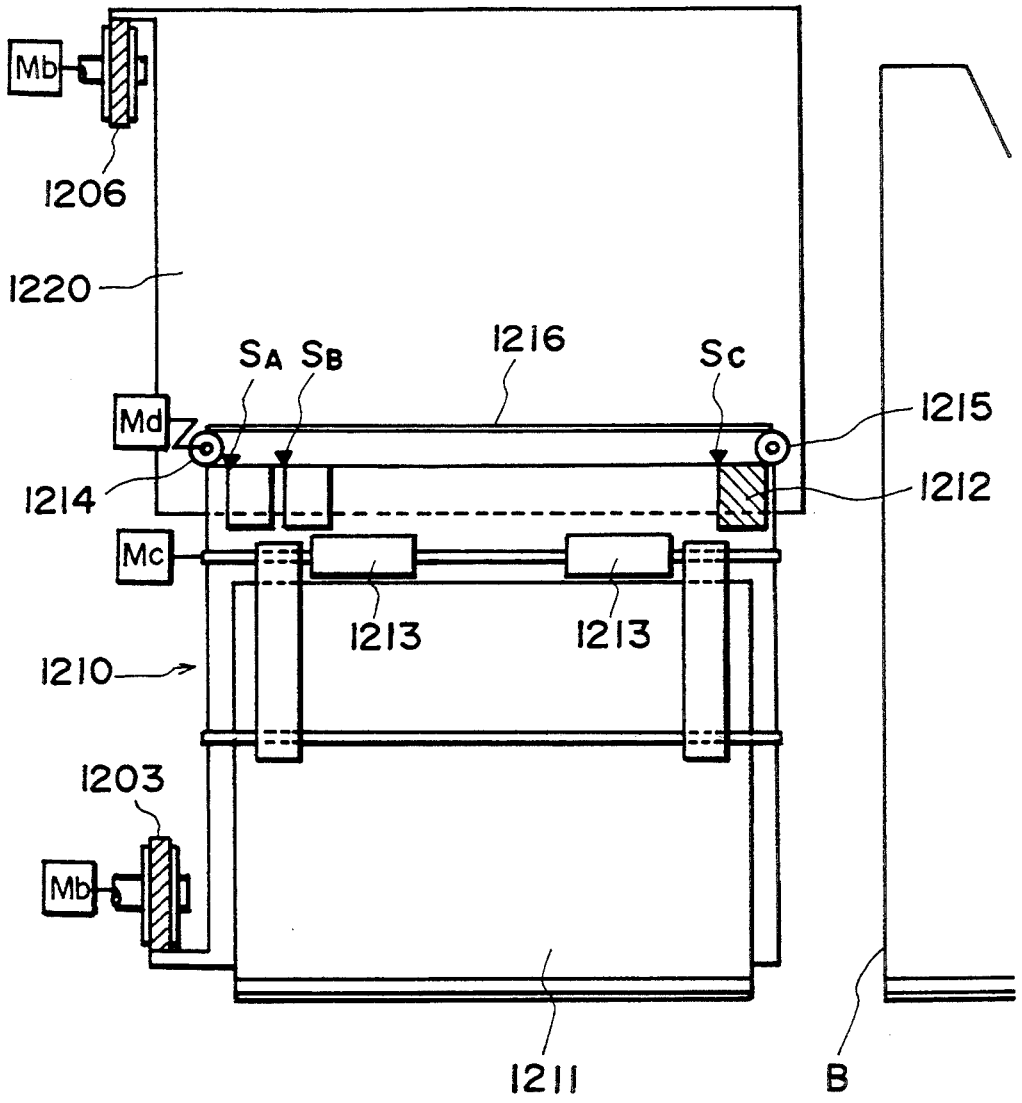
FIG. 44 is a top plan view of a stacking apparatus.

The intermediate tray 1212 is fixed to a frame (not shown) of the intermediate unit 1210, and extends in parallel with the bin trays B1–B10. To the rear end, a sheet stopper 1211*a* stands. The gripper unit 1212, as shown in FIG. 44, is fixed to a belt 1216 stretched between a front driving pulley 1214 and a rear pulley 1215 provided at the opposite ends of a frame (not shown) front to back direction of the intermediate unit 1210. It is reciprocable in the direction indicated by the arrow by the forward and backward rotation of a motor Md for driving the front pulley 1214. On the frame, there are provided a sensor S for detecting a third position (solid line position) of the gripper unit 1212, a sensor $S_A$ for detecting the first position (chain line position), and a sensor $S_B$ for detecting the second position (indicated by chain lines with two dots).

Figure 45:
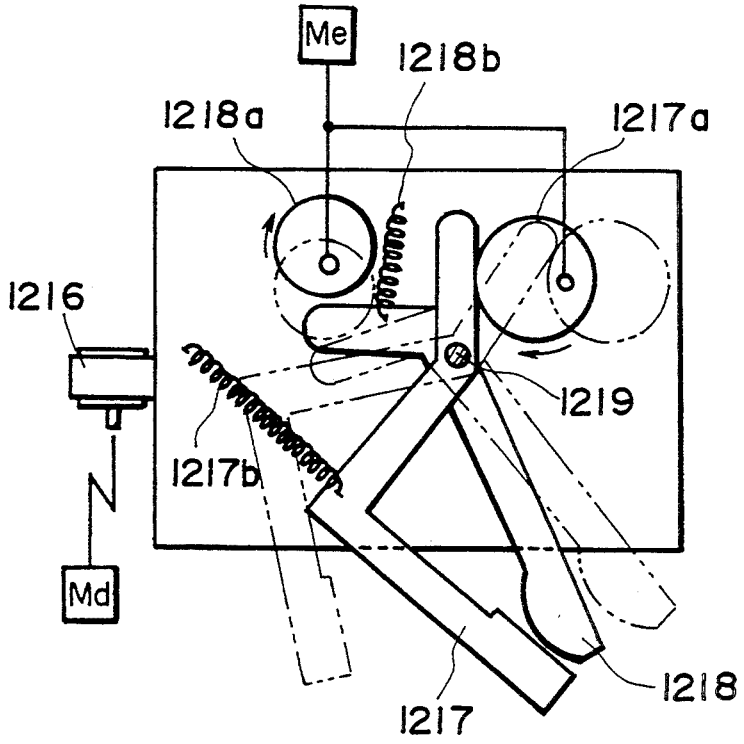
FIG. 45 is a front view of a grip of a stacker.

As shown in FIG. 45, the lower gripper arm 1217 and the upper gripper arm 1218 are supported on a shaft 1219 in the gripper unit 212. Eccentric cams 1217*a* and 1218*a* are contacted to the arms and is rotated by a motor Me, so that it is moved between the solid line position (gripping position) and the chain line position (open position). Spring members 1217*b* and 1218*b* mounted to the respective gripper arms urge the gripper arm at all times to the eccentric cam to provide the predetermined gripping force.

Figure 46:
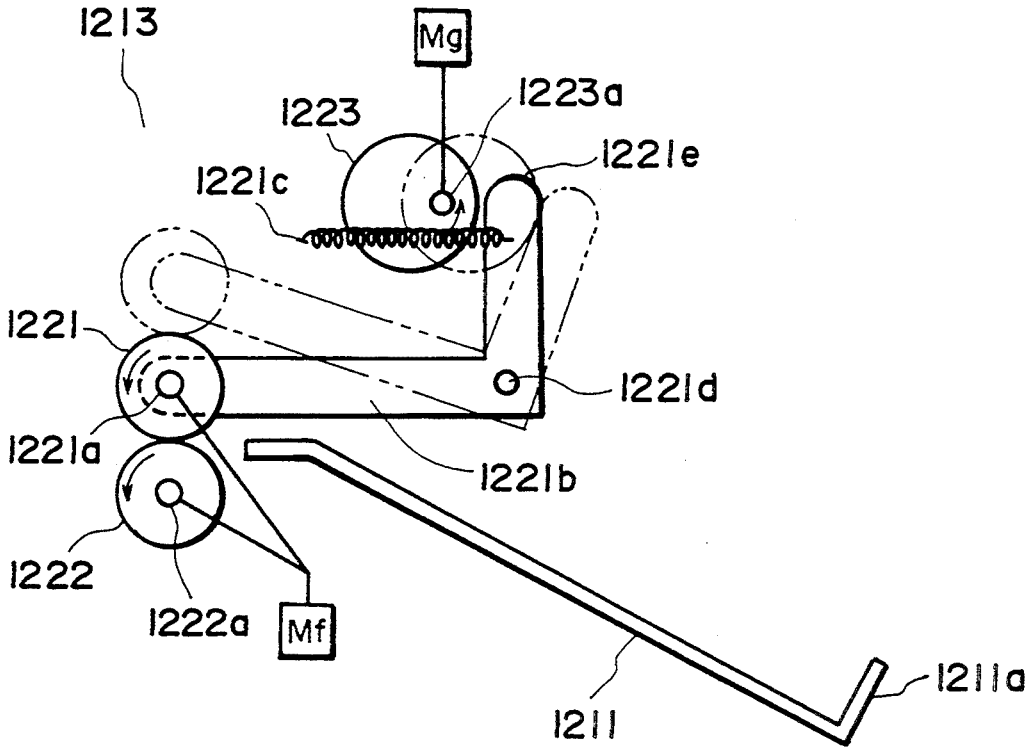
FIG. 46 s a front view of a conveyer of a stacker.

Referring to FIG. 46, the description will be made as to the conveying unit 1213. Two lower conveying rollers 1212 are mounted on a lower roller shaft 1222*a* supported on front and rear plates (not shown) of the intermediate unit 1210, and at an upper side faced to the lower conveying roller 1222, the upper conveying rollers 1221 is mounted on the upper roller shaft 1221*a*. The opposite end of the upper roller shaft 1221*a* are supported by a swingable arm 1221*b* engaged with the shaft 1221*d* supported on the plates. An eccentric cam 1223 contacted to an end 1221*e* of the swingable arm 1221*b* to swing the swingable arm 1221*b* between the solid line position (gripping position) and the chain line position (open position). The eccentric cam 1223 is mounted on a shaft 1223*a* rotated by a motor Mg. The upper conveying roller 1221 and the lower conveying roller 1222 have the same outer diameter, and are rotated at the same speed in the direction indicated by the arrows by the motor Mf.

As shown in FIG. 42, a vertical frame of the stacker 200, there is fixed a group $S_N$ including sensors S1, S2, S3, S4, S5, S6, S7, S8, S9 and S10 faced to the bottommost position of the bin trays B1, B2, B3, B4, B5, B6, B7, B8, B9 and B10. Below the nip position formed between the rollers 1221 and 1222 of the intermediate unit 1210, a sensor Se is disposed to detect the sheet surface on the stack tray 1220. A sensor $S_D$ is fixed to the frame of the stacker 200 to detect the bottommost position of the stack tray 1220. A sensor $S_F$ is mounted on a surface of the stack tray 1220 adjacent to the intermediate unit 1210 to detect the trailing edge of the sheet sets being conveyed. A CPU receives outputs from the various sensors, and controls the various motors. The CPU further establishes communication between the sorter 1110 and the image forming apparatus 1300.

Figure 47:
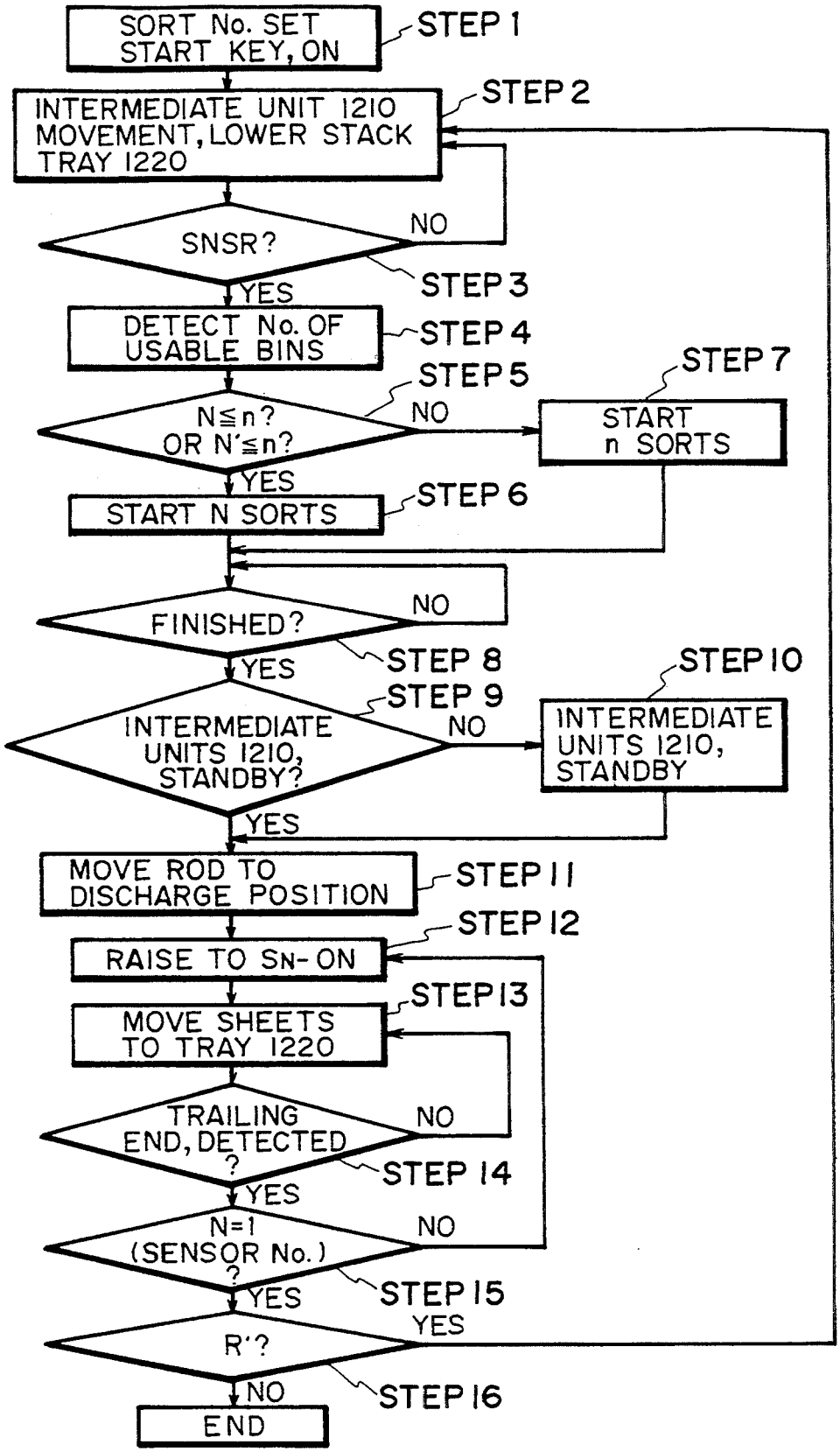
FIG. 47 is a flow chart of sequential operations.
Figure 48:
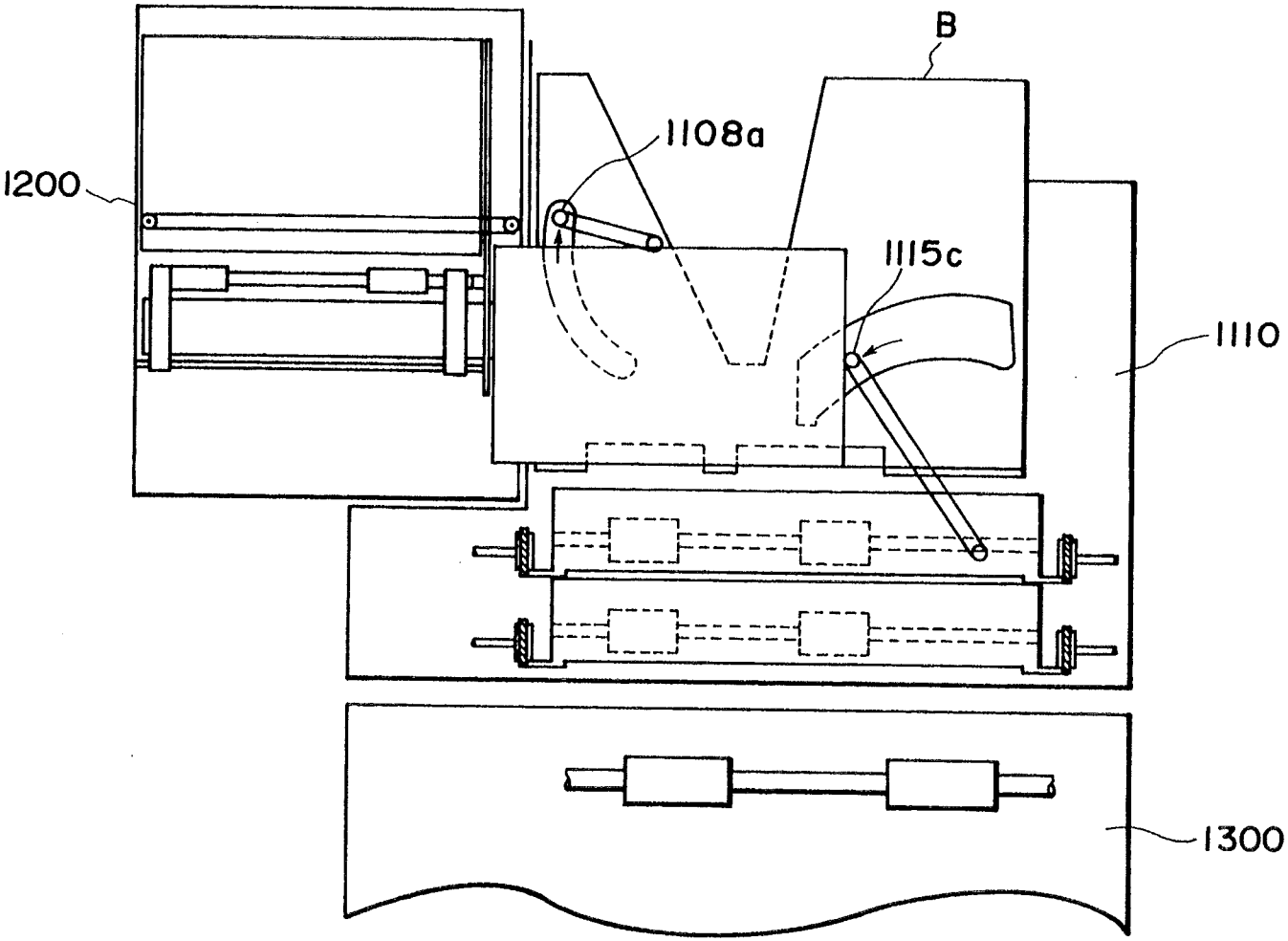
FIG. 48 is a top plan view illustrating operation.

Referring to FIG. 47 (flow chart), the operation of the above-described apparatus will be described.

Step 1: The operator places the originals on the image forming apparatus 1300, and sets the requisite number of sets of sorted sheets N or the like, and depresses the start key after the setting.

Figure 43:
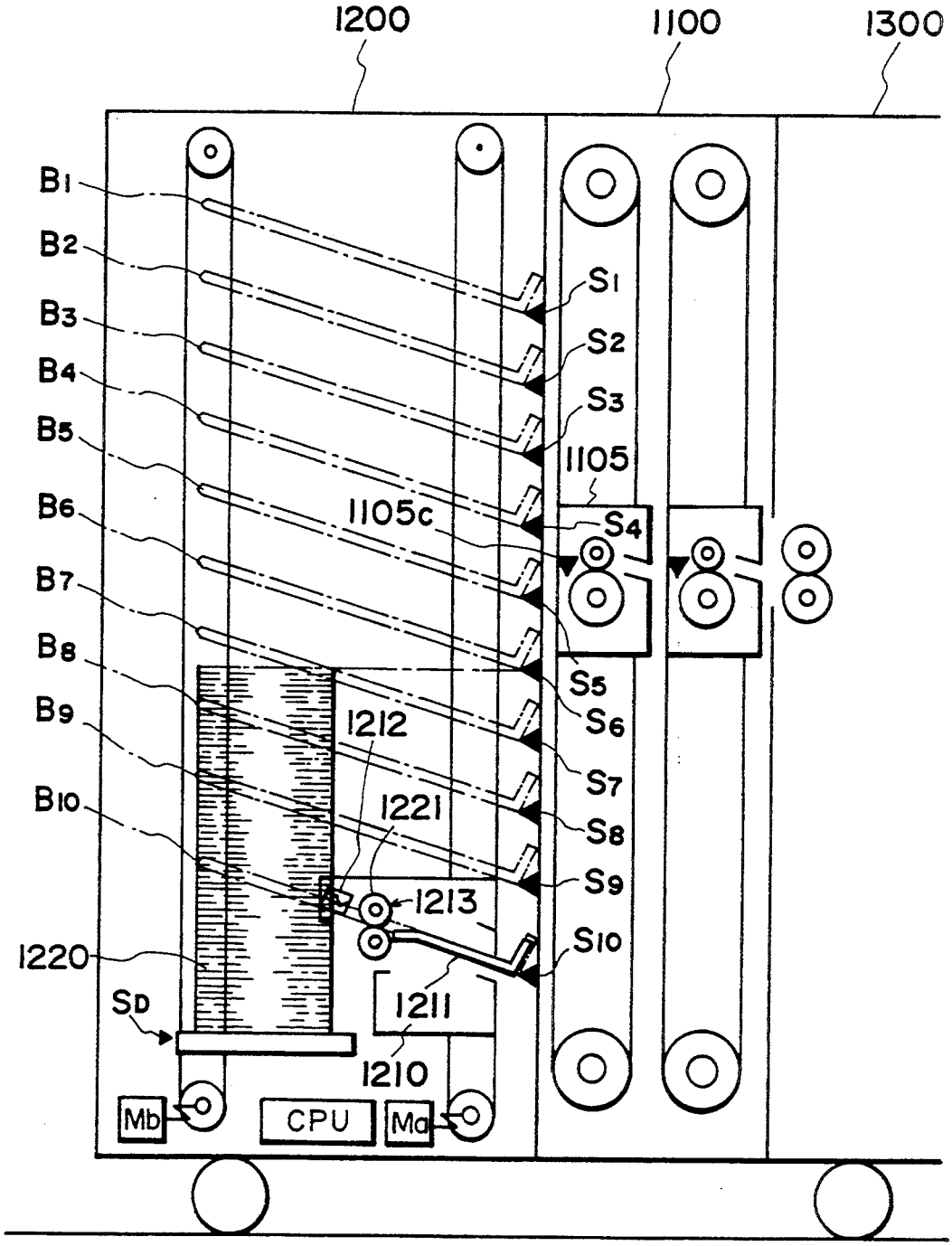
FIG. 43 is a sectional view of a sorter and a stacker.

Steps 2 and 3: As shown in FIG. 43, the intermediate unit 1210 moves to a position facing the bottommost bin tray B10. The stack tray 1220 lowers by the motor Mb until the lower limit sensor $S_D$ detects it.

Step 4: The CPU recognizes the number of usable bin trays (n), that is, the number of bin trays above the sheet surface on the stack tray 1220, by detecting the sheet surface on the stack tray 1220 by the bin sensors $S_N$. In FIG. 43, for example, the sheet surface is detected by the sensor S6, and therefore, the number n of the usable bin trays is 6 (S1–S6).

Steps 5, 6, 7 and 8: The CPU compares the initially set number for the requisite sheet sets N with the usable number of bin trays (step 5). If $N \leqq n$, the requisite N sets of sheets are sorted (step 6). If $N > n$, n sets of sheets are first sorted (step 7).

The sorting operations, are as disclosed in Japanese Laid-Open Patent Application No. 63-262373, and therefore, the description will be made briefly. As shown in FIG. 42, the discharged sheet from the image forming apparatus 1300 is gripped by the rollers 1101*a* and 1101*b* of the first dispensing device 1101 at the stand-by position corresponding to the sheet discharging rollers 1313. The first dispensing device 1101 is moved to the position of the second dispensing device 1105 waiting at the sheet inlet of the predetermined bin tray. Thereafter, the rotations of the rollers 1101*a* and 1101*b* transfer the sheet to the second dispensing device 1105. The rollers 1105*a* and 1105*b* of the second dispensing device 1105 discharge the sheet to the proper bin tray.

When the leading edge of the sheet is gripped by the rollers 1105*a* and 1105*b* of the second dispensing device 1105, the first dispensing device 1101 is returned to the position of the discharging rollers 1313 of the image forming apparatus 1300. The second dispensing device 1105 at a predetermined bin tray moves up or down by one stage, and is prepared for the next sheet from the first dispensing device 1101.

By repetition of the above operations, the sheets are sequentially dispensed to the bin trays. The sheets are aligned on the bin trays in the manner described in the foregoing. Finally, all of the sheets having the images are stacked and aligned on the bin trays (step 8).

Steps 9 and 10: At step 8, the sort completion signal is transmitted to the stacker 1200. The sensor $S_A$ detects and determines whether the gripper unit 1212 of the intermediate unit 1210 is at the first position or not (FIG. 44). If not, the movement is effected until the sensor $S_A$ detect its. It is also detected whether the lower gripper 1217 and the upper gripper 1218 are in the open position (FIG. 45). If not, the grippers are moved to the open positions. Furthermore, it is discriminated whether the conveying rollers 1221 and 1222 of the conveying unit 1213 are open positions. If not, the upper conveying roller 1212 is moved to the open position.

Step 11: After the reference rod 1108 returned to the stand-by position 1108*a*, a lateral end portion of the aligned sheet set shown in FIG. 41 is moved to the stacker position 1200.

Step 12: The intermediate unit 1210 waiting at the stand-by position corresponding to the bottommost bin tray B10 (step 3), is elevated by the motor Ma, and it is stopped when the bin sensor $S_N$ (S6 in the case of FIG. 43) corresponding to the bottommost bin tray BN among the sheet stacking bins. Further, the stacking tray 1220 is elevated, and is stopped when the sensor $S_A$ of the intermediate unit 1210 detects the sheet surface.

Figure 49:
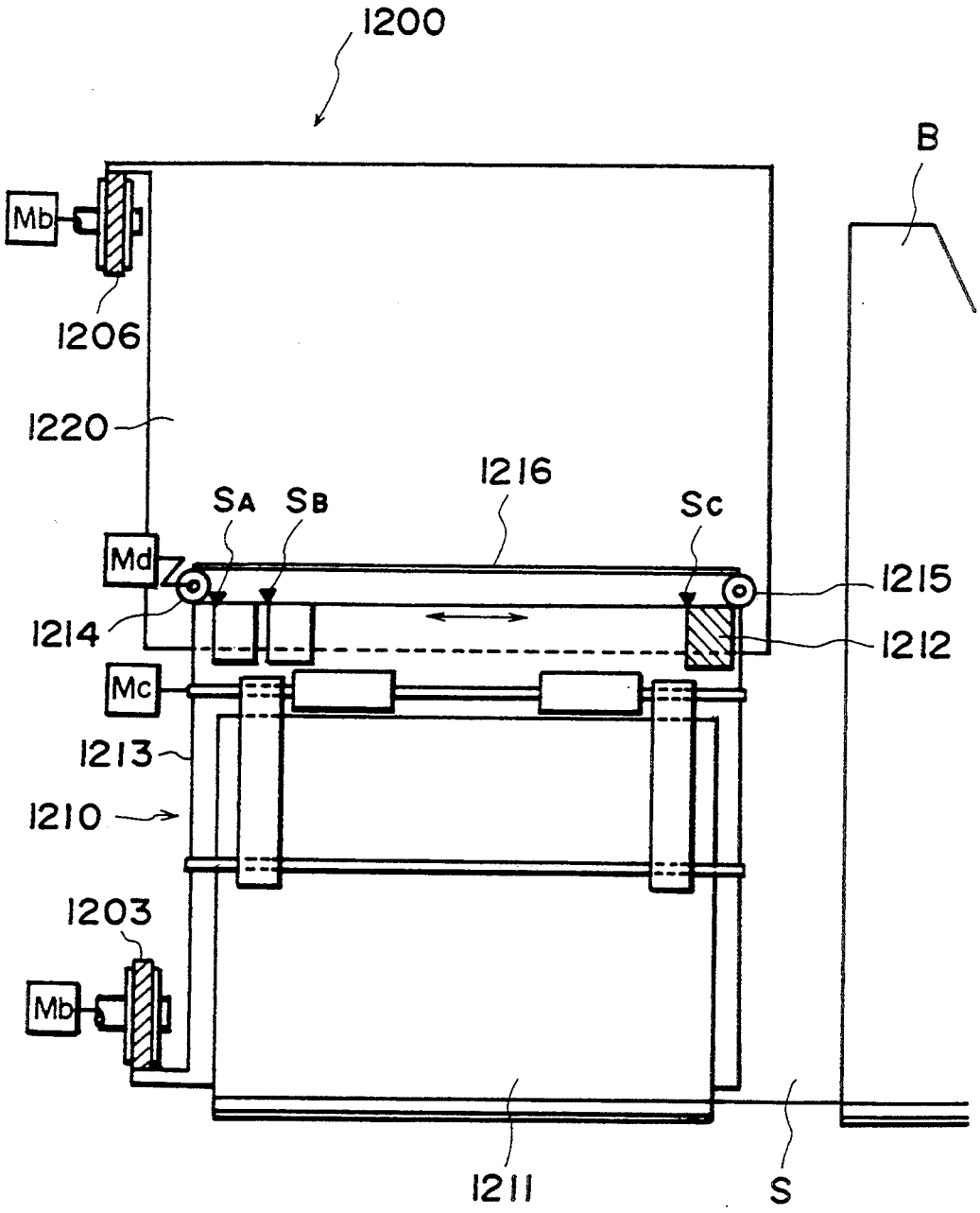
FIG. 49 is an enlarged view illustrating operation.
Figure 50:
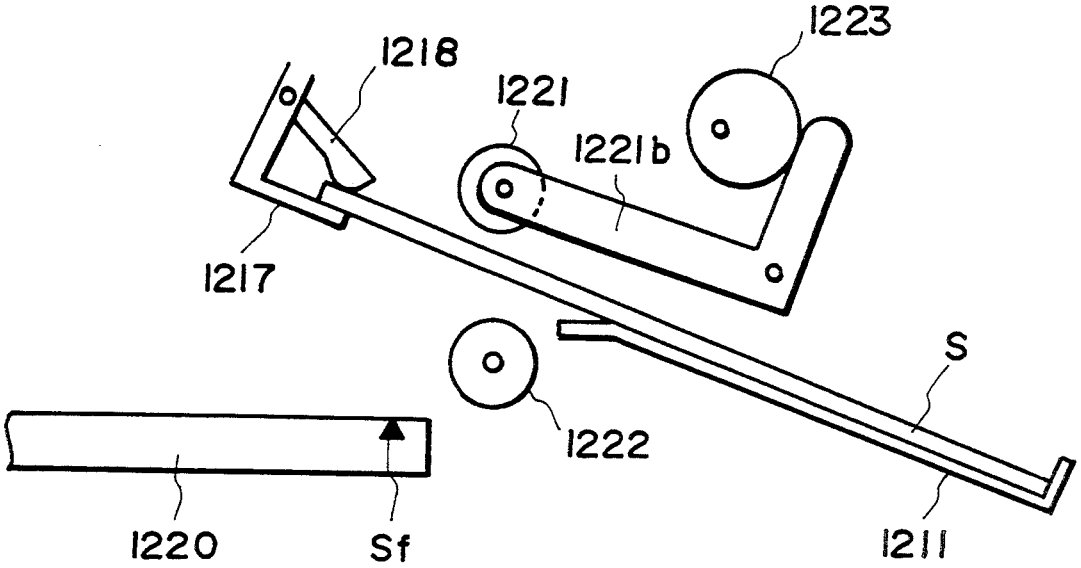
FIG. 50 is a front view illustrating operation.
Figure 51:
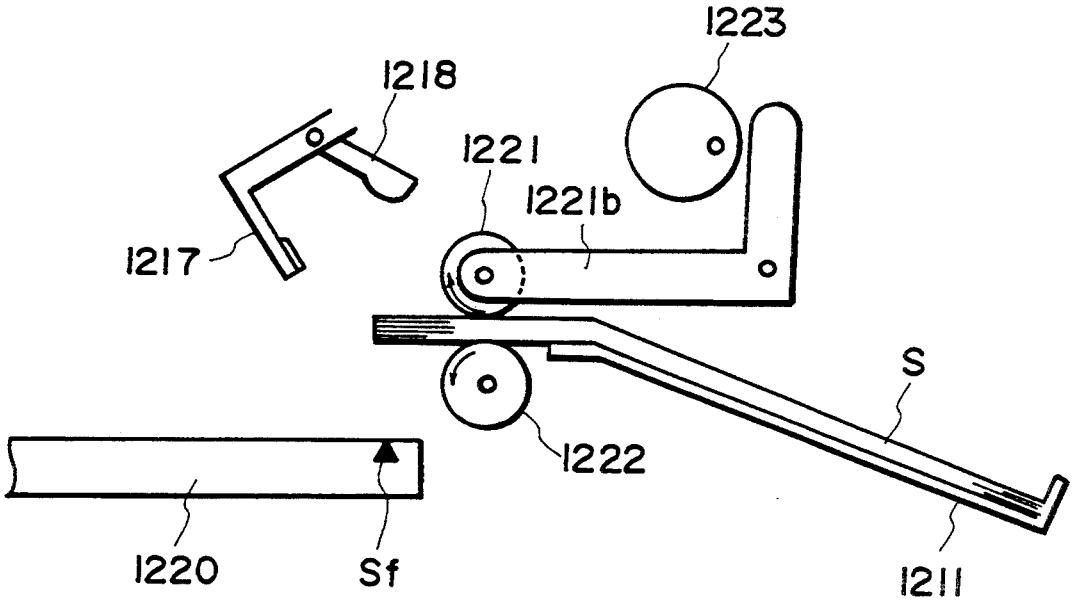
FIG. 51 is a front view illustrating the operation.
Figure 52:
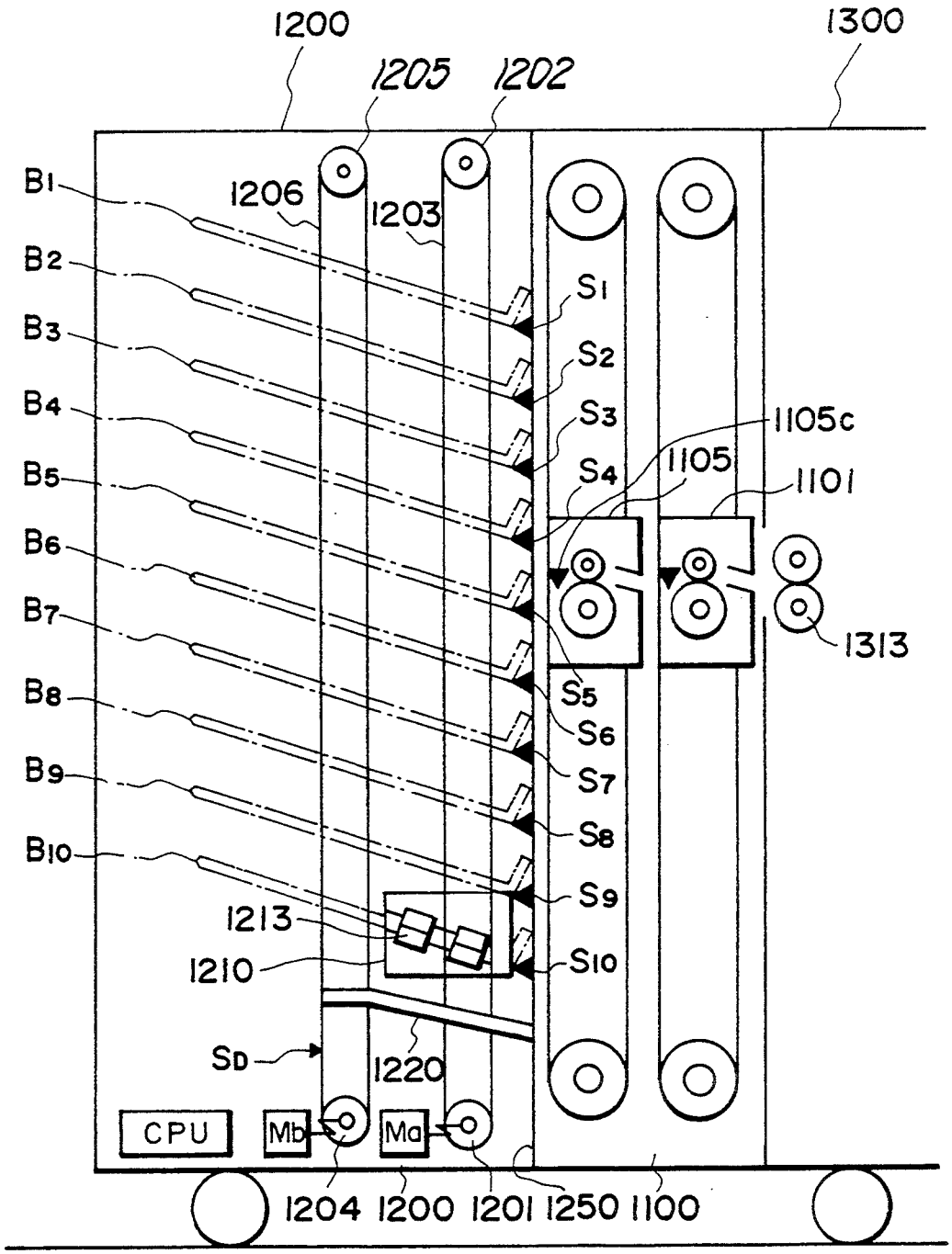
FIG. 52 is a front view of an apparatus according to a further embodiment of the present invention in which bin trays are fixed.

Step 13: As shown in FIG. 49, the gripper unit 1212 is moved by the motor Md, and is stopped at the third position where the sensor $S_C$ detect its. At this time, a leading side corner of the sheet set S is inserted between the upper and lower grippers 1217 and 1218 placed at the open positions, and then, the upper and lower grippers 1217 and 1218 are moved to the gripping positions, so that the leading end corner is assuredly gripped. Subsequently, the gripper unit 1212 moves to the first position where the sensor $S_A$ exists, so that the set of sheets is inserted between the upper and lower conveying rollers 1221 and 1222 which are at the open positions (FIG. 50). Then, the grippers 1217 and 1218 are placed to the open position to release the sheet set, and the conveying rollers 1221 and 1222 are brought into the gripping positions to grip the sheet set with the predetermined pressure. Subsequently, the conveying rollers 1221 and 1222 are rotated in the directions of the arrows by the motor Mf to transfer the sheet set onto the stacking tray 1220.

Step 14: When the sensor $S_F$ shown in FIG. 50 detects the trailing end of the sheet set S, the sheet set S is stacked on the stacking tray 1220 (completion of the stacking is detected).

Step 15: If the bottommost ones of the bin trays BN is the bin tray B1 at step 12, the operation proceeds to step 16. If not, the operations are repeated from step 12 to step 15, so that the sheet sets are sequentially conveyed to the stacking tray 1220 from the lower bin tray.

Step 16: At step 5, if $N \leqq n$, the operation is complete as it is. If $N > n$ at step 5, that is, there remains the sets (N'), the operation returns to step 2, and the operations are repeated from step 2 to step 16.

In the foregoing description, unstapled or unbound sheets are taken, but the apparatus may be provided with binding means such as stapling means to permit stapling or binding of the sheets. In the foregoing description, at step 13, the stop position of the gripper unit gripping the set of sheets is only at the first position. However, it may be changed to the first position or second position, as has been described in conjunction with FIG. 44, for each of the sheet sets. The sheet set accommodated on the stack tray 1220 through the above operations is spatially divided (offset).

The description will be made as to an embodiment in which the processing speed is increased when the sorting operation is carried out in the above-described sorting apparatus.

In this embodiment, the CPU divides the requisite sort set number N (N1 and N2, for example). First, the operations after step S6 are carried out for the first N1 sets. When the operation reaches to the step 9, the operations after step 6 are carried out for N2 sets. Thus, during the transfer of the sheet sets from the bin trays to the stacking tray 1220, the sorting operations are carried out for the remaining sets, so that the overall processing speed is reduced. The divided numbers N1 and N2 may be properly calculated to provide the higher processing speed. In this case, the aligning operations on the bin tray are not carry out.

At step 3, the interval between the sensor S1 corresponding to the topmost bin and each bin sensor SN for detecting the sheet surface on the stack tray 1220, is the one determined in the design of the apparatus. Therefore, it is possible to empirically determine the number of sheets accommodatable thereon. Therefore, by inputting the accommodatable number of sheets corresponding to the intervals into the CPU, it is possible that the operation is prohibited, or a warning signal is produced to the operator when the total sheet numbers calculated on the basis of the set number of originals and sorting number (step 1) exceeds the accommodatable number of sheets.

In the foregoing, the transfer of the sheet sets from the bin trays to the stacking tray, is carried out sequentially from the lower sheet sets. However, as will be described later, this may be changed so that the sheet sets are transferred from the top or from the bottom, as the case may be.

For example, as described hereinbefore, the number of sheets accommodatable in the interval of the adjacent bin sensors SN is stored in the CPU beforehand. A number of total sheets N3 is calculated on the basis of the set number of originals and the requisite number of sorted sets. For the purpose of easy understanding, it is assumed that the stacker 1200 is in the state shown in FIG. 43, and the four sets is requited ($n=4$), the number of sheets N4 which can be accommodated between a sensor S4 corresponding to the bottommost bin tray B4 used in the sorting mode, and a sensor S6 for detecting the sheet surface of the stacking tray 1220, is recognized by the CPU. If $N3 < N4$, the sheet sorted to the bin trays B1–B4, is sequentially taken out by the intermediate unit 1210 in the order of B1, B2, B3 and B4 or in the order of B4, B3, B2 and B1, depending on the selection made by the CPU. More particularly, the intermediate tray 1210 starts the sheet transfer from the bin tray which has first received the last sorted sheet. The selection is determined on the basis of the number of originals, and the set of sheet is first taken out in the order from the bin tray first having received all of the sheets, and therefore, the waiting period can be shortened, thus reducing the overall processing period.

When the CPU discriminates that $N3 > N4$, non-selection is carried out, and as described hereinbefore, the sheet set is taken out from the bottom bin tray.

Figure 53:
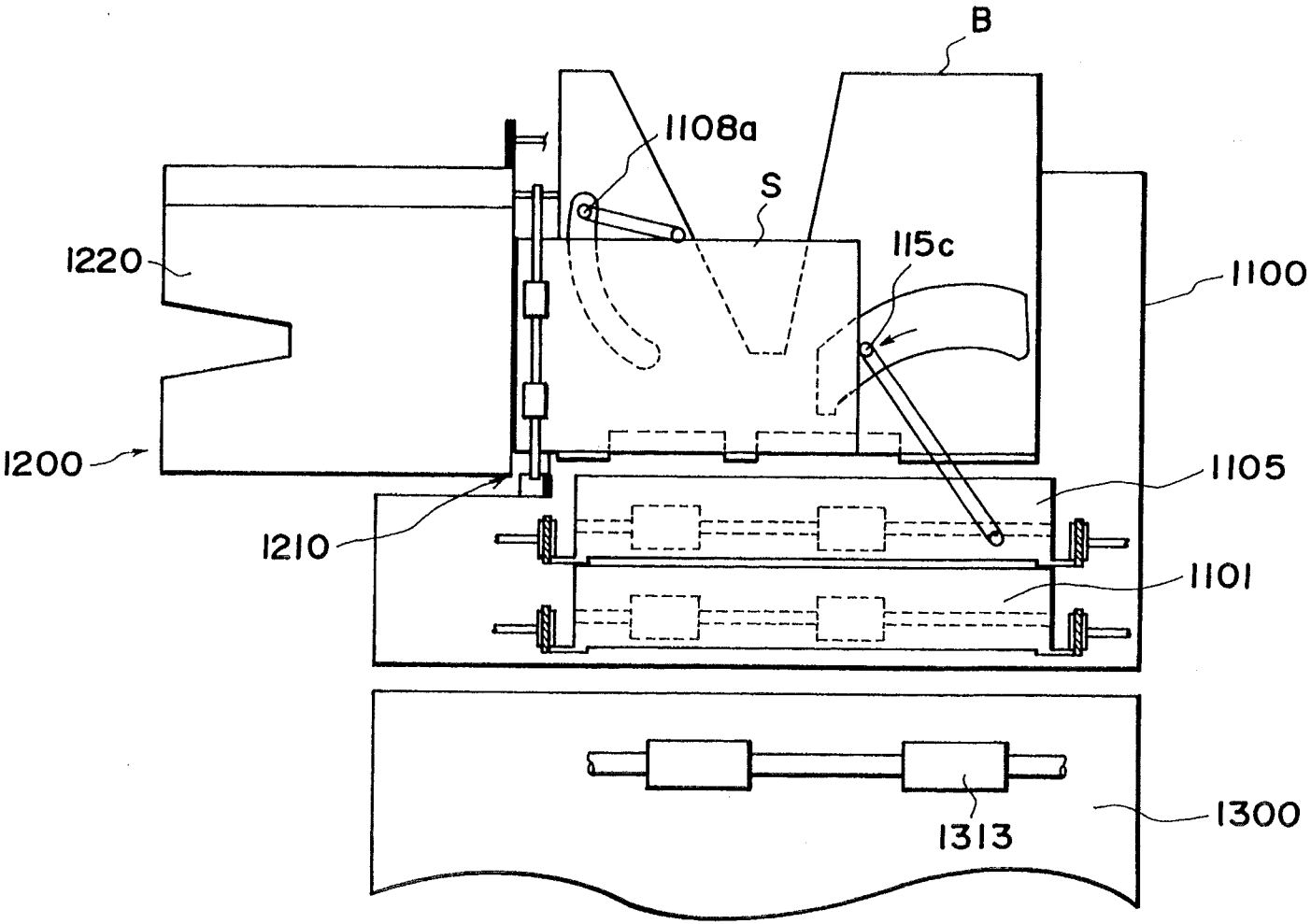
FIG. 53 is a top plan view of an apparatus of FIG. 52.
Figure 54:
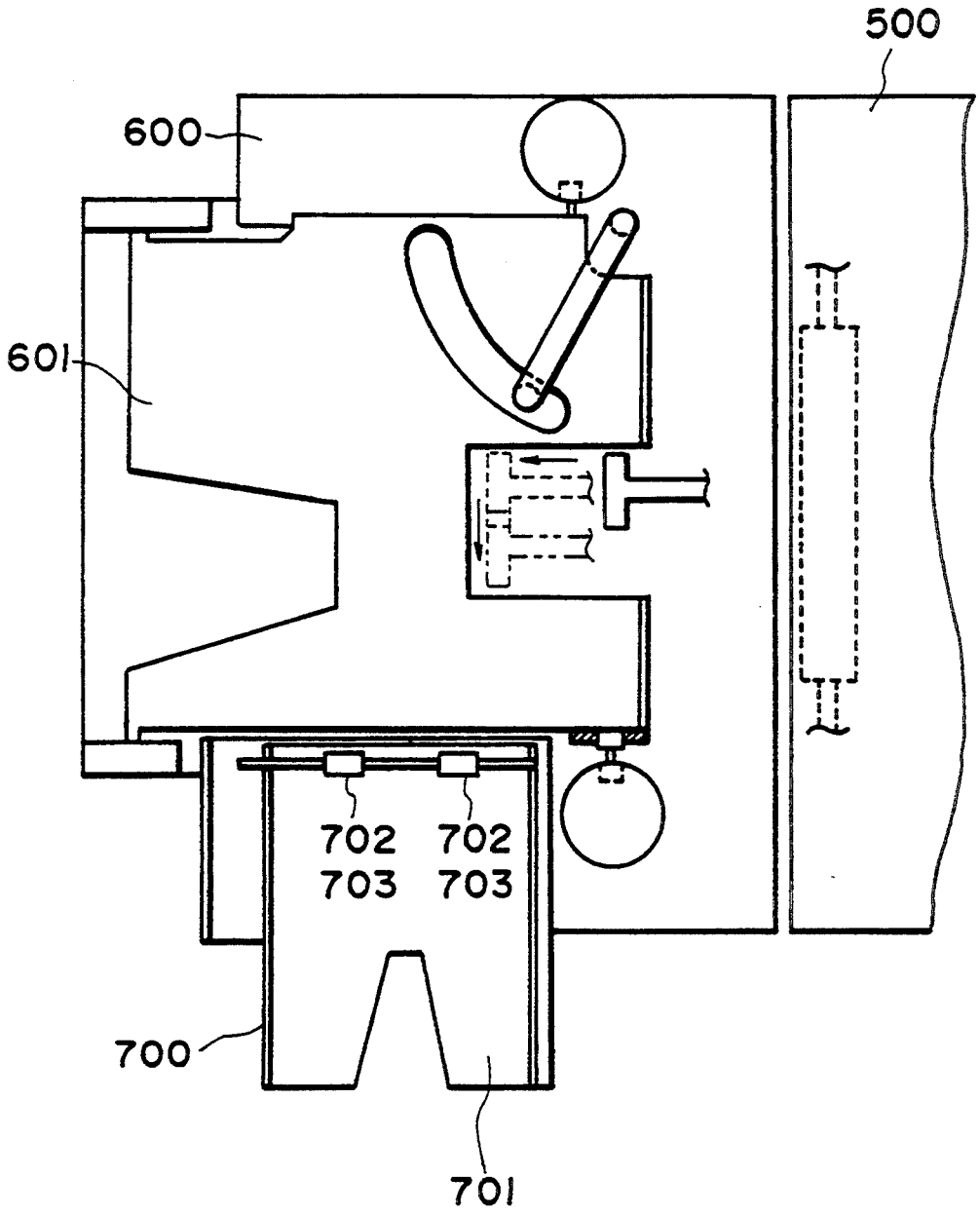
FIG. 54 PRIOR ART
FIG. 54 is a top plan view of a conventional apparatus.
Figure 55:
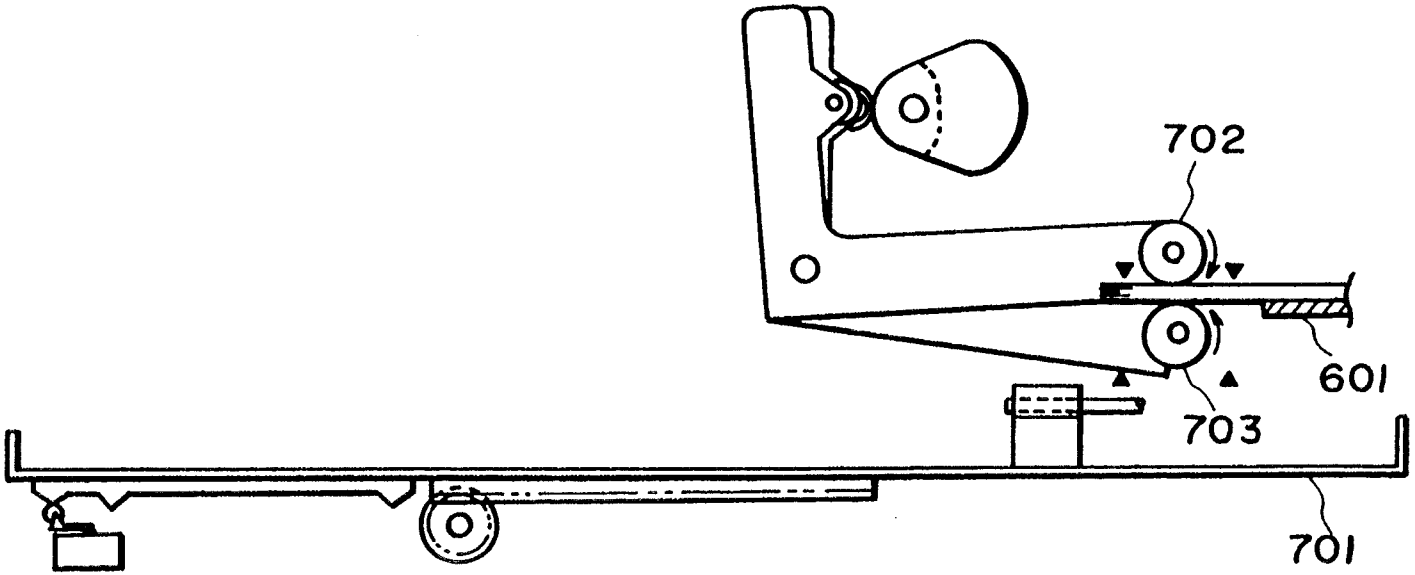
FIG. 55 PRIOR ART
FIG. 55 is a side view of the conventional apparatus.
Figure 56:
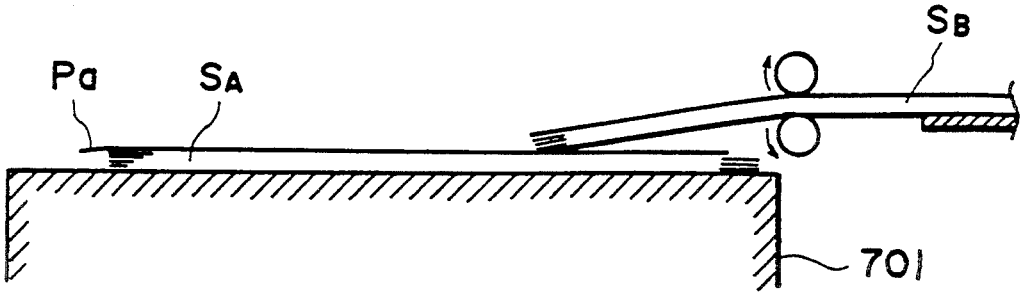
FIG. 56 PRIOR ART
FIG. 56 is a front view illustrating operation in the conventional apparatus.
Figure 57:
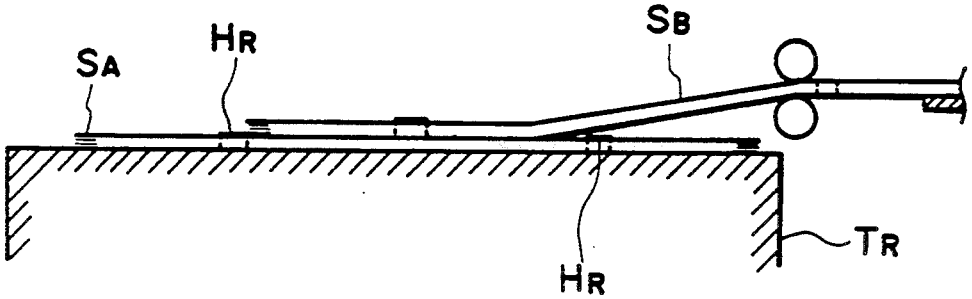
FIG. 57 PRIOR ART
FIG. 57 illustrates the operation of the apparatus.
Figure 58:
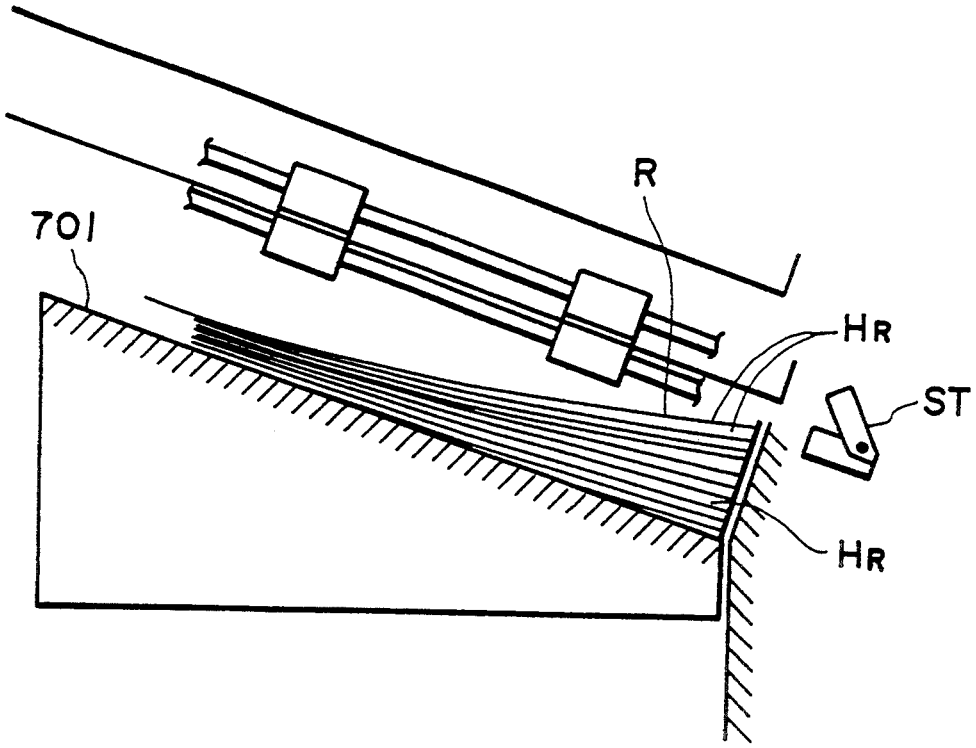
FIG. 58 PRIOR ART
FIG. 58 is a sectional view of another conventional apparatus.
Figure 59:
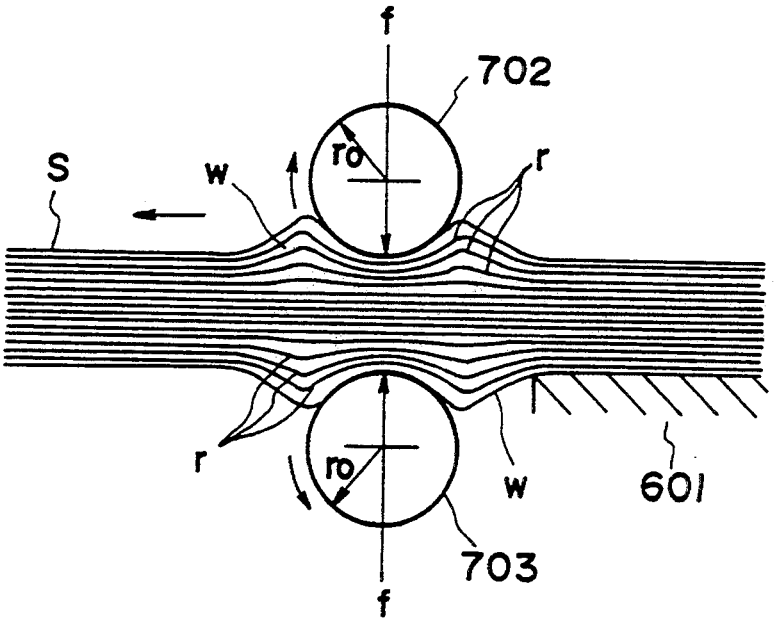
FIG. 59 PRIOR ART
FIG. 59 illustrates conveyance of the sheet set in the conventional apparatus.
Figure 60:
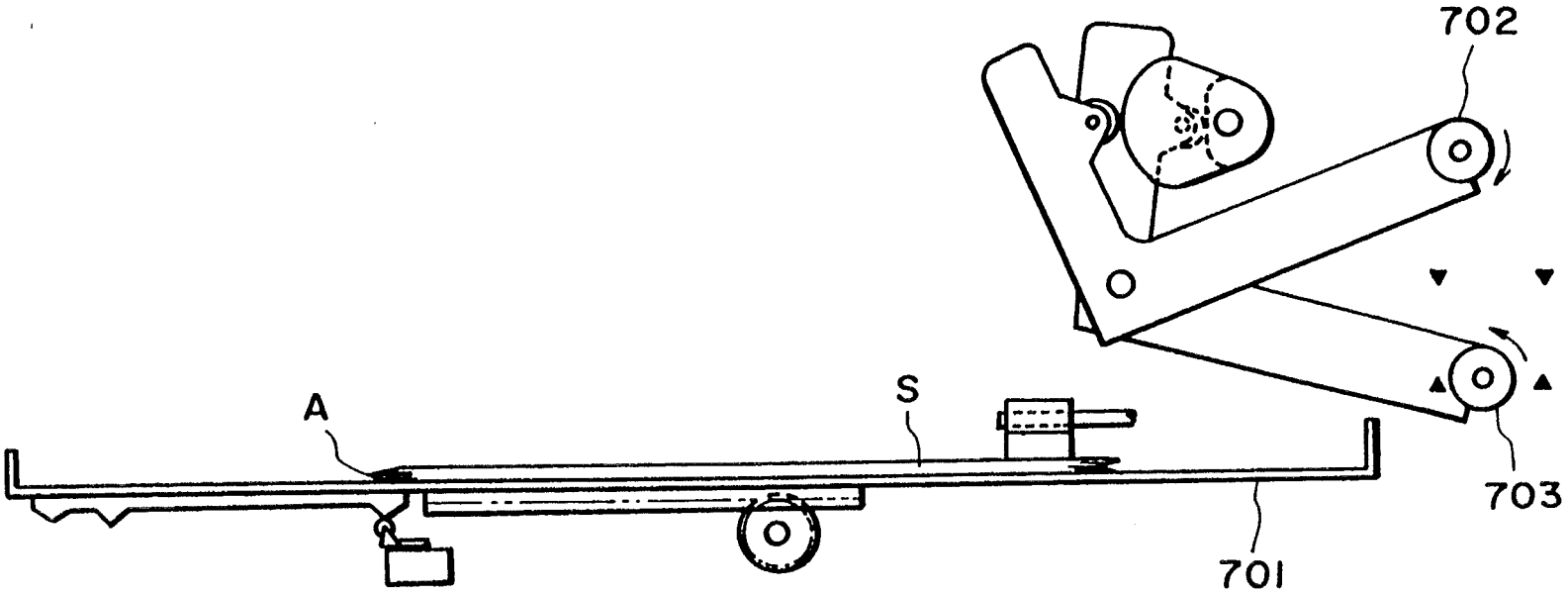
FIG. 60 PRIOR ART
FIG. 60 is a side view illustrating alignment of the sheet set in the conventional apparatus.

In the foregoing embodiment, the transfer of the sheet from the bin tray to the stacking tray is made through the intermediate tray. However, it is a possible alternative, for example, that the intermediate unit 1210 comprises only the conveying roller 1213 (or gripper) for conveying the sheets to the front side, and a stacking tray 1220 is disposed downstream thereof. The operations of the elements are the same as in the foregoing embodiments. As shown in FIG. 53 which is a top plan view of an apparatus shown in FIG. 52, the sets of sheets received on the bin trays are transferred by the conveying rollers 1213 of the intermediate unit 1210 movable up and down to the position faced to the respective bin trays, and the sheet sets are received by the stacking tray 1220 placed at a controlled level so as to meet the conveying rollers 1213.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus comprising:

at least one sheet discharging tray means for receiving and stacking discharged sheets;

feeding means for feeding a set of sheets from said discharging tray means;

stacking tray means for receiving and stacking the set of sheets fed by said feeding means;

an alignment reference member, disposed downstream of said stacking tray means with respect to a feeding direction of the set of sheets, for being abutted by an end surface of the sheet set coming thereto; and lowering means for gradually lowering said stacking tray means in accordance with an amount of sheets tacked thereon, and shifting means for moving said reference plate from the end of the sheet set when said stacking tray means lowers.

2. An apparatus according to claim 1, further comprising means for advancing lower part of the sheets of the set of sheets, when the sheet set is fed by said second feeding means.

3. An apparatus according to claim 2, wherein said second feeding means includes a pair of rotatable members capable of nipping the sheet set therebetween, and wherein a lower one of the rotatable members is of lower hardness material than the upper one of the rotatable members to increase a sheet feeding distance.

4. A sheet post-processing apparatus comprising:
at least one sheet discharging tray means for receiving and stacking discharged sheets;
first feeding means for feeding a set of sheets on said discharging tray means;
intermediate tray means for stacking the set of sheets fed by said first feeding means;
second feeding means for feeding the set of sheets on said intermediate tray means; and
stacking tray means for stacking the set of sheets fed by said second feeding means, wherein said first feeding means feeds the sheet set substantially perpendicularly to the sheet discharging direction, and wherein said second feeding means feeds the sheet set in a direction substantially perpendicular to a feeding direction of said first feeding means.

5. An apparatus according to claim 4, wherein said discharging tray means is inclined in a direction of discharge of the sheets, and said intermediate tray means is inclined in the same direction, and wherein said stacking tray means has a sheet set receiving surface which is substantially horizontal.

6. An apparatus according to claim 4, further comprising binding means for binding the sheet sets on said intermediate tray.

7. An apparatus according to claim 4, further comprising lifting means for gradually lowering said stacking tray means in accordance with amount of the sheet sets thereon.

8. An apparatus according to claim 4, wherein said first feeding means comprises pushing means for pushing the sheet set out of said discharging tray means, gripping means for feeding the sheet set pushed out by said pushing means and feeding it to said intermediate tray means, and wherein said second feeding means comprises a pair of rotatable members capable of nipping the sheet set on said intermediate tray means and feed it.

9. An apparatus according to claim 4, further comprising an alignment reference plate to be abutted by an end of the sheet set, disposed at a downstream end of said stack tray means with respect to a sheet feeding direction.

10. An apparatus according to claim 9, further comprising lowering means for gradually lowering said stacking tray means in accordance with an amount of sheets stacked thereon, and shifting means for moving said reference plate from the end of the sheet set when said stacking tray means lowers.

11. A sheet post-processing apparatus comprising:
at least one sheet discharging tray means for receiving and stacking discharged sheets;
first feeding means for feeding a set of sheets on said discharging tray means;
intermediate tray means for stacking the set of sheets fed by said first feeding means;
second feeding means for feeding the set of sheets on said intermediate tray means;
stacking tray means for stacking the set of sheets fed by said second feeding means, wherein said discharging tray means comprises a plurality of bin trays which are movable up and down, and said intermediate tray means is fixed at a predetermined position, and wherein said stacking tray means can move gradually in accordance with an amount of stacked sheet sets, and wherein said first feeding means feeds the sheet set substantially perpendicularly to the sheet discharging direction.

12. A sheet post-processing apparatus comprising:
at least one sheet discharging tray means for receiving and stacking discharged sheets;
first feeding means for feeding a set of sheets on said discharging tray means;
intermediate tray means for stacking the set of sheets fed by said first feeding means;
second feeding means for feeding the set of sheets on said intermediate tray means;
stacking tray means for stacking the set of sheets fed by said second feeding means; and
binding means for binding the set of sheets on said discharging tray means, wherein said binding means is movable in a direction of movement of said first feeding means, and functions also as said first feeding means.

13. A sheet post-processing apparatus comprising:
at least one sheet discharging tray means for receiving and stacking discharged sheets;
first feeding means for feeding a set of sheets on said discharging tray means;
intermediate tray meads for stacking the set of sheets fed by said first feeding means;
second feeding means for feeding the set of sheets on said intermediate tray means; and
stacking tray means for stacking the set of sheets fed by said second feeding means,
wherein said discharging tray means includes a plurality of fixed bin trays, and said first and second feeding means, said intermediate tray means and said stacking tray means are movable up and down.

14. An apparatus according to claim 13, further comprising lifting means for lifting said first and second feeding means, said intermediate tray means and said stacking tray means so that the sheet sets are sequentially fed from a lower one of the bin trays.

15. A sheet post-processing apparatus comprising:
at least one sheet discharging tray means for receiving and stacking discharged sheets;
first feeding means for feeding a set of sheets on said discharging tray means;
intermediate tray means for stacking the set of sheets fed by said first feeding means;
second feeding means for feeding the set of sheets on said intermediate tray means;
stacking tray means for stacking the set of sheets fed by said second feeding means;
an alignment reference plate to be abutted by an end of the sheet set, disposed at a downstream end of said stack tray means with respect to a sheet feeding direction; and
means for advancing lower part of the sheets of the set of sheets, when the sheet set is fed by said second feeding means.

16. An apparatus according to claim 15, wherein said second feeding means includes a pair of rotatable members capable of nipping the sheet set therebetween, and wherein a lower one of the rotatable members is of low hardness material to increase a sheet feeding distance.

17. An image forming apparatus comprising:
image forming means;
sheet supplying means for supplying a sheet to said image forming means;
at least one sheet discharging tray means for receiving and stacking sheets discharged from said image forming means;

first feeding means for feeding a set of sheets on said discharging tray means;

intermediate tray means for stacking the set of sheets fed by said first feeding means;

second feeding means for feeding the set of sheets on said intermediate tray means; and stacking tray means for stacking the set of sheets fed by said second feeding means, wherein said first feeding means feeds the sheet set substantially perpendicularly to the sheet discharging direction, and wherein said second feeding means feeds the sheet set in a direction substantially perpendicular to a feeding direction of said first feeding means.

18. An image forming apparatus comprising:

image forming means;

sheet supply means for supplying a sheet to said image forming means;

at least one sheet discharging tray means for receiving and stacking sheets discharged from said image forming means;

feeding means for feeding a set of sheets from said discharging tray means;

stacking tray means for receiving and stacking the set of sheets fed by said feeding means;

an alignment reference member, disposed downstream of said stacking tray means with respect to a feeding direction of the set of sheets, for being abutted by an end surface of the sheet set coming thereto; and lowering means for gradually lowering said stacking tray means in accordance with an amount of sheets stacked thereon, and shifting means for moving said reference plate from the end of the sheet set when said stacking tray means lowers.

19. A sheet post-processing apparatus comprising:

a plurality of fixed sheet discharging tray means for receiving and stacking sheets discharged;

first feeding means for feeding a set of sheets on said discharging tray means;

intermediate tray means for stacking the set of sheets fed by said first feeding means, said intermediate tray means being movable to any one of said tray means;

second feeding means for feeding the set of sheets on said intermediate tray means;

movable stacking tray means for stacking the set of sheets fed by said second feeding means;

stacking tray moving means for moving said stacking tray means so that a top surface of the sheets on said stacking tray means is aligned with said second feeding means;

wherein said intermediate tray means sequentially receives the sets of sheets from lower one of said discharging tray means.

20. An apparatus according to claim 19, further comprising detecting means for detecting a surface of the sheet set when said stacking tray means is at a lower limit position, and discriminating means for discriminating a number of trays existing above the surface detected by said surface detecting means.

21. An image forming apparatus comprising:

image forming means;

sheet supplying means for supplying a sheet to said image forming means;

a plurality of fixed sheet discharging tray means for receiving and stacking sheets discharged from said image forming means;

first feeding means for feeding a set of sheets on said discharging tray means;

intermediate tray means for stacking the set of sheets fed by said first feeding means, said intermediate tray means being movable to any one of said tray means;

second feeding means for feeding the set of sheets on said intermediate tray means;

movable stacking tray means for stacking the set of sheets fed by said second feeding means; and stacking tray moving means for moving said stacking tray means so that a top surface of the sheets on said stacking tray means is aligned with said second feeding means, wherein said intermediate tray means sequentially receives the sets of sheets from a lower one of said discharging tray means.

* * * * *

UNITED STATES PATENT AND TRADEMARK OFFICE

CERTIFICATE OF CORRECTION

PATENT NO. : 5,443,248

DATED : August 22, 1995

INVENTOR(S) : KENICHI HAYASHI, et al.

It is certified that error appears in the above-indentified patent and that said Letters Patent is hereby corrected as shown below:

COLUMN 1

Line 22, "a" should read --an--.
Line 42, "staked" should read --stacked--.

COLUMN 2

Line 19, "are" should read --being--.

COLUMN 3

Line 63, "FIG. 18 illustrates" should read --FIGS. 18A and 18B illustrate--.

COLUMN 4

Line 47, "s" should read --is--.

COLUMN 10

Line 23, "plate 253," should read --plate 255,--.

COLUMN 15

Line 16, "is in-" should read --to--.
Line 17 should be deleted.
Line 54, "sets" should read --set--.

COLUMN 16

Line 4, "sets" should read --set--.
Line 61, "is" should be deleted.

UNITED STATES PATENT AND TRADEMARK OFFICE

CERTIFICATE OF CORRECTION

PATENT NO. : 5,443,248 Page 2 of 2

DATED : August 22, 1995

INVENTOR(S) : KENICHI HAYASHI, et al.

It is certified that error appears in the above-indentified patent and that said Letters Patent is hereby corrected as shown below:

COLUMN 22

Line 1, "is" should read --are--.
Line 58, "tacked" should read --stacked--.
Line 62, "lower" should read --a lower--.

COLUMN 23

Line 30, "amount" should read --an amount--.
Line 40, "feed" should read --feeding--.

COLUMN 24

Line 24, "meads" should read --means--.
Line 54, "lower" should read --a lower--.

Signed and Sealed this

Twenty-third Day of January, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,443,248

DATED : August 22, 1995

INVENTOR(S) : KENICHI HAYASHI, et al.

It is certified that error appears in the above-indentified patent and that said Letters Patent is hereby corrected as shown below:

COLUMN 15:

line 17, delete "creased"

Line 17 should read --more than 51 sheets, the electric stapler is not--.

COLUMN 22:

Line 63, delete "second".

Signed and Sealed this

Fifteenth Day of October, 1996

Bruce Lehman

*Attest:*

BRUCE LEHMAN

*Attesting Officer*

*Commissioner of Patents and Trademarks*